US010809003B2

(12) United States Patent
De Beer et al.

(10) Patent No.: US 10,809,003 B2
(45) Date of Patent: Oct. 20, 2020

(54) METHOD AND APPARATUS AND CONTAINER FOR FREEZE-DRYING

(71) Applicant: RheaVita BV, Gent-Zwijnaarde (BE)

(72) Inventors: Thomas De Beer, Bachte (BE); Jozef Antonius Willem Maria Corver, Nuenen (NL)

(73) Assignee: RHEAVITA BV, Gent-Zwijnaarde (BE)

( * ) Notice: Subject to any disclaimer, the term of this patent is extended or adjusted under 35 U.S.C. 154(b) by 23 days.

(21) Appl. No.: 16/325,618

(22) PCT Filed: Aug. 10, 2017

(86) PCT No.: PCT/EP2017/070306
§ 371 (c)(1),
(2) Date: Feb. 14, 2019

(87) PCT Pub. No.: WO2018/033468
PCT Pub. Date: Feb. 22, 2018

(65) Prior Publication Data

US 2019/0178576 A1 Jun. 13, 2019

(30) Foreign Application Priority Data

Aug. 16, 2016 (EP) ..... 16184288

(51) Int. Cl.
*F26B 5/06* (2006.01)
*F26B 25/22* (2006.01)

(52) U.S. Cl.
CPC ..... *F26B 5/06* (2013.01); *F26B 25/22* (2013.01)

(58) Field of Classification Search
CPC ..... F26B 5/00; F26B 5/06; F26B 3/00; F26B 3/02; F26B 25/00; F26B 25/22
(Continued)

(56) References Cited

U.S. PATENT DOCUMENTS 5,522,155 A * 6/1996 Jones ..... B65D 51/241 34/286
7,461,465 B2 12/2008 Lee-Smith
(Continued)

FOREIGN PATENT DOCUMENTS

CA 3033778 A1 * 2/2018 ..... F26B 25/22
CN 205825599 U 12/2016
(Continued)

OTHER PUBLICATIONS

Borgognoni et al., "Freeze-Drying Microscopy in Mathematical Modeling of a Biomaterial Freeze-Drying," Brazilian Journal of Pharmaceutical Sciences, vol. 48, No. 2, Apr./Jun. 2012, 8 Pages.
(Continued)

*Primary Examiner* — Stephen M Gravini
(74) *Attorney, Agent, or Firm* — Workman Nydegger

(57) ABSTRACT

A method of drying (sublimation or desorption) a frozen product stored in a container, comprising: a) capturing a thermal IR image of the container wall using a thermal IR camera; b) processing the thermal IR image by calculating temperature values of points located on the outer surface of the container wall; c) calculating a maximum temperature of the product in the container using a mathematical model that models heat flow and that models progress of the drying process; d) controlling an amount of power supplied to the container based on the calculated maximum product temperature and on a temperature safety_margin. A freeze drying apparatus for performing said method. A container having a specific shape for use in such a process.

16 Claims, 24 Drawing Sheets

(58) Field of Classification Search
USPC ..... 34/284, 92
See application file for complete search history.

(56) References Cited

U.S. PATENT DOCUMENTS

| | | | | |
|---|---|---|---|---|
| 8,677,649 | B2 | 3/2014 | Böttger et al. | |
| 9,046,303 | B2 | 6/2015 | Yagi | |
| 9,459,044 | B1 | 10/2016 | Haddock et al. | |
| 9,488,410 | B2 | 11/2016 | Sawada et al. | |
| 9,863,699 | B2 * | 1/2018 | Corbin, III | A01N 1/0263 |
| 9,863,701 | B2 * | 1/2018 | Robinson | A61K 9/19 |
| 9,945,611 | B2 * | 4/2018 | DeMarco | F26B 5/065 |
| 10,094,616 | B2 * | 10/2018 | Carin | F26B 19/005 |
| 10,136,771 | B1 * | 11/2018 | Dykes | A47K 10/48 |
| 10,197,331 | B2 * | 2/2019 | Kokugan | B01D 11/02 |
| 10,240,867 | B2 * | 3/2019 | Zielinski | F26B 5/04 |
| 10,351,478 | B2 * | 7/2019 | Quinn | C04B 24/38 |
| 10,443,935 | B2 * | 10/2019 | Knight | B01L 7/00 |
| 10,451,346 | B1 * | 10/2019 | Nguyen | F26B 5/065 |
| 10,539,367 | B2 * | 1/2020 | Corbin, III | A61L 2/10 |
| 10,551,122 | B2 * | 2/2020 | Weisselberg | F26B 5/06 |
| 2006/0239331 | A1 | 10/2006 | Schwegman | |
| 2019/0178576 | A1 * | 6/2019 | De Beer | F26B 25/22 |

FOREIGN PATENT DOCUMENTS

| | | | | |
|---|---|---|---|---|
| CN | 109780821 | A | 5/2019 | |
| DE | 102016100163 | A1 | 7/2017 | |
| EP | 2074367 | B1 | 2/2012 | |
| EP | 3074707 | B1 | 1/2018 | |
| TW | 201104194 | A | 2/2011 | |
| WO | 9629556 | A1 | 9/1996 | |
| WO | 2013036107 | A2 | 3/2013 | |
| WO | 2015189655 | A1 | 12/2015 | |
| WO | WO-2018033468 | A1 * | 2/2018 | F26B 5/06 |

OTHER PUBLICATIONS

Chakraborty et al., "Prediction of Optimal Conditions of Infrared Assisted Freeze-Drying of Aloe Vera (*Aloe barbadensis*) Using Response Surface Methodology," Separation and Purification Technology, vol. 80, 2011, pp. 375-384.

Chang et al., "Freeze-Drying Process Development for Protein Pharmaceuticals," Lyophilization of Biopharmaceuticals, American Association of Pharmaceutical Scientists, 2004, pp. 113-138.

De Meyer et al., "Evaluation of Spin Freezing Versus Conventional Freezing as Part of a Continuous Pharmaceutical Freeze-Drying Concept for Unit Doses," International Journal of Pharmaceuticals, vol. 496, 2015, pp. 75-85.

Emteborg et al., "Infrared Thermography for Monitoring of Freeze-Drying Processes: Instrumental Developments and Preliminary Results," Journal of Pharmaceutical Sciences, vol. 103, 2014, pp. 2088-2097.

Mrad et al., "Moisture Desorption Isotherms and Glass Transition Temperatures of Osmo-Dehydrated Apple and Pear," Food and Bioproducts Processing, vol. 91, 2013, pp. 121-128.

Pikal et al., "The Nonsteady State Modeling of Freeze Drying: In-Process Product Temperature and Moisture Content Mapping and Pharmaceutical Product Quality Applications," Pharmaceutical Development and Technology, vol. 1, 2005, pp. 17-32.

Sadikoglu et al., "Mathematical Modelling of the Primary and Secondary Drying Stages of Bulk Solution Freeze-Drying in Trays: Parameter Estimation and Model Discrimination by Comparison of Theoretical Results With Experimental Data," Drying Technology, vol. 15, 1997, pp. 791-810.

Van Bockstal et al., "Noncontact Infrared-Mediated Heat Transfer During Continuous Freeze-Drying of Unit Doses," Journal of Pharmaceutical Sciences, vol. 106, 2017, pp. 71-82.

Extended European Search Report from EP Application No. 16184288.5, dated Jul. 19, 2017.

International Search Report and Written Opinion from PCT Application No. PCT/EP2017/070306, dated Sep. 25, 2017.

* cited by examiner

FIG 4(A)
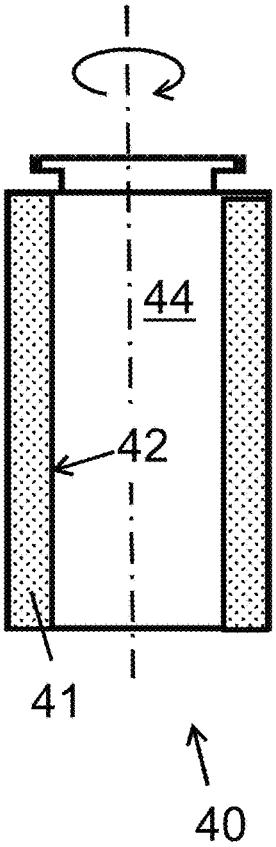
FIG 4(B)
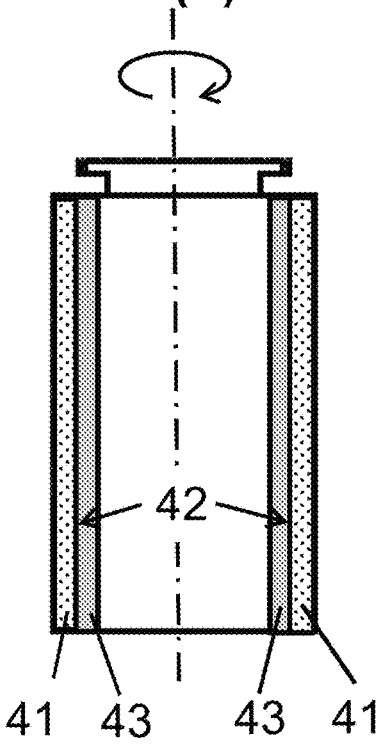
FIG 4(C)
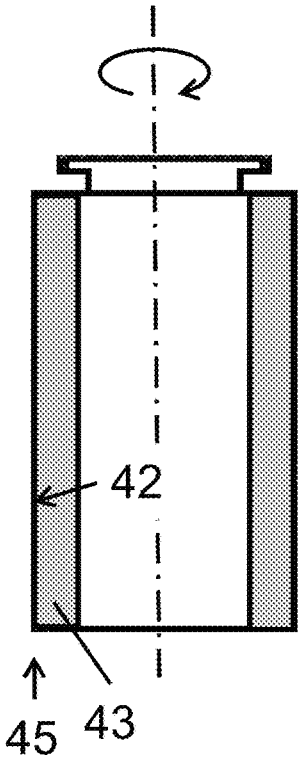
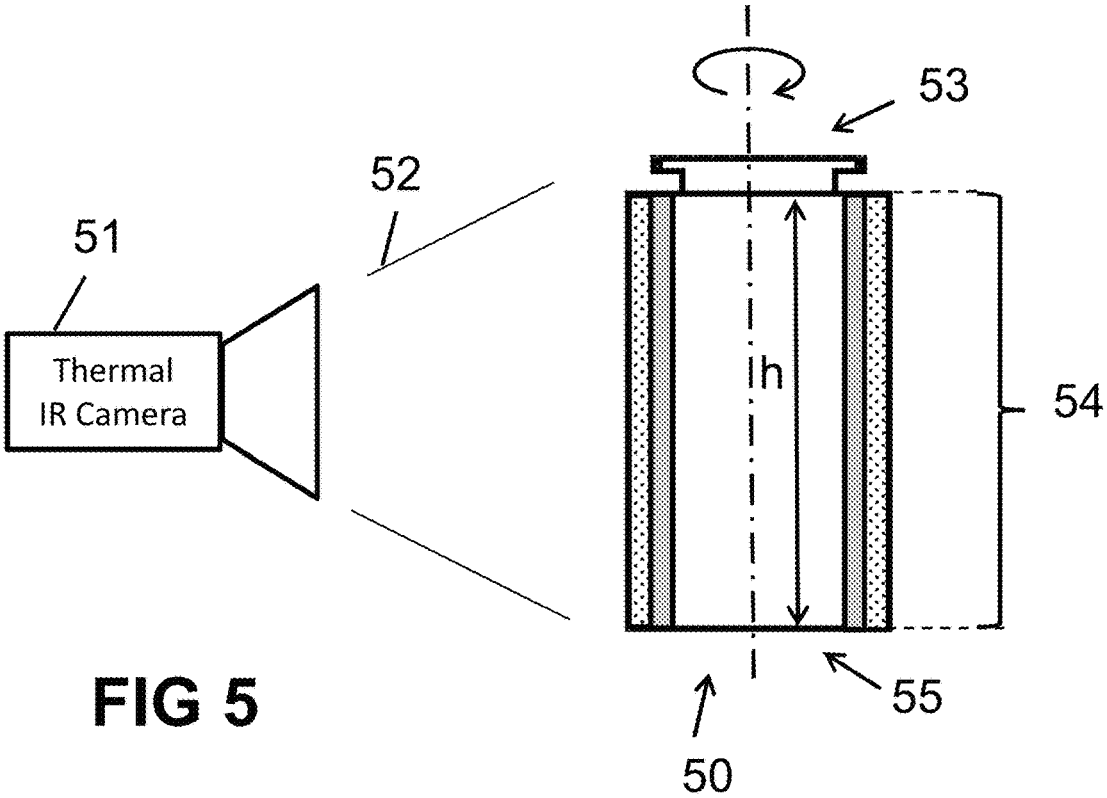
FIG 5

1300

1900

METHOD AND APPARATUS AND CONTAINER FOR FREEZE-DRYING

FIELD OF THE INVENTION

The present invention relates to the field of freeze-drying of products, including but not limited to pharmaceutical compositions, biological compositions, cosmetic compositions or medical nutritional products. In particular the present invention relates to a method of drying (sublimation and/or desorption) of a frozen product, and an apparatus for performing said method, and to a container especially adapted for use in such a method.

BACKGROUND OF THE INVENTION

The technique of "freeze-drying", also known as lyophilization is known for several decades. Stated in simple terms, it is a process typically used to a perishable material (e.g. pharmaceutical products or food products) or to make the material more convenient for storage, distribution and/or transport.

During the lyophilization or freeze drying process water is removed from a composition after it is frozen and placed under a vacuum, allowing the ice to change directly from a solid to a vapour state, without passing through a liquid state. The process comprises three main separate processes: (I) a freezing phase, (II) a primary drying phase (sublimation), and (III) a secondary drying phase (desorption).

A conventional method to execute the lyophilisation process is to place a batch of containers, each container provided with a dispersion or solution of composition in water, on hollow shelves inside a sealed chamber. With a thermal fluid flowing through the hollow shelves, the shelves are chilled which in turn reduces the temperature of the containers and the composition inside the containers. At the end of this freezing cycle (I) the composition is frozen as a plug at the bottom of the container, after which the pressure in the chamber is reduced and the shelves are simultaneously heated to force sublimation of ice crystals formed in the frozen composition. During the sublimation process (II) water vapour will be generated which leaves the surface of the plug in the bottom of the container. The ice-vapour interface, also called the "sublimation front" (further abbreviated herein as SF), moves slowly downward in the direction of the bottom of the container and in the direction of the shelf as the sublimation process progresses (see FIG. 3). Once a substantial part of the ice crystals has been removed, a porous structure of the composition remains. Commonly a secondary drying step (III) will follow to complete the lyophilization cycle wherein residual moisture (e.g. hydrate water, water dissolved in the amorphous matrix) is removed from the formulation interstitial matrix by desorption with elevated temperatures and/or reduced pressures.

Besides various advantages of freeze-drying including enhanced stability and shelf life of a dry composition powder, and rapid and easy reconstitution of the composition, the known method also suffers from serious drawbacks. A main drawback of the known method is that it is a slow and inefficient process. The whole lyophilisation cycle may last 20-60 hours depending on the product, process conditions and dimensions of the containers. Furthermore, the current industrial freeze dryers apply a process with a large number of containers that are processed in a batch, wherein within batch variations occur due to local variation in the process conditions which cannot be compensated for during the batch process. While using a large number of containers may be possible at industrial scale, this approach is not feasible during the development or experimental phase. In the current freeze dryers it is also not possible to optimize the freezing cycle in a highly controlled manner, which renders a constant batch quality even more difficult. When the process is suffering technical problems also the business risk associated with this is large, due to the impact on the entire batch.

U.S. Pat. No. 8,677,649 describes a device for large-scale lyophilization of pharmaceutical solutions in medical hollow bodies, including a lyophilization device and at least one camera. Images of the pharmaceutical solution to be lyophilized are recorded by the camera. The images may be used for controlling and/or monitoring the lyophilization process.

WO 2013/036107 discloses a method of freeze-drying injectable compositions, comprising: A) storing a quantity of a dispersion or solution of an injectable composition in an aqueous dispersion or solution medium in at least one ready-to-use vial, B) rotating the vial at least for a period of time to form a dispersion or solution layer at an inner surface of a circumferential wall of the vial, C) during rotating of the vial according to step B) cooling the vial to solidify and in particular to form ice crystals at the inner surface of the circumferential wall of the vial, and D) drying the cooled composition to sublime at least a portion of the ice crystals formed in the dispersion or solution by substantially homogeneously heating the circumferential wall of the vial.

In "Freeze-drying Process Development for Protein Pharmaceuticals", published in "Lyophilization of Biopharmaceuticals" (Costantino, H. R. and Pikal, M. J. eds), American Association of Pharmaceutical Scientists, pp. 113-138, Chang et. al. provide an overview of the impact of protein formulation variables on different stages of a protein freeze-drying process. (further referred to herein as [Chang]).

In "The Nonsteady State Modeling of Freeze Drying: In-Process Product Temperature and Moisture Content Mapping and Pharmaceutical Product Quality Applications, M. J. Pikal et al., School of Pharmacy, University of Connecticut, USA, describe a theoretical model of a freeze-drying process. The model is based on a set of coupled differential equations, where numerical results are obtained using finite element analysis. (further referred to herein as [Pikal]).

In "Evaluation of spin freezing versus conventional freezing as part of a continuous pharmaceutical freeze-drying concept for unit doses", L. De Meyer et. al. compare the sublimation rate of spin-frozen vials versus traditionally frozen vials in a batch freeze-dryer. NIR spectroscopy was used to monitor the process. (further referred to herein as [De Meyer]).

In "Noncontact Infrared-Mediated Heat Transfer During Continuous Freeze-Drying of Unit Doses", published in Pharmaceutics, Drug Delivery and Pharmaceutical Technology, Pieter-Jan Van Bockstal et al. describe a freeze-drying process which uses infrared (IR) heaters and near infrared spectroscopy. (further referred to herein as [Van Bockstal]).

In "Infrared Thermography for Monitoring of Freeze-Drying Processes: Instrumental Developments and Preliminary Results", HAKAN EMTEBORG et al. describe monitoring of a bulk product, in particular a cheese slurry stored on a shelf, using a thermal infrared (IR) camera. (further referred to herein as [Emteborg]). This document demonstrates (inter alia) that it is possible to use a thermal IR camera to measure a plurality of temperatures in a non-contact manner, by suitable calibration and by appropriately taking into account emission. This document is included herein by reference in its entirety, in particular the aspects related to the calibration and emission.

"Prediction of optimal conditions of infrared assisted freeze-drying of aloe vera (Aloe barbadensis) using response surface methodology", SEPARATION AND PURIFICATION TECHNOLOGY, vol. 80, no. 2, pp. 375-384, by Chakraborty et al, discloses an experimental study on infrared (IR) assisted freeze-drying of aloe vera (Aloe barbadensis) coupled with statistical analysis. Multivariate regression models are used to evaluate the influence of process parameters on the quality of the freeze-dried aloe vera powder. Optimal freeze-drying conditions of IR power, product temperature and drying time were determined. Separate validation experiments at the derived optimal conditions were performed to validate the predictive ability of the model equations.

WO 2015/189655 discloses a system for detecting a quantity of solvent, extracted from a product to be subjected to lyophilization, by measuring the quantity of material solidified on the condenser of a lyophilizing system. The amount of liquid extracted by sublimation from the product to be subjected to lyophylization is accumulated on the condenser in solid form, hence, the measurement of the quantity of material formed is detectable through weighing cells or another measuring system. Thus, the disclosure aims at determining—at any stage of a lyophilization process—the amount of solvent extracted from the matrix to be subjected to lyophilization, for monitoring the process to intervene where required, establishing the end-point in a definite manner and guaranteeing constant reproducibility.

US 2006/239331 discloses a wireless parameter sensing system for a flask for use in lyophilization and a method of controlling a lyophilization process based on the sensed readings. The wireless parameter sensing system may include a stopper adapted to be removably secured to an open end of the flask. A control unit may be positioned within an inner portion of the stopper. A parameter sensor may be connected with the control unit. A radio frequency transmitter may be connected with the control unit, wherein the control unit is operable to periodically transmit a parameter reading from the parameter sensor with the transmitter.

There is a need to further improve methods of freeze-drying.

SUMMARY OF THE INVENTION

It is an object of embodiments of the present invention to provide a reliable method for freeze-drying products, and an apparatus performing that method.

It is an object of particular embodiments of the present invention to provide a method and apparatus that facilitate improved process control.

It is an object of particular embodiments of the present invention to provide a method and apparatus that allow increased throughput while guaranteeing individual product quality.

It is an object of particular embodiments of the present invention to provide a method and apparatus that allows or provides improved quality control and/or quality assurance.

These objectives are accomplished by a method and a device and a container and a kit of parts according to embodiments of the present invention.

It is an advantage of embodiments of the present invention that a good process efficiency and/or a good product quality, e.g. a good uniformity of the product, can be achieved.

In a first aspect, the present invention provides a method of drying a frozen product stored in a container having a container wall defining a cavity for holding said product, the method being a method of drying by sublimation or being a method of drying by desorption, the method comprising the steps of: a) capturing a thermal IR image of at least a portion of the container wall using at least one thermal IR camera; b) processing the thermal IR image by determining a plurality of temperature values associated with a plurality of points located on an outer surface of the container wall, using an image processing module; c) calculating a maximum temperature of the product in the container using a mathematical model that models heat flow and that models progress of the drying process; d) controlling an amount of power supplied to at least a portion of the container based on the calculated maximum product temperature and on a temperature safety margin; e) repeating at least once the steps a) to e).

The amount of power can be supplied to the container by controlling at least one parameter selected from the group of: power supplied to at least one heater, position of the at least one heater relative to the container, orientation of the at least one heater relative to the container, and exposure time of the container relative to said heater, The temperature safety margin may be a predefined constant value (depending on the specific product) indicative of a temperature difference between a critical product temperature and the product temperature itself, or may be dynamically calculated (dependent on the specific product and on the progress obtained from the model).

It is an advantage of using a thermal IR camera because it allows to determine a temperature without physically contacting the product, and allows to capture a large number of temperatures at once (in a single image, depending on the resolution of the camera), and because the measurement is almost instantaneous, and because it reduces the risk of contamination, in contrast to for example the use of probes inserted in the product.

In contrast to prior art methods where for example an image is taken from a position above the product, in order to capture a temperature of the product itself, and a temperature of the container is ignored, in the present invention the temperature of the container wall is measured, and this data is provided to a mathematical model that models the sublimation process of said specific product in said specific container in one way or another. As a result the temperature at the sublimation front of each individual container with product becomes known, which in the prior art cannot be achieved.

The method can be applied for example for cylindrical containers which contain frozen products substantially in the form of a thin layer against an inner wall of the container, in which case the at least one thermal IR camera is preferably arranged to capture a major portion of the cylindrical wall of the container.

The portion of the container wall may comprise a line segment defined by an intersection of the outer wall surface and a virtual plane through a longitudinal axis of the container.

The portion of the container wall may comprise a curve segment defined by an intersection of the outer wall surface and a virtual plane perpendicular to the longitudinal axis of the container.

The portion of the container wall may comprise a surface portion located between a first and a second plane perpendicular to the longitudinal axis of the container (e.g. horizontal planes in case of cylindrical containers suspended in an upright position) and spaced at a first distance from each other, and between a third and a fourth plane containing the longitudinal axis of the container (e.g. vertical planes in said example).

In an embodiment, the method further comprises step f) preceding step d) of determining a temperature safety margin as a temperature difference between the temperature of the product and a predefined critical temperature related to the product based on said calculated progress.

It is a major advantage of this method that the safety margin is dynamically calculated as opposed to prior art methods wherein a fixed safety margin is used. Dynamically adjusting the safety margin allows that the safety margin can be decreased during some portions of the drying process when the risk of overheating the product is relatively low (e.g. at the beginning of the sublimation process and at the end of the desorption process), but is increased during other portions of the drying process when the risk of overheating the product is relatively large (e.g. at the beginning of the desorption process and at the end of the sublimation process). Dynamically adjusting the safety margin allows the overall drying process to proceed faster, yet in a fully reliable manner, without compromising the quality of the product.

Stated in simple terms, (as shown in FIG. 12(*b*)), the value of the temperature safety margin can for example be determined if the progress of the sublimation or desorption is known.

The container is preferably arranged in an upright position, meaning that its longitudinal axis preferably forms an angle of less than 45° with a "vertical line" (i.e. the direction of gravitation), preferably less than 25°, preferably less than 10°.

The at least one heater is preferably at least one IR radiator.

The at least one heater is preferably arranged for heating a side wall of the container, in particular over a portion of the height where a substance is located, preferably excluding an upper portion of the container where no substance is located, and preferably excluding to heat the product inside the container directly (e.g. by direct radiation from above).

In preferred embodiments the product comprises a pharmaceutical substance and an aqueous solvent, but the present invention is not limited to pharmaceutical products, and can also be used for other products, such as for example biological compositions, cosmetic compositions, medical nutritional products and non-aqueous solvents such as alcohol.

In preferred embodiments, the container has a bottom wall portion and a side wall portion. Preferably the bottom wall portion is substantially flat or planar, or at least has a shape such that the container can be placed on a horizontal surface without falling. Preferably the side wall portion has a shape such that an intersection of the side wall portion and a plane perpendicular to the longitudinal axis of the container is circular. Preferably the wall thickness of the side wall portion is substantially constant over the height of the container.

In an embodiment, step f) comprises calculating the temperature safety margin using the mathematical model by taking into account at least one of: a predetermined content of said product; at least a subset of the temperature values calculated in step b); an estimated or calculated cumulative amount of heat energy provided to or absorbed by the container.

The "predetermined content" includes a predetermined amount and a predetermined composition. The amount is typically an amount in the range from 0.1 ml to 100.0 ml.

The subset of temperature values may comprise at least two or at least three or more than three temperature values corresponding to a corresponding number of points located on the above described "line segment" or "curve segment" or "surface portion" on the outside surface of the container wall.

The cumulative amount of heat energy absorbed by the container can for example be calculated based on the amount of energy supplied to the at least one heater, and by calculating or estimating the amount of energy transferred from the heater to the container, and by calculating or estimating the amount of energy emitted or reflected by the container.

In an embodiment, the container has a longitudinal axis and is rotated around its longitudinal axis and has a substantially circular cross-section in a plane perpendicular to said longitudinal axis; and the mathematical model is mainly based on heat transfer from an outside of the container wall, through the container wall, and through a portion of the product still containing ice crystals.

An underlying idea of this embodiment is that the cumulative amount of heat energy absorbed by the container can be accurately determined, e.g. estimated or calculated based on the measured temperatures on the outside of the container wall, and based on a calculated first temperature difference over the material of the container wall, and based on a calculated second temperature difference over an "outer portion" of the frozen product still containing ice crystals.

It is an advantage of rotating the container during the drying process, because in this way the amount of energy supplied to the container can be assumed to be substantially homogenously distributed over the circumferential circles of the container, but not necessarily in the height direction. This allows relatively simple mathematical models to be used.

In an embodiment, the method of drying is a method of sublimation, and the mathematical model is based on one of the following models:

A) a model of supplying heat energy to a body comprising three concentric cylindrical shapes, comprising: a) an outer cylinder formed by the container material; b) an intermediate cylinder in physical contact with the outer cylinder and comprising frozen product still containing ice crystals; c) an inner cylinder containing frozen product substantially free of ice crystals; or B) a model based on supplying heat energy to a body comprising a plurality of at least two disks, each disk comprising three concentric annular rings comprising: a) an outer ring formed by the container material; b) an intermediate ring in physical contact with the outer ring and comprising frozen product still containing ice crystals; c) an inner ring containing frozen product substantially free of ice crystals.

In both models, it is assumed that the energy supplied to the outer cylinder is used completely for sublimating the ice crystals.

An advantage of model (A) is its simplicity. This model is especially suitable if the thickness of the product in the container does not substantially change in height direction.

An advantage of model (B) is that it can take into account thickness variations of the product inside the container, and can control the heating accordingly, for example by moving the heater to deliberately heat the container non-uniformly, or by controlling more than one heater.

In an embodiment, the method of drying is or further comprises a method of desorption, and the mathematical model is based on one of the following models:

A) a model of supplying heat energy to a body comprising three concentric cylindrical shapes, comprising: a) an outer cylinder formed by the container material; b) an intermediate cylinder in physical contact with the outer cylinder, comprising product substantially free of ice crystals, and substantially free of moisture content; c) an inner cylinder containing product substantially free of ice crystals but still containing moisture content; or B) a model of supplying heat energy to a body comprising a plurality of at least two disks, each disk comprising three concentric annular rings: a) an outer ring formed by the container material; b) an intermediate ring in physical contact with the outer ring and comprising product substantially free of ice crystals, and substantially free of moisture content; c) an inner ring containing product substantially free of ice crystals but still containing moisture content.

In both models, it is assumed that the energy supplied to the container is used for warming up the product and for evaporating the moisture content.

In an embodiment, the container has a side wall portion having a cylindrical shape or a conical shape or a truncated conical shape or a paraboloid shape or a truncated paraboloid shape over at least a portion of the height of the container.

Preferably the side wall portion of the container has a substantially constant thickness in radial direction.

It is an advantage of using a container having any of the specified shapes over at least a portion of the container height, for example at least a quarter of said height, preferably at least 50% of said height or even more preferably at least 75% of said height, because, when this container is rotated about its longitudinal axis, heat provided by a nearby heat source (e.g. radiated by a IR heat source) can be distributed substantially uniformly in circumferential direction. in other words, such a container helps to prevent or reduce local temperature deviations, especially in circumferential direction of the container.

In an embodiment, step e) comprises one or more of the following actions: i) controlling an amount of power supplied to the at least one heater; ii) controlling a distance between the at least one heater and the cylinder; iii) controlling and orientation between the at least one heater and the cylinder; iv) controlling an exposure time of the container in front of the at least one heater.

In a preferred embodiment at least the amount of power supplied to the at least one heater is controlled, and optionally also the distance, orientation or exposure time, for example by moving the heater relative to the container, or by moving the container relative to the heater, or both.

In a particular embodiment the exposure time is controlled by moving the container faster or slower relative to the at least one heater.

In an embodiment, step d) comprises controlling the amount of power supplied to the container by controlling at least a first amount of power provided to a first heater and by controlling at least a second amount of power provided to a second heater, located at a different position relative to the container.

It is an advantage of using two separate heaters that it allows to provide a different amount of heat energy to for example a bottom portion of the container, where the layer of frozen product may have a larger thickness than an upper portion of the frozen product.

By suitably controlling the two heaters, the time of arrival of the sublimation front at the inside of the container wall (during the sublimation process) can be influenced. Ideally, the sublimation front would arrive at the same time independent of the height position.

In an embodiment, the at least one heater is movable relative to the container.

Moving can mean translating or rotating or tilting or a combination of these.

By controlling at least one of the power and/or distance and/or orientation of the heater, for example by controlling both power and distance, or for example by controlling both power and orientation, it is possible to influence the time of arrival of the sublimation front SF against an inside of the container wall.

In an embodiment, step d) comprises estimating or calculating at least one temperature of at least one point of the product located in the intermediate cylinder or in the intermediate ring using the mathematical model; and controlling the at least one heater comprises controlling said heater such that the product temperature is smaller than or equal to a critical temperature minus the safety margin.

As explained above, the product temperature must never be larger than the critical temperature Tcrit, otherwise the product is lost, but in order to speed-up the process, the control loop will try to heat in a manner such that the resulting product temperature approaches Tcrit-Tsm as close as possible, ideally such that the calculated (maximum) product temperature Tprod_max is equal to (Tcrit−Tsm) during.

A suitable control algorithm, for example so called "Proportional" Control, or any other suitable control, can be used to control the at least one heater.

In an embodiment, the amount of power supplied to the at least one heater is increased when the calculated product temperature is lower than the critical temperature minus the safety margin; and the amount of power supplied to the at least one heater is decreased or set to zero when the calculated product temperature is higher than the critical temperature minus the safety margin.

According to a second aspect, the present invention provides a method of freeze-drying a liquid product, comprising the steps of: g) providing a container; h) inserting the liquid products in said container; k) freezing the product in said container while rotating the container about its longitudinal axis at a predefined speed; applying a first drying step for removing ice crystals from the product, using a method according to the first aspect, or applying a second drying step for removing moisture content from the product, using a method according to the first aspect, or both.

In an embodiment, step g) comprises providing a container containing a side wall portion having a substantially constant thickness and having a substantially paraboloid shape or a truncated paraboloid shape over at least a quarter of the height of the container; and wherein step k) comprises freezing the product in said container while rotating the container about its longitudinal axis at a predefined speed chosen corresponding to the curvature of the paraboloid shape, such that the product will form a layer of substantially constant thickness against the side wall.

The liquid product may be a pharmaceutical product.

The at least one heater may be arranged for uniformly heating the side portion of the container, or stated more correctly, to provide heat to said container especially over the portion of the height where product is located.

It is an advantage of a container having a substantially paraboloid shape, or a truncated paraboloid shape and for example a flat portion at the bottom, that it is possible to provide a container with a frozen product located against the side wall of the container, even when rotating at moderate speed. This is especially beneficial for some pharmaceutical products for which high centrifugal forces due to fast rotation are not allowed.

Moreover, the process of sublimation and/or desorption of the product in the container can subsequently be better controlled, and the accuracy of the model can be further improved. This may be beneficial for process efficiency, but especially for quality of the dried product. Indeed, because the product layer has a substantially constant thickness, temperature variations (in height direction) are reduced, and the sublimation front (SF) will arrive at the container wall at approximately the same time for the entire product, hence the ice crystals are removed everywhere at the same time, and the somewhat arbitrary transition period between the sublimation process and desorption process occurs at the same time throughout the product.

It is noted that the speed of rotation during freezing can be chosen independently from the speed of rotation during sublimation or during desorption. Only the speed during freezing is related to the curvature of the paraboloid shape, because after freezing the shape of the frozen product is fixed.

Although it is well known that rotation of a cylindrical container containing a fluid results in a fluid surface having a paraboloid shape due to a combination of gravity and centrifugal forces, but gravity force and, as far as known to the inventors it is not known or at least insufficiently recognised in the prior art that by providing a container having a complementary paraboloid shape, the thickness of the product inside such a container will result in a paraboloid shape having a constant thickness, which shape can be fixed by freezing the product while rotating the container, as is typically done in a first step of a freeze-drying process.

It is a major advantage of using such a container because the time of arrival of the sublimation front at an upper portion of the product and at a lower portion of the product is by definition approximately the same, even without the use of multiple heaters per container, or even without having to move the one or more heaters. This also reduces the risk of "passing" the critical temperature on an upper side of the product when an upper part of the sublimation front has already arrived at the container wall, while a lower part of the sublimation front has not yet arrived.

Preferably the bottom side comprises or is a substantially flat portion because it allows to place the container in an upright position on the flat surface without falling. This can easily be obtained by choosing an appropriate diameter and height of the container as a function of the amount of products it should contain.

The at least one heater may have a paraboloid reflector or minor for providing substantially uniform heating to said container. But more than one heater may be used as well. The one or more heaters may be fixedly mounted or may be movable, for example displaceable or rotatable.

In a third aspect, the present invention also provides a freeze-drying apparatus for drying a frozen product stored in a container having a container wall defining a cavity holding said product, the apparatus being adapted for drying said product by sublimation and/or by desorption, the apparatus comprising: a) a thermal IR camera for capturing a thermal IR image of at least a portion of the container wall; b) an image processing module adapted for processing the thermal IR image by calculating a plurality of temperature values associated with a plurality of points located on an outer surface of the container wall; c) at least one heater arranged for heating at least a portion of the outer surface of the container wall; at least one of the following components: means for supplying power to the at least one heater, means for moving the at least one heater, means for moving the container; d) a controller adapted for repeatedly:

- calculating a temperature of the product in the container using a mathematical model that models heat flow and models progress of the drying process;
- calculating a temperature safety margin; using a mathematical model that models that models heat flow and progress of the drying process of said product in said container;
- calculating a temperature safety margin between the temperature of the product and a predefined critical temperature related to the product;
- controlling an amount of power supplied to at least a portion of the container by controlling at least one of the means for supplying power, the means for moving the at least one heater, and the means for moving the container.

In a fourth aspect, the present invention also provides a container suitable for use in a method according to the first or second aspect, or for use in a freeze-drying apparatus according to the third aspect, the container having a longitudinal axis, and comprising a container wall defining a cavity for holding a product to be freeze-dried; the container wall having a bottom portion and at least a lower side portion and optionally an upper side portion; the lower side portion having a substantially constant thickness over at least a portion of its height; a cross-section of the lower side portion in a plane containing the longitudinal axis defines at least one substantially parabolic shape or truncated parabolic shape; a cross section of the lower side portion in a plane perpendicular to the longitudinal axis having a substantially circular shape.

Preferably the lower side portion has a constant thickness over at least 50% of its height, or over at least 60% of its height, or over at least 70% of its height, or over at least 80% of its height. The extend over which the paraboloid shape extends in height direction, is in fact dependent on the maximum amount of product to be stored in the container and for which a constant layer thickness is desired. If the entire height is parabolic, there is no upper side portion, only a lower side portion.

In an embodiment, the container of the fourth aspect comprises a frozen pharmaceutical composition, or a frozen biological composition, or a frozen cosmetic composition or a frozen medical nutritional product located at an inner surface of said side portion.

In an embodiment, the container of the fourth aspect comprises a freeze-dried pharmaceutical composition, or a freeze-dried biological composition, or a freeze-dried cosmetic composition or a freeze-dried medical nutritional product located at an inner surface of said side wall portion.

In an embodiment, the container of the fourth aspect comprises a dried pharmaceutical composition, or a dried biological composition, or a dried cosmetic composition or a dried medical nutritional product, produced with a method according to the first aspect. or according to the second aspect.

In a fifth aspect, the present invention also provides a kit of parts comprising a freeze-drying apparatus, preferably in accordance with embodiments of the fourth aspect of the present invention and a container, preferably in accordance with embodiments of the fourth aspect of the present invention.

Particular and preferred aspects of the invention are set out in the accompanying independent and dependent claims. Features from the dependent claims may be combined with features of the independent claims and with features of other dependent claims as appropriate and not merely as explicitly set out in the claims.

These and other aspects of the invention will be apparent from and elucidated with reference to the embodiment(s) described hereinafter.

BRIEF DESCRIPTION OF THE DRAWINGS

FIG. 2(*a*) shows an example of a container comprising a substance that is frozen while the container is kept stationary in an upright position.

FIG. 2(*b*) shows an example of a container comprising a substance that is frozen while the container is being rotated around its longitudinal axis. The purpose of such rotation is that the substance forms a dispersion or solution layer at an inner surface of a circumferential wall of the container due to centrifugal forces.

FIG. 4(A) to FIG. 4(C) illustrate progress of the first drying step (sublimation) of the frozen substance in the spin-frozen container of FIG. 2(B), as a function of time, assuming that the frozen product forms a dispersion or solution layer of constant thickness against the inner surface of the container wall, and that the side wall of the container is uniformly heated.

FIG. 5 illustrates that a thermal infrared (IR) camera can be used to measure primarily the temperature of the outside surface of the container.

FIG. 10[*b*] shows a first, simple mathematical model wherein the substance in the container is represented by three concentrical cylinders. FIG. 10(*c*) shows a corresponding temperature profile through the container wall, and inside the substance.

FIG. 11(*a*) shows the temperature profile in case of optimal heating where the sublimation front moves as fast as possible. FIG. 11(*b*) shows the temperature profile in case too much heating power is supplied to the container. FIG. 11(*c*) shows the temperature profile in case more heating power could have been supplied to the container.

In FIG. 17 only two disks are shown: an upper disk and a lower disk. Each disk consists of three annular rings: an outer ring comprising material of the container wall, an intermediate ring comprising substance with ice crystals, and an inner ring comprising substance without ice crystals. The intermediate ring and the inner ring are separated by an interface known as "sublimation front". The thickness of the sublimation front is sometimes exaggerated in the figures for illustrative purposes.

Figure 1:
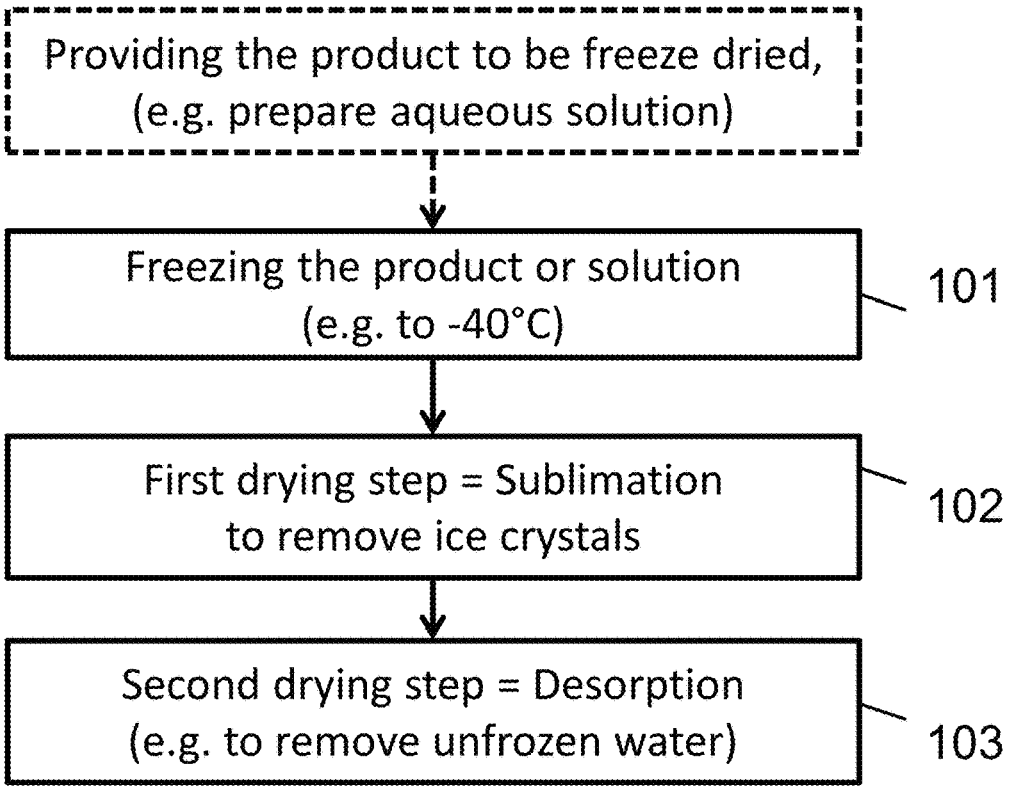
FIG 1 (prior art)
FIG. 1 shows the main steps of a freeze drying process, as is known in the art. The main focus of the present invention is related to the first drying step 102 and/or the second drying step 103. In the second drying step typically unfrozen water, e.g. ionically bound water, is removed.

The drawings are only schematic and are non-limiting. In the drawings, the size of some of the elements may be exaggerated and not drawn on scale for illustrative purposes. Any reference signs in the claims shall not be construed as limiting the scope. In the different drawings, the same reference signs refer to the same or analogous elements.

DETAILED DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

In this document the term "drying" is used to refer to either "sublimation" (also referred to as "the first drying step") or to "desorption" (also referred to as "the second drying step"), or to both. Depending on the context only one of these steps, or both steps are referred to.

It is noted that, when reference is made to the "relative position of the heater and the container" or the "relative position of the camera and the container", the angular position of the container around its longitudinal axis is not to be taken into account. What is actually meant is the "relative position of the heater with respect to the rotation axis of the container and with respect to a plane tangential to the bottom of the container", but for ease of the description, the former expression will be used.

In this document the term "local heater" is used to indicate a heater which is associated, at least temporarily, with a nearby container, and which is driven to provide heat mainly to said associated container, preferably without providing heat energy to other containers, or only in a reduced amount.

When referring to "measuring the temperature of the container wall" what is meant is that a thermal IR image is taken of the container wall, and that temperature information is extracted from the thermal IR image.

The present invention is related to a process of freeze-drying, and to a freeze-drying apparatus and also to a specific container suitable for use in a freeze-drying process and apparatus. Before describing the specifics of the present invention, the process of freeze-drying will be briefly explained with reference to FIG. 1.

FIG. 1 shows the main steps of a freeze drying process, as is well known in the art. Although the method of freeze-drying is applicable to various products, for example food products, the present invention will be explained for freeze-drying a pharmaceutical solution stored in individual containers, e.g. in one or more vials, but the present invention is not limited thereto, and can also be used for freeze-drying other products, or products stored in other containers, such as biological compositions, cosmetic compositions or medical nutritional products.

Referring to FIG. 1, the step of providing the product to be freeze-dried, for example but not limited to preparing an aqueous solution, is not considered part of the method of freeze-drying itself. It is assumed that at least one container comprising a frozen product to be freeze-dried is provided. Unless explicitly mentioned otherwise, the words "product" or "substance" or "composition" are used as synonyms, to indicate the material to be freeze-dried.

Figures 22A, 22B, 22C:
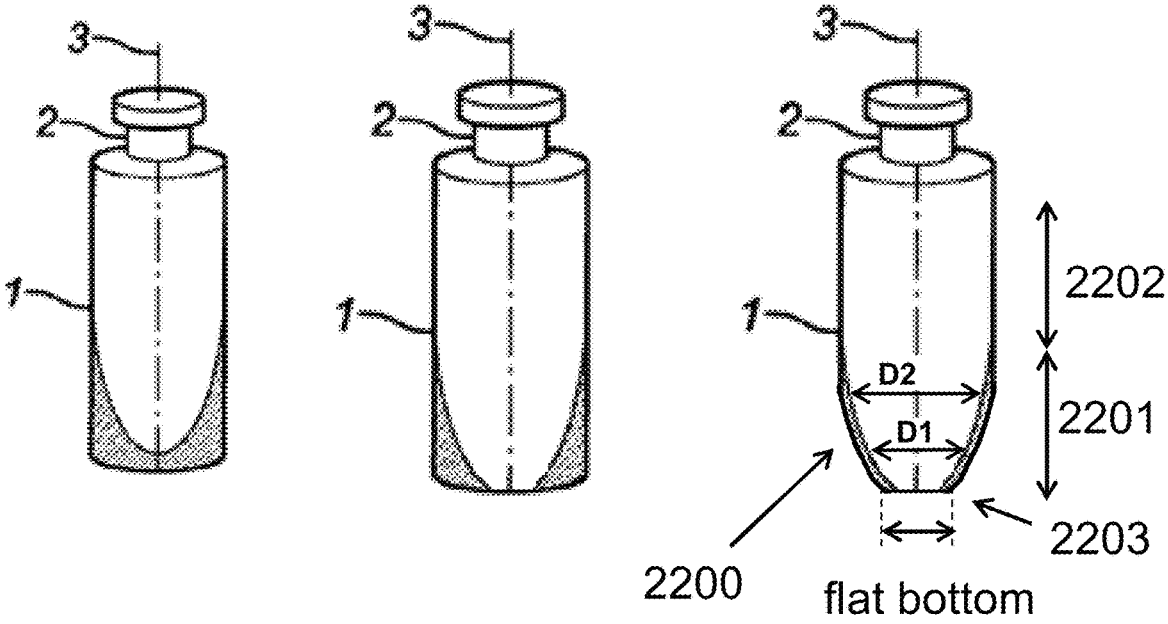
FIG. 22(A) and FIG. 22(B) show that a liquid substance stored in a cylindrical container, which is rotated at a constant speed around its longitudinal axis, forms a paraboloid surface (FIG. 22A) or a truncated paraboloid surface (FIG. 22B), as is known per se in the art.
FIG. 22(C) shows a container according to an embodiment of the present invention, having a wall portion with a paraboloid shape or a truncated paraboloid shape, such that the substance inside the container forms a layer of constant thickness against said wall portion, when the container is being rotated at a corresponding speed during freezing.

In a first step 101 the container holding the product is frozen in a conventional manner. This step typically involves placing the container (e.g. a vial) in a chamber under atmospheric pressure, and by lowering the temperature surrounding the container. This step is not the main focus of the present invention, although an advantageous effect can be obtained when using a special container, as will be explained in FIG. 22(C).

In a second step 102, generally known as the "first drying step" or "sublimation step", ice crystals are removed from the frozen product by sublimation. This step is typically performed under vacuum conditions.

In the third step 103, generally known as "second drying step" or "desorption step", remaining moisture is removed from the product in the container.

The two drying steps typically require 20 to 60 hours to complete, depending on the freeze dried product properties, the container dimensions and the applied process conditions. The main focus of the present invention is related to the first drying step 102 and the second drying step 103.

Figure 2:
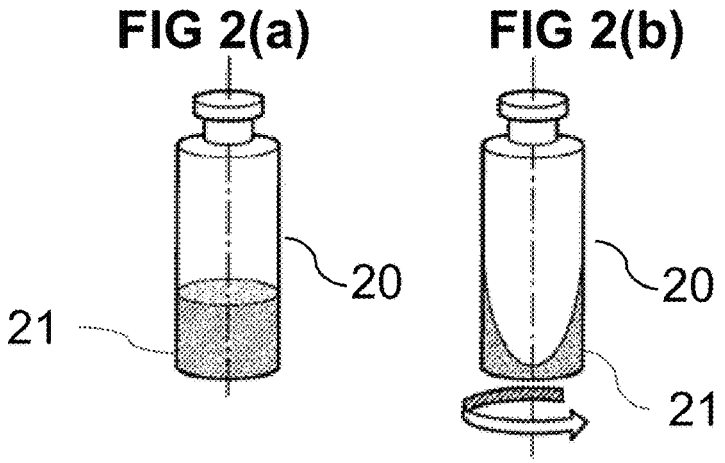
FIG 2 (prior art)
FIG. 2 shows two ways of freezing a substance in a container, known in the art.

FIG. 2 shows two ways of freezing a substance in a container, known in the art.

FIG. 2(*a*) shows an example of a container 20 comprising a substance 21 that is frozen while the container is kept stationary in an upright position, in which case the frozen product will be located at the bottom side of the container.

FIG. 2(*b*) shows an example of a container 20 comprising a substance 21 that is frozen while the container is being rotated around its longitudinal axis, such that the substance forms a layer, for example a relatively thin layer or a spread layer at an inner surface of a circumferential wall of the container due to centrifugal forces. In the prior art, typically a rotation speed of at least about 4000 RPM is used in order to obtain a layer having a constant thickness, but such a high speed is not suitable for all products, for example some pharmaceutical products containing particular proteins should not be exposed to such high centrifugal forces. Hence, for such products, either the product is to be frozen in a static position (see FIG. 2A) or spin-freezing has to be applied at a lower speed, resulting in a non-uniform thickness (see FIG. 2B), but this has consequences for the subsequent drying steps.

Figure 3:
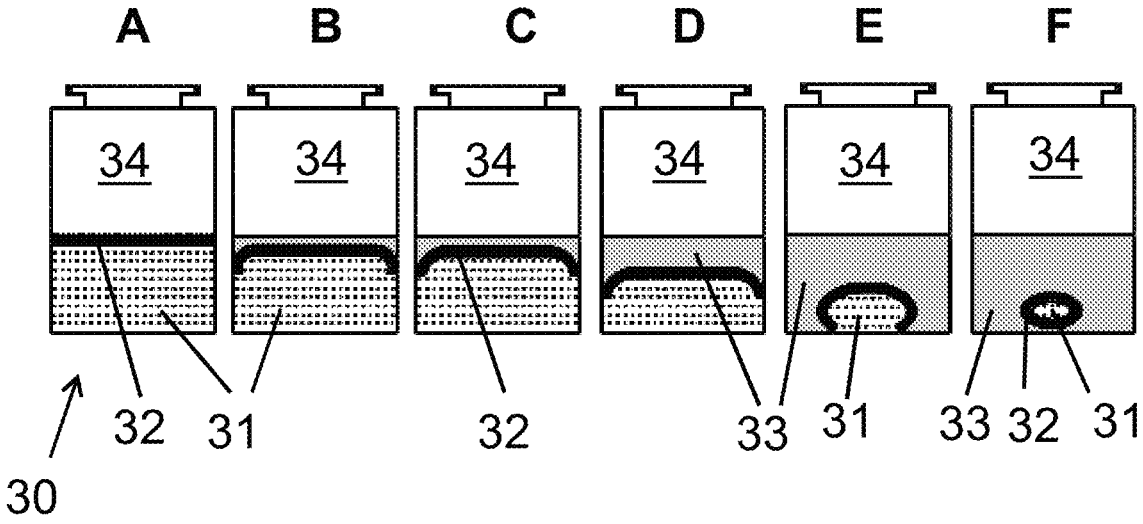
FIG 3 (prior art)
FIG. 3 illustrates progress of the first drying step (sublimation) of the frozen substance in the container of FIG. 2(A), as a function of time.

FIG. 3 illustrates a typical progress of the first drying step (sublimation) for the substance in the container of FIG. 2(A), as a function of time. This type of drying is typically referred to as "batch freeze drying" where typically hundreds or even thousands of vials are simultaneously freeze-dried. The containers 30 are typically stored on a shelf (not shown), and the sublimation process is typically performed by keeping the chamber pressure and the shelf temperature constant. The so called "sublimation front" 32 moves gradually downwards. The sublimation front 32 is located between the (relatively dry) substance 33 without ice crystals and the frozen substance 31 still having ice crystals. During the sublimation process, the container 30 is typically placed in a chamber under low pressure (close to vacuum). Reference 34 denotes the atmosphere containing water vapour that escaped from the substance, and is collected by a condensor (not shown).

As far as is known to the inventors, the product quality of this process is deemed guaranteed by choosing a slow process and relatively large safety margins, which inherently means a decreased throughput. As far as is known to the inventors, no measurement data is provided for each individual container.

FIG. 4(A) to FIG. 4(C) illustrate progress of the first drying step (sublimation) for a substance in a spin-frozen container 40, as a function of time, assuming that the frozen product forms a dispersion or solution layer of constant thickness against the inner surface of the container wall, and assuming that the container is uniformly heated.

At the start of the sublimation process, as depicted in FIG. 4(A), the entire frozen material 41 contains ice crystals. When heat energy is provided uniformly to the circumferential container wall, heat is conducted through the container wall, and through the material inside the container radially inwards towards the center. Ice crystals are sublimated at a so called "sublimation front" 42 formed between the outer zone 41 (still containing ice crystals) and the inner zone 43 (substantially free of ice crystals). Water vapour 44 (in case of an aqueous solution) escapes via pores of the dried material of the inner zone 43, out of the container 40. As is known in the art, the inner zone 43 actually still contains some moisture content, for example in the form of unfrozen water present in the substance, for example ionically bound water, which will substantially be removed during the second drying step (desorption). Preferably the container is rotated around its longitudinal axis in order to provide a uniform heating (as indicated by the arrow).

FIG. 4(B) shows the container 40 of FIG. 4(A) some time later. As shown, the sublimation front 42 has moved radially outwards. The sublimation front 42 separates an outer zone 41 still containing ice crystals from an inner zone 43 substantially free from ice crystals. This process continues until the sublimation front 42 arrives at the container wall 45, as shown in FIG. 4(C). Ideally the sublimation front 42 arrives at the container wall 45 at about the same time throughout the product, but in practice this may not be the case, especially when the thickness of the layer is not constant.

FIG. 5 illustrates that a thermal IR camera 51 can be used to "measure" the temperature of the outside surface of the container wall. Actually the camera does not detect the temperature itself but detects IR radiation, which can be converted into temperature information using an image processing module. It is important to realize that unlike a normal camera capturing visual light, the thermal IR camera does not really "look inside" the container 50, even when the container is made of glass, hence cannot "readily see" the position of the sublimation front as it moves. It is noted in this respect that IR transmission through for example borosilicate glass is not exactly zero, but effective transmission is typically lower than 10%. In the present invention, it is assumed that the thermal IR camera 50 measures the temperature at the outside surface of the container 50.

In fact, this is one of the reasons why it is not straightforward to use a thermal IR camera for determining the temperature of the product inside the container, especially since the camera is arranged to capture a thermal IR image of the outer surface of the circumferential container wall 54, rather than being directed to the product inside the container itself. This is an important difference with some prior art methods where a thermal IR camera is also used for obtaining temperature information, but where the camera is oriented towards the product itself, rather than to the outside wall 54 of the container. In other words, in embodiments of the present invention, it is not required that the product inside the container lies in the field of view 52 of the camera. In fact, the methods described herein, will typically ignore such data, as will be further described when discussing FIG. 13.

According to an underlying idea of the present invention, the thermal image captured by the thermal IR camera, or rather the thermal information extracted from said thermal image, is used together with a mathematical model to "monitor" in real-time the progress of the sublimation. Moreover, rather than merely observing what is happening, the mathematical model can also be used to dynamically control the sublimation process more efficiently, but importantly, without compromising the quality of the product at any time, as will become clear further.

It is known in the art, for example from [Emteborg], how image data obtained from a thermal camera can be converted into accurate temperature information, which therefore need not be explained in more detail here. Suffice it to say that this can be achieved for example by proper calibration, and/or by correlating the thermal image data with known temperature information, e.g. with temperature information obtained using other means such as Pt100 probes and/or thermocouples, or other temperature sensing means. The calculations typically involve taking into account thermal coefficients such as a reflection coefficient and/or an emission coefficient of the materials and their surfaces.

Figure 6:
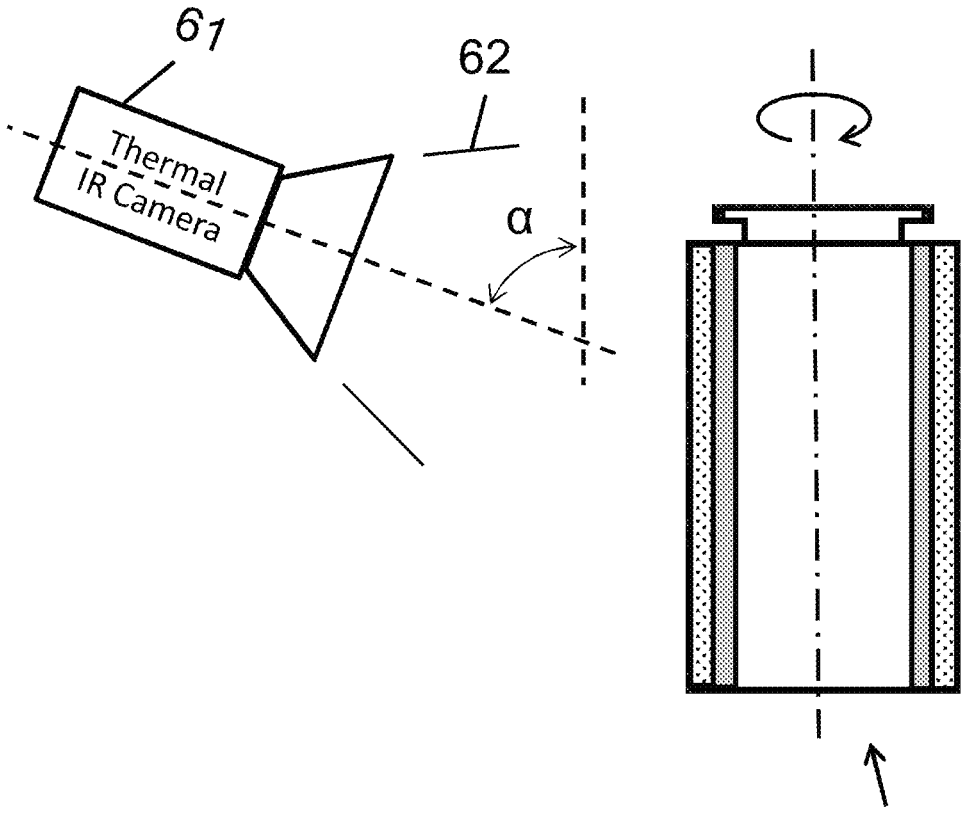
FIG. 6 is a variant of the arrangement of FIG. 5, showing that the camera can also be mounted in a tilted position, and can also be mounted at a higher or lower position relative to the container.

FIG. 6 is a variant of the arrangement of FIG. 5, showing that the thermal IR camera 61 can also be mounted in a tilted position, and can also be mounted at a higher or a lower position relative to the container 60, but of course this is only an example and other positions than the one being explicitly shown are possible as well. For example the camera may be mounted such that the thermal image contains a portion of the top, or a portion of the bottom of the container, for practical reasons (e.g. space limitations in the apparatus), despite that the data related to the top and the bottom will typically be discarded. Such mounting can for example be used in arrangements where heat is supplied to the container by means of one or more IR radiators (not shown in FIG. 6), for example in order to avoid that the heater is located in the field of view 62 of the camera, or to avoid unwanted reflections, or for any other reason.

The camera 61 can be mounted fixedly or can be mounted movably. In the latter case the apparatus or system further comprises means (not shown) for moving the camera 61, which may be adapted for moving the camera up/down in a direction substantially parallel with the longitudinal axis of the container 60, or in a plane substantially perpendicular to the axis of rotation, or may be adapted to rotate the camera around an axis parallel to the longitudinal axis of the container, or any combination of these. Such mounting means are known in the art, and hence need not be described in detail. Moving the camera can be used for monitoring a plurality of at least two or at least three containers, or even more, by means of a single camera. If possible the camera can also be mounted at a sufficiently large distance for allowing capturing of thermal IR images of at least two containers or at least three containers simultaneously. Such mounting can for example be used in chambers having limited space for mounting the camera 61.

An example of a freeze-drying system or apparatus 2300 comprising three thermal IR cameras C1, C2, C3 will be described further, when discussing FIG. 23, but of course the present invention is not limited to the specific examples described or shown.

Figure 7:
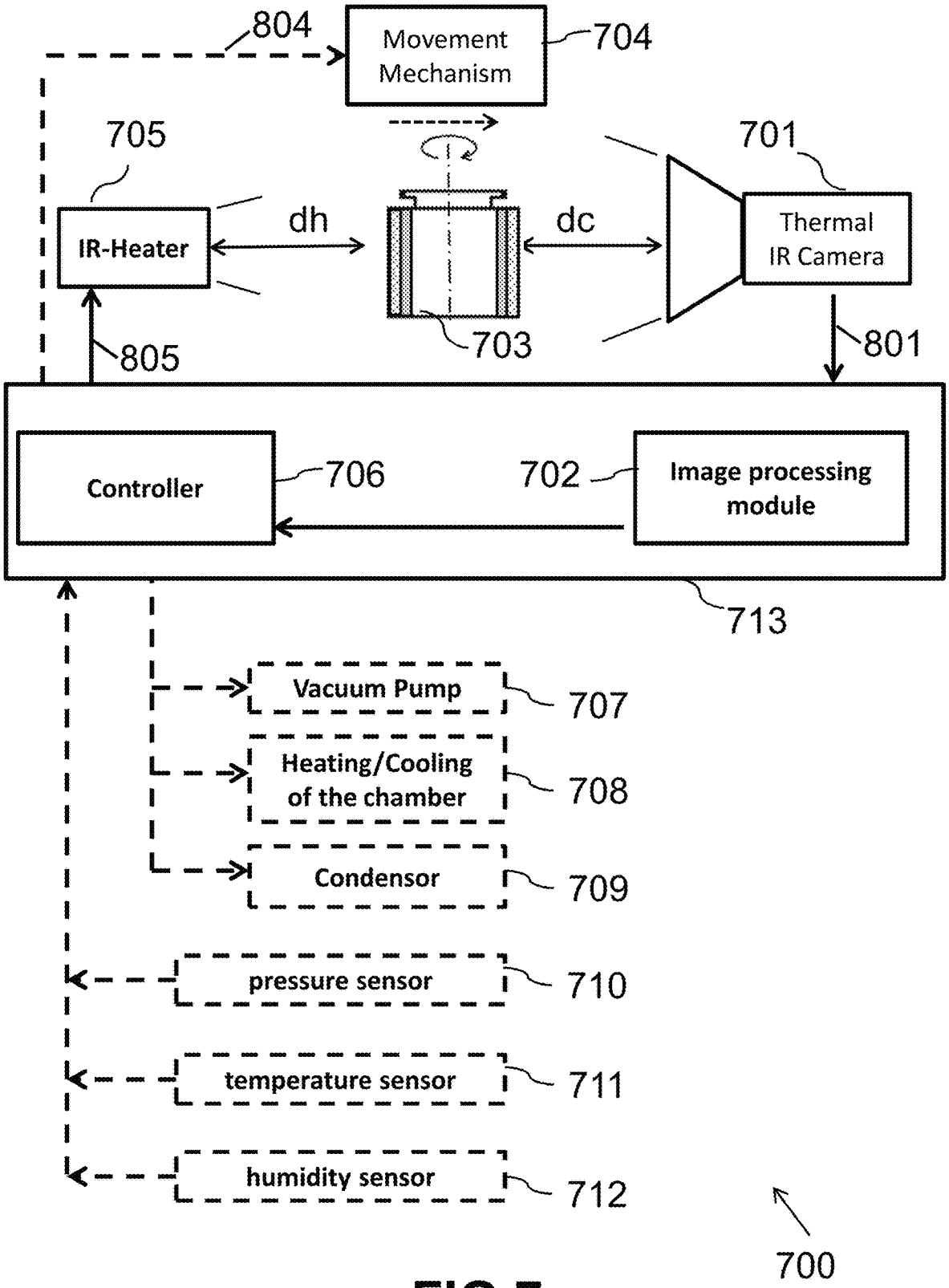
FIG. 7 illustrates an example of a freeze-drying apparatus or system according to an embodiment of the present invention.

FIG. 7 illustrates an exemplary freeze-drying system or apparatus 700 as can be used for performing a "drying method" according to embodiments of the present invention. The apparatus 700 can be adapted for freeze-drying only one container 703 at the time, or for freeze-drying a plurality of containers 703 simultaneously. In FIG. 7 only one container 703 is shown. The container 703 can for example be a vial or a syringe holding a pharmaceutical composition, but other bodies having a circular cross section in a plane perpendicular to the rotation axis may also be used.

For ease of the description, the apparatus 700 and its components and its functionality will be described for sublimating or desorbing the content held by a single container 703, or both sublimation and desorption, but the invention is not limited thereto, and the skilled reader can easily apply the teaching to an apparatus for drying multiple containers.

The apparatus 700 has a movement mechanism 704 for rotating the container 703 around its longitudinal axis. Such rotation allows the side surface of the container over its entire height or at least a portion of the height where substance is located, to be substantially uniformly exposed to a heater 705, e.g. a local IR heater, and to be viewed by at least one thermal IR camera 701. The movement mechanism 704 may also be adapted for translating the containers (see also FIG. 23, illustrating a continuous freeze-drying system 2300). Such movement mechanisms 704 capable of rotating and/or translating one or more containers 703 are known in the art, and hence need not be described in more detail herein. It is noted however that translation is not absolutely required for the present invention, and that the rotation speed of the container during drying can be lower, e.g. much lower than the 4000 RPM mentioned during freezing. It is envisioned that a rotation speed in the range from about 10 to 1200 RPM or in the range from about 30 to 600 RPM, in particular from about 30 to 100 RPM will yield good results during drying.

The device 700 comprises at least one thermal IR camera 701. The exemplary freeze-drying apparatus 700 shown in FIG. 7 has a single thermal IR camera 701 fixedly mounted at a distance "dc" from the rotating container 703, and is oriented (in this example) under a predefined angle of 90° with respect to the rotation axis, but as explained above (FIG. 5 and FIG. 6), the camera may also be movably mounted (e.g. translation or tilting or rotation), and/or may view the container 703 under a different angle, e.g. an angle in the range from 20° to 160°, or for example an angle in the range from 45° to 135°.

While FIG. 7 only shows a single thermal IR camera 701, freeze-drying apparatuses according to the present invention may comprise more than one thermal IR camera, for example at least two or at least three thermal IR cameras. The cameras may be arranged for monitoring at least one container 703, for example at least two or at least three containers at the same time, or at different moments in time.

In particular embodiments, each container 703 is being monitored by at least two different cameras. Even though one camera would be redundant, this allows to improve the reliability of the process, allows to detect deviations or errors, but also allows to "save" the content in the containers in case one camera would fail during the process and thus no logging data would be available.

It is technically possible to capture images at a relatively high sample rate, for example at least 5 Hz, but in view of the thermal constants involved, meaning that warming-up and cooling-down in vacuum does not occur instantaneously, sample frequencies lower than 5 Hz can also be used. In contrast to some prior art methods however, where the thermal IR camera is only used for monitoring the process without influencing or controlling the process, a sample rate of only 1 image per 120 seconds for example would be insufficient for the control algorithm that will be described further. It is envisioned that a sample rate in the order of about 0.1 Hz to about 10 Hz, or from about 0.5 Hz to about 10 Hz, or from about 1 Hz to about 10 Hz will be used.

The camera may be physically arranged inside the vacuum chamber, or outside of the chamber. In the latter case the camera may for example be arranged in front of a window which is substantially transparent to IR radiation of the envisioned wavelength range (from 0.1 to 25,am). The thermal IR camera 701 provides thermal images to an image processing module 702, which may be a stand-alone unit, or may be part of a larger system. The image processing unit or module 702 converts the pixel data into temperature data, as will be further illustrated in FIG. 13. It is important to realize that the thermal IR data captured by the thermal IR camera 701 in itself contains information closely related to the temperature of the outside surface of the container wall, rather than information of the product or substance stored inside the container itself.

In some embodiments, the container wall of the envisioned containers is substantially opaque to IR radiation, for example has a transmission coefficient of at most 20%, preferably at most 15%, or at most 10% or even at most 5% in the frequency range where the thermal IR camera is sensitive.

In other embodiments where the container wall is more transparent to IR radiation, for example has a transmission coefficient higher than 20% as is the case for some ceramic materials, the captured IR data does not represent the temperature of the outside surface of the container, but represents an average or a weighted average between a first temperature at the outside surface of the container wall, and a second temperature at an inside surface of the container wall in contact with the product, but it is contemplated that the same techniques as described further can still be used.

The temperature data, typically arranged in matrix-format, is provided by the image processing module 702 to a controller 706, for example a programmable controller or a digital computer 713. In a practical implementation, the image processing block or module 702 may be implemented in software, as an image processing software module, and the thermal IR camera 701 may be directly connected to the computer 713 via a cable to a suitable port, for example a USB-port, but the present invention is not limited thereto, and other devices and/or interfaces can also be used, provided they are sufficiently fast.

The controller 706 executes a control algorithm, which will be described in more detail further. For understanding the working of the system 700 shown in FIG. 7, it suffices for now to understand that the controller 706 uses a mathematical model of the container 703 and its content in its environment, in particular in a vacuum chamber and in the vicinity of its local heater 705. The fundamental formulae underlying the mathematical model are based on the law of conservation of energy and the law of conservation of mass, but rather than describing the model by a set of differential equations in two- or three dimensions, and solving the set of equations numerically using finite elements, which requires a powerful computer, and cannot be done in real-time (at least not without prohibitively expensive equipment), the inventors took a very practical approach.

Before describing the specific model(s) presented by the present invention in more detail, the elements involved in the system of FIG. 7 should be recognized to be acting as a closed-loop system.

Stated in simple terms, the thermal IR camera 701 captures thermal IR images of the outside surface of the container wall 703 (for example at time T1, time T2, etc.), this data is converted into temperature information and processed (e.g. filtered, averaged, etc.) by the image processing module 702 and provided to the controller 706. The controller 706 drives the heater 705, and thus knows how much energy is provided to the heater. The controller 706 has a mathematical model of the container 703 and of the product or substance therein, and of the environment, (e.g. the spatial arrangement of the heater 705 relative to the container 703, the pressure inside the chamber, etc.), and can determine or estimate or calculate the amount of energy expected to be absorbed, and the effect of that heat absorption on the product, and the effect thereof on the temperature on the outside surface of the container. By comparing the actual temperature at the outside of the container wall (based on the IR data) with that predicted by the model, the controller can determine, e.g. estimate or calculate whether more energy is absorbed than was intended to be provided by the heater (e.g. if the temperature of the wall at time T2 is lower than expected or predicted), or less energy is absorbed than was intended to be provided by the heater (e.g. if the temperature of the wall at time T2 is higher than expected of predicted). The controller will then typically correct the variables of the model (e.g. the position of the sublimation front), by taking into account the "measured temperature data" (or more accurately stated: the temperature data extracted from the captured IR image) and the amount of heat provided, and will adjust the power to the heater 705 to control the progress of the drying. This explains in a nutshell the underlying principles of the present invention in its general form. More details about the algorithm will be explainer further (mainly FIG. 10 to FIG. 20).

Referring back to FIG. 7, the system, e.g. freeze-drying apparatus 700 comprises at least one heater 705, for example a local infrared radiator 705, arranged at a predefined constant or adjustable distance "dh" from the container 703, and oriented at a predefined angle with respect to the rotation axis of the container 703. In the example of FIG. 7, the heater 705 is stationary and oriented at an angle of 90° and positioned at substantially the same height as the container 703, for uniformly heating the side wall of the container. But the present invention is not limited to this specific arrangement, and the heater 705 may also be movable, in which case the system or freeze-drying apparatus 700 would further comprise movement means 715 (not shown in FIG. 7, but see for example FIG. 8 and FIG. 21) for translating and/or rotating and/or titling the heater 705. If present, the movement means 715 is also controlled by the controller 706 by means of a signal 815 (see FIG. 8 and FIG. 21). Although only a single heater 705 is shown in FIG. 7, the freeze-drying apparatus 700 may comprise more than one heater, for example at least two IR heaters 705, or a heater having multiple filaments (see for example FIG. 18 for a heater having two separately controllable heating filaments 1803, 1804).

For completeness, it is mentioned that the freeze-drying apparatus 700 will typically also comprise a vacuum pump 707, and general heating or cooling means 708 for heating or cooling the chamber (in particular the walls of the chamber), and importantly a condensor 709 for capturing the water vapour escaping from the container 703 during the primary (sublimation) and/or the secondary (desorption) drying step. Preferably the controller 706 is further adapted for controlling these devices 707 to 709. It is noted that the term "general heating or cooling means" is used to differentiate between the temperature control of the chamber in general (relevant for all the containers stored in the chamber, when more than one), as opposed to the "local heater" which is specifically adapted for controlling the amount of heat provided to the specific container 703. As shown in FIG. 23, in case multiple containers are freeze-dried in the same chamber at the same time, each individual container will preferably have, permanently or temporarily, its own local heater or its own local heaters, e.g. two heaters stacked on top of each other (not shown in FIG. 23).

Referring back to FIG. 7, the freeze-drying apparatus 700 will typically also comprise one or more pressure sensors 710, one or more temperature sensors 711 other than the thermal IR camera 701, for example including one or more Pt100 probes and/or one or more thermocouples, and one or more humidity sensors 712. If present, the controller 706 may be further adapted for receiving an input from one or more of these devices. The data received or retrieved from the one or more temperature sensors 711 can for example be used for calibrating the thermal IR camera 701 in a manner known per se in the art. The data received or retrieved from the one or more pressure sensors 710 and/or from the one or more humidity sensors 712 may also be used by the mathematical model, in particular for example for detecting "the end" of the sublimation phase, which is an important moment in time, because from that moment onwards, the temperature of the product is allowed to gradually increase.

Although not part of the freeze-drying apparatus 700 itself, the container 703 is an important component in the process, and therefore needs some explanation. Although methods according to the present invention are not limited to containers having a specific shape (unless explicitly indicated otherwise), it can be stated in general that the container has a bottom portion 55 (see for example FIG. 5) and a side portion 54 and a top portion 53. In contrast to some prior art freeze-drying processes where the containers are stored on a shelf, the shape of the bottom portion 55 is less relevant for the present invention, although for practical reasons, it is beneficial if the bottom portion 55 is shaped such that the container 50 is capable of standing in an upright position on a flat surface. The shape of the top portion 53 is also less relevant for the present invention, because the mathematical model is primarily based on temperature information of the circumferential side wall of the container. For practical reasons the top of the container preferably has a shape that can easily be closed, which shape may also be chosen for holding the container by gripping means (not shown), and for rotating the container around its longitudinal axis. But from a thermodynamic point of view the bottom portion 55 and a top portion 53 have no major influence, provided that the opening of the top portion 53 is sufficiently large for allowing the water vapour generated during the sublimation or desorption step, to escape with a sufficiently low pressure drop in order to avoid so-called "choked flow" condition. Suitable shapes are known in the art.

The shape of the side portion 54 on the other hand, has a major influence on the drying process. In the example of FIG. 7 the "side wall", also referred to herein as "circumferential wall portion" of the container, is substantially cylindrical, although a cylindrical shape is not absolutely required for the present invention to work, and other suitable shapes may also be used, for example a truncated conical shape. It is important however that the container has a substantially circular cross-section, e.g. a circular cross-section in a plane perpendicular to its longitudinal axis over at least part of the container height "h" (see FIG. 5) where product is located, because this offers the advantage of substantially uniform heat absorption when the container is being rotated.

Using a container with a cylindrical shape however, offers the advantage that the product can be located in a relatively thin layer at an inner wall surface using spin-freezing, and the advantage of a more uniform heat transfer from the exterior surface of the container to the inside of the container and to the product, which greatly simplifies the mathematical model.

In one particular embodiment, the container has a substantially paraboloid or truncated paraboloid portion, as will be discussed in FIG. 22(*c*). It will become clear further that this shape provides yet another advantage over a cylindrical shape.

Figure 8:
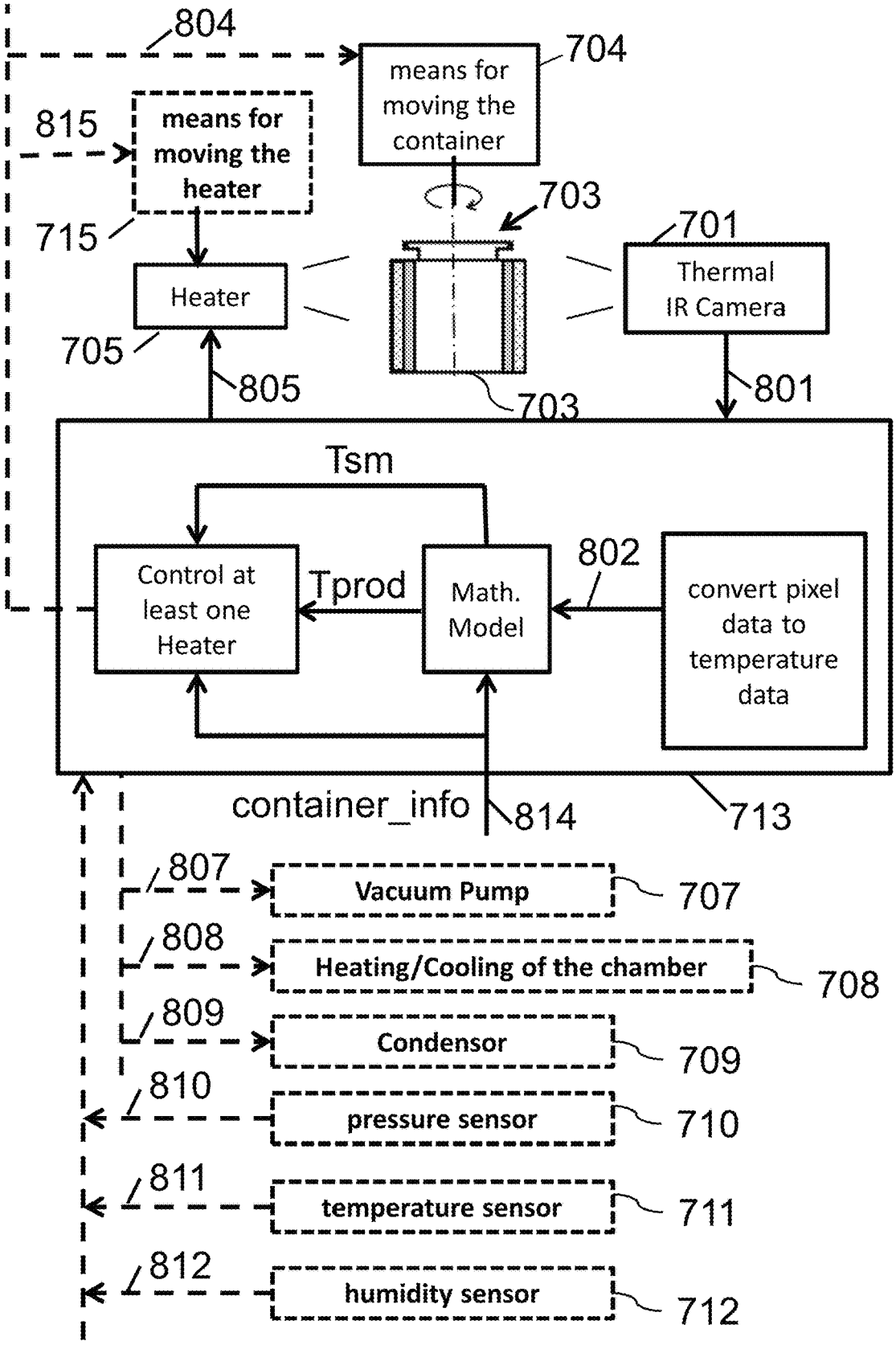
FIG. 8 illustrates an exemplary data-flow diagram as can be used in methods and systems according to embodiments of the present invention.

FIG. 8 illustrates an exemplary data-flow diagram as can be used in methods according to the present invention. The reader will immediately recognise the correspondence with the components shown in FIG. 7. In the centre of FIG. 8, an example of the computer 713 with a mathematical model is shown in some more detail.

The controller, e.g. the computer 713 receives the following inputs as signals or data:

i) a thermal IR image 801 indicative of the temperature at points located on the external surface of the container wall;

ii) information about the container 703, such as for example the geometry, shape and size and material of the container, and about the content of the substance inside the container, in particular the amount and composition of the substance.

An important parameter related to the substance is the maximum allowed product temperature during sublimation, referred to herein as critical temperature "Tcrit_sub", which is considered to be a constant temperature, depending on the product to be freeze-dried. The Tcrit_sub may be chosen as the temperature where the substance loses its structure (collapse) which may be caused by increased mobility (the temperature exceeding the collapse temperature (Tcol) for the glass phase), or loss of crystal structure (the temperature exceeding Teutectic), both leading to unacceptable visual product cake aspect, to a possible excess of final residual moisture after drying and/or leading to unacceptable time for dissolution during reconstitution.

Another important parameter related to the substance is the maximum allowed product temperature during desorption, which is not a constant temperature value, but a temperature that varies as a function of residual moisture content "Tcrit_des[moisture]" or as a function of secondary drying time "Tcrit_des [Time]. The data of "Tcrit_des" can be provided in the form of a list or a curve or a table or as a mathematical function or in any other suitable manner Depending on which of the steps is to be performed by the device or the method, one or both of the values "Tcrit_sub" and "Tcrit_des[.]" is provided to the algorithm, for example as part of the data or signal 814, or may also be stored beforehand in the controller, for example in a non-volatile memory or on a hard-disk, from where it can be retrieved.

In embodiments of the present invention it is assumed that the substance in the container 703 is spin frozen, and is therefore located mainly or exclusively at an inner surface of the side wall of the container 703. Three special cases are contemplated:

(a) cylindrical container holding the substance in a suspension layer of constant thickness, as illustrated for example FIG. 4 to FIG. 6, and FIG. 10 to FIG. 11;

(b) cylindrical container holding the substance in a suspension layer having a non-constant thickness, as illustrated for example in FIG. 15 to FIG. 18;

(c) container having a paraboloid or a truncated paraboloid portion over the entire height or a portion of the height of the side portion, holding the substance in a suspension layer of constant thickness, as illustrated in FIG. 22(*c*), even when spin-frozen at relatively low speed. As far as is known to the inventors, containers having such a shape especially adapted for the purpose of freeze-drying, and more in particular for holding pharmaceutical products, do not exist yet.

In all cases, it is assumed that the container wall has a constant thickness, apart from production tolerances.

Optionally the controller 713, e.g. the computer may further receive as additional input:

iii) a pressure signal 810 indicating the pressure in the chamber or indicating partial vapour pressure of water, or both;

iv) a temperature signal 811 indicating a temperature of the chamber walls, which can for example be taken into account when calculating the heat energy received by the container, and/or a temperature of a local probe such as a Pt100 probe which can be used for calibration purposes;

v) a humidity signal 812 indicating the humidity of the product in the container as determined by an NIR sensor (see [Van Bockstal]), as an independent monitoring of the product quality and readiness of the process.

According to an aspect of the present invention, the controller 713 controls the drying process of the substance in the container 703. To this end, the present invention provides (i) a method of sublimating the frozen product in the container 703, which can be used in the first drying step of the freeze-drying process. The present invention also provides (ii) a method of desorption of the frozen product in the container 703, which method may be used during the second drying step of the freeze-drying process. It is possible to use only (i) the method of sublimation according to the present invention in combination with a prior art desorption method, or to use a prior art method of sublimation in combination with (ii) the method of desorption according to the present invention, or to use both (i) the method of sublimation according to the present invention and (ii) the method of desorption according to the present invention.

Figure 23:
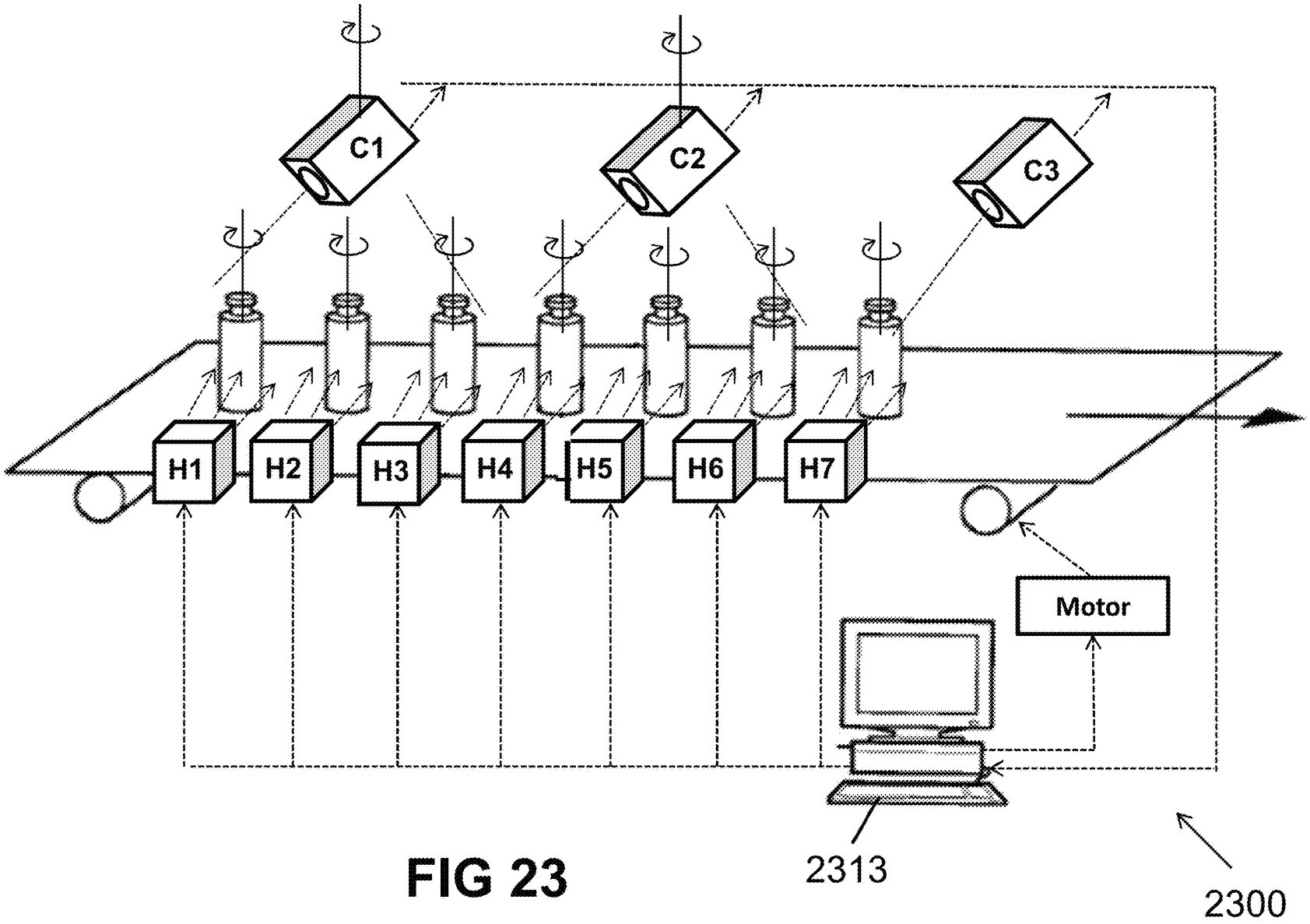
FIG. 23 shows an apparatus or a system according to the present invention, adapted for simultaneously freeze-drying multiple doses of a substance stored in a plurality of containers.

According to an underlying principle of the present invention, the controller 713 controls the drying process of the product in the individual container 703 by controlling the heat that is absorbed by the individual container 703, in particular by controlling or influencing at least one of the following:

i) the power, e.g. electrical power supplied to the at least one local heater 705;

ii) the relative position of the at least one local heater 705 and the associated container 703, which may be influenced for example by moving the local heater 705 away from or towards the container 703, or by moving the container 703 towards or away from the local heater 705, and/or by moving the local heater 705 in a direction parallel to the longitudinal axis of the container;

iii) the relative orientation of the at least one heater 705 and the container 703, for example by controlling an angular position of a main beam of the heater 705 with respect to the longitudinal axis of the container 703;

iv) the exposure time of the container 703 to the heat provided by the heater for example by moving the container faster or slower past the heater in a continuous production process (as illustrated for example in FIG. 23);

or any combination thereof.

In particular embodiments of the present invention only the power provided to the local heater 705 is controlled, while the relative position and orientation is fixed. In this case the control signal 805 provided to the heater 705 is or comprises a power signal (e.g. in case of a heater with a single heating element) or comprises a plurality of power signals (e.g. in case of multiple local heaters, or in case of a single heater comprising multiple heating elements which can be powered individually). These embodiments will be explained in more detail further to illustrate the principles of the present invention, but the present invention is not limited to these examples, and the same effects may also be obtained by controlling movement of the one or more heaters instead of, or in combination with power control.

In other particular embodiments of the present invention, both the power provided to the heater(s) 705 and the exposure time of the container 703 to the heater(s) 705 are controlled. In this case the controller 713 would provide a power control signal 805 to the heater(s) 705 and a motion control signal 804 to the movement mechanism 704 that moves the container(s) 703 and/or a control signal 815 to the movement mechanism 715 that moves the heater.

For completeness it is mentioned that the controller 713 may of course also provide a pressure control signal 807 to the vacuum pump 707, and/or a heating or cooling control signal 808 to the general heating or cooling unit 708 of the chamber, and/or a condenser control signal 809 to the condenser unit 709, etc, in a manner known in the prior art.

Figure 9:
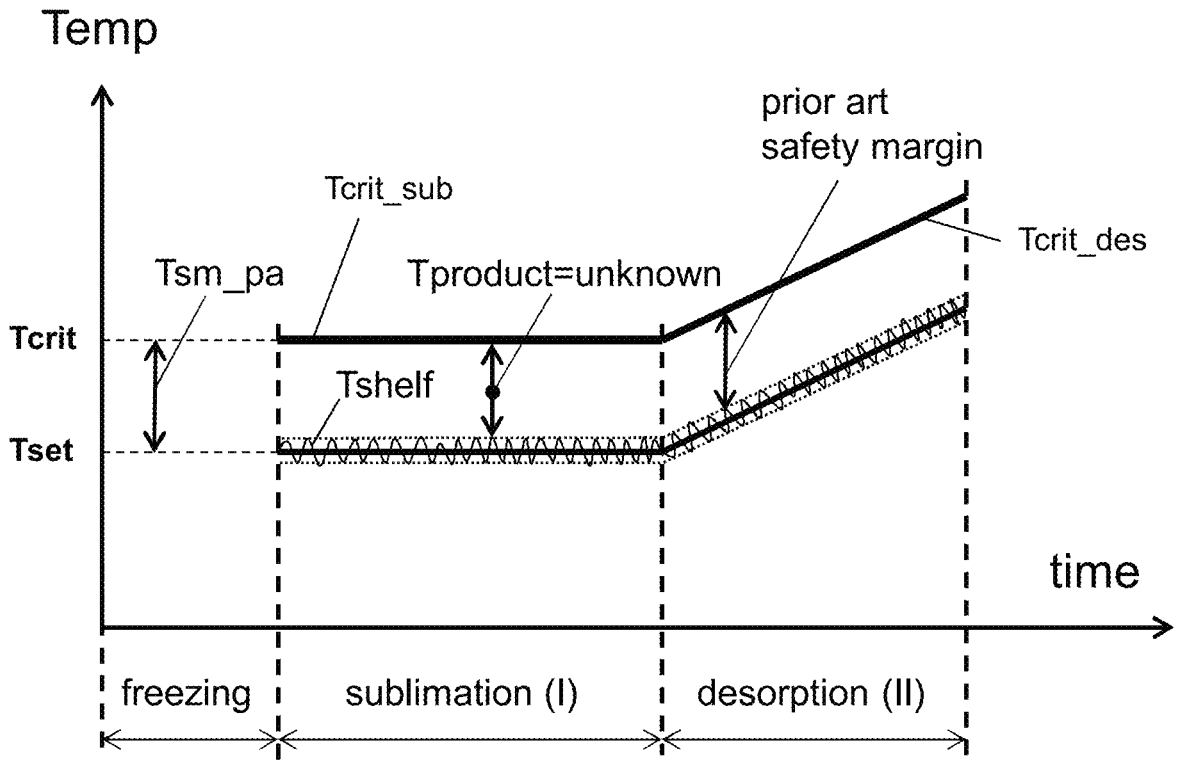
FIG. 9 shows an example of how prior art control methods are believed to work. Such methods typically regulate the shelf temperature without knowing the actual product temperature at the sublimation front.

Before describing the particular control method of the present invention, a control method as typically used in the prior art will be explained first, to better appreciate the differences and advantages of the present invention. In FIG. 3 it was shown how the drying process progresses for one container 30 being one of a plurality of containers stored on a shelf. FIG. 9 shows an example of a prior art control method, that regulates the shelf temperature without knowing the actual product temperature. On the horizontal axis the different steps or phases of the process are indicated: a) a freezing phase, b) the sublimation step or "first drying" step, c) and the desorption step or "second drying step".

During the freezing step, the temperature of the chamber and more in particular, the temperature of the shelf, and hence indirectly also the temperature of the containers stored on said shelf, and the product stored in the containers, is reduced to for example −20° C., or another suitable temperature, depending on the product, the pressure in the chamber is lowered, etc. The containers are stored on the shelf, in an upright and stationary position. As mentioned before, the first step is not the main focus of the present invention, unless otherwise indicated.

During the sublimation step, the task of the prior-art process is to guarantee that the product temperature does not rise above the critical temperature "Tcrit" but also to provide heat energy to the shelf (and thus indirectly to the containers and to the product) to allow the sublimation to take place. To this end heat energy needs to be provided to the shelf, but not too much heat, otherwise the product temperature may locally rise above the critical temperature, which is not allowed. In the prior art this is typically achieved by choosing a relatively large safety margin "Tsm_pa" (where "sm" stands for safety margin, and "pa" stands for prior art) below the critical temperature. Typically a temperature Tset is defined as $$Tset = Tcrit_shelf - Tsm_pa \quad [1]$$

with Tcrit_shelf is the critical temperature of the shelf, corresponding with the critical temperature of the product, and the controller of the prior art performs an algorithm (control loop) to keep the shelf temperature as much as possible equal to this set temperature "Tset", by increasing or decreasing the temperature and/or the flow rate of a cooling liquid flowing in tubes connected to the shelf. The effect of such control process is depicted in FIG. 9. As is typical with control processes, there is always a small ripple or oscillation around the set temperature value. The product temperature itself is not known but is assumed to be somewhere below Tcrit, which assumption is justified provided that the heat energy is added very slowly via the bottom of the container, such that the "sublimation front" moves as illustrated in FIG. 3.

As can be appreciated from FIG. 3(E) and FIG. 3(F), when approaching the end of the sublimation process (i.e. when substantially all ice crystals are removed from the product), some portions of the product in contact with the bottom of the container no longer contain ice crystals, hence will not be "cooled" anymore by the latent energy consumed by the sublimation front, but will not conduct the heat very well either, because the matter is substantially dry. The risk of "overheating" the product (i.e. that Tproduct >Tcrit) is high, but this risk is "solved" in the prior art by maintaining the relatively large safety margin "Tsm_pa" until substantially all the ice crystals are removed.

Referring back to FIG. 9, when the first drying step is complete, the secondary drying step can start. It is noted that in practice there is no "hard boundary" between the first and secondary drying step. Since the exact moment is not known, in the prior art typically also the duration of the sublimation process is prolonged to be safe, although there seem to be efforts to detect this moment based on information obtained from the condensor and/or based on partial vapour pressure. These methods are related to the cumulative condition of the plurality of the containers and therefore lack precise information of the individual container. This is another argument for using a rather large safety margin. And of course the shelf temperature is not exactly the same everywhere, which is yet another reason for a relatively high safety margin.

In the secondary drying step (desorption) the critical temperature Tcrit_des (i.e. the maximum allowed temperature of the product during desorption) increases as the moisture content of the product decreases, hence increases with time. Also in this step, the prior art method uses a control algorithm based on $$Tset = Tcrit_shelf - Tsm_pa \quad [2]$$

to keep the shelf temperature at a safe distance from the maximum allowed temperature (Tcrit), without actually knowing the product temperature. It is noted that in practice it is not easy or even not possible to directly measure the moisture content of the product, which again is typically addressed in the prior art by using a slow process and by taking sufficient safety margin, and by using the data or formula where the critical temperature is expressed as a function of time, rather than moisture content.

It can be understood that the prior art approach is a safe approach (provided the safety margins are chosen sufficiently large and the process is performed sufficiently slow, meaning that the amount of heat provided is sufficiently low), but is not the most efficient approach in terms of throughput time.

Desiring to improve the efficiency of the prior art methods and/or to improve or guarantee the quality of the product, the inventors propose a method with the following steps:

a) capturing a thermal IR image of at least a portion of the container wall using at least one thermal IR camera 701;
b) processing the thermal IR image by determining, e.g. calculating or estimating a plurality of temperature values associated with a plurality of points located on an outer surface of the container wall, using an image processing unit or module 702;
c) determining, e.g. calculating or estimating a temperature of the product (Tprod) stored in the container using a mathematical model that models heat flow and models progress of the respective drying process (sublimation or desorption) going on in that particular container;
d) determining, e.g. calculating or estimating a temperature safety margin "Tsm" between the temperature of the product Tprod and a predefined critical temperature Tcrit related to the specific product content;
e) controlling an amount of power supplied to the container 703, in particular to at least a portion of the circumferential side wall thereof, by controlling at least one parameter selected from the group consisting of: power supplied to at least one local heater 705, position of the at least one local heater relative to the container, orientation of the at least one local heater relative to the container, and exposure time of the container relative to said local heater.

It is noted that in step c) "a" temperature of the product is determined, not "the" temperature of the product, because the temperature of the product may and typically will vary depending on the location in the container. During the sublimation process, but also during the desorption process, preferably a temperature of the product at a location near the inner surface of the container wall is determined, because at this location the product temperature is expected to be the highest.

Figure 10A:
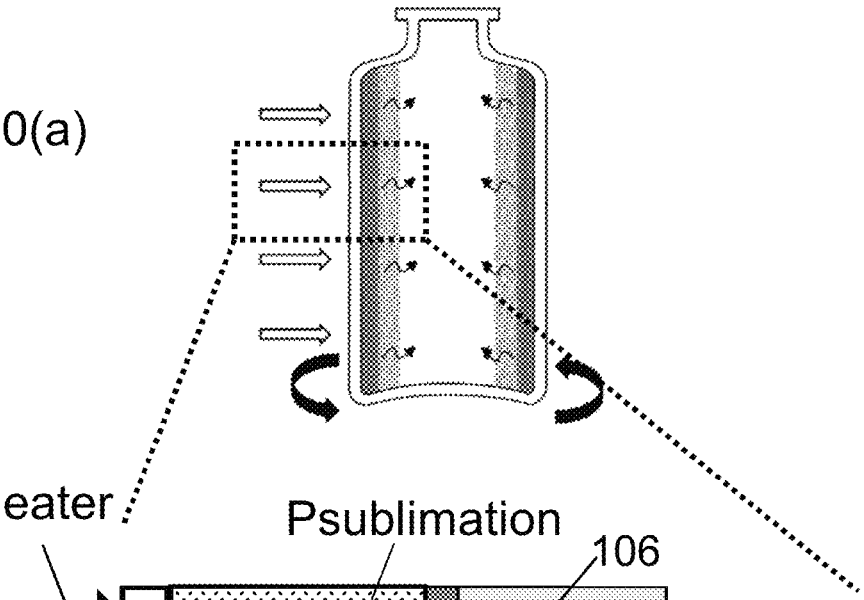
FIG. 10(*a*) is a replica of FIG. 1 of [Van Bockstal].
Figure 10B:
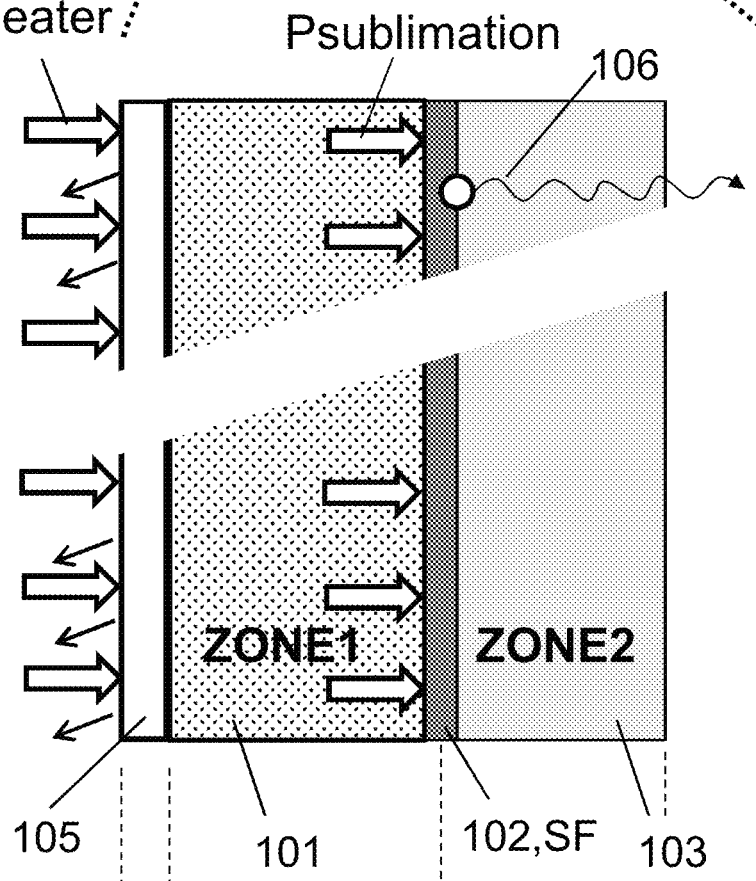
Figure 10C:
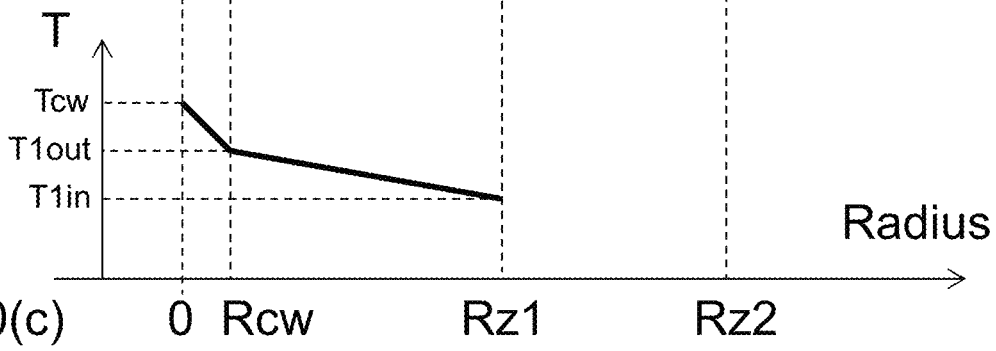

FIG. 10(*a*) is a replica of FIG. 1 from [Van Bockstal], showing that heat in the form of IR radiation is supplied to a rotating container. (it is noted however that Van Bockstal used NIR spectroscopy to measure radiation selectively reflected by the ice crystals providing ice and moisture content related information, whereas the present invention uses a thermal IR camera to detect the temperature on the outside surface of the container wall, which is completely different).

FIG. 10(*b*) and FIG. 10(*c*) illustrate a first mathematical model that can be used in embodiments of the present invention for modelling the sublimation of a spin-frozen product in a cylindrical container, the product being in the form of a layer of constant thickness located at an inner surface of the circumferential wall 105 of the container.

The mathematical model is based on supplying heat energy to a body comprising three concentric cylindrical shapes (shown in cross section in FIG. 10(*b*)). The body comprises:

a) an outer cylinder 105 formed by the container material;

b) an intermediate cylinder 101, also referred to as "zone1", in physical contact with the outer cylinder 105, and comprising frozen product still containing ice crystals;

c) an inner cylinder 103, also referred to as "zone2", containing frozen product substantially free of ice crystals.

Even though representing a three-dimensional shape, for symmetry-reasons it can be described as a one-dimensional model, which moreover can be approximated by linear temperature gradients, as shown in FIG. 10(*c*), or in other words, the mathematical model can be described by only a handfull of variables or parameters, such as for example:

Tcw representing the temperature at the outside of the container wall,

T1out representing the temperature at the inside of the container wall, deemed equal to the temperature at the outer radius of the first product zone "zone1" still containing ice crystals, T1in representing the temperature at the inner radius of the first product zone "zone1", deemed equal to the temperature of the sublimation front, Rcw representing the radius (or thickness) of the cylindrical wall, Rz1 representing the inner radius of the first zone, deemed equal to the position of the sublimation front, but other parameters can also be used.

The model is further based on the law of conservation of energy and the law of conservation of mass. A exemplary detailed description of such a model is introduced in the appendix, but the invention is not limited thereto. This model assumes that energy is entering the body through the outer cylinder 105, passes through the intermediate cylinder 101, and is absorbed at an interface, known as "sublimation front" SF between the intermediate cylinder 101 and the inner cylinder 103 for sublimating the ice crystals. As ice crystals are being removed, the sublimation front gradually moves outwardly (to the left of FIG. 10(*b*)), in other words, the thickness of the intermediate cylinder 101 decreases while the thickness of the inner cylinder 103 increases. Since evaporation uses latent heat energy, the temperature at both sides of the sublimation front SF can be assumed to be substantially constant, and thus it can be assumed that the entire energy entering the outer cylinder 105 and passing through the intermediate layer 101 is completely used for evaporating the ice content. Since the product content (amount and properties etc.) is known, and the amount of energy entering the container can be determined (based inter alia on the thermal IR image data), the amount of ice crystals converted into vapour can be calculated, and thus the progress of the sublimation front can be calculated.

The water vapour then leaves the product by passing through the pores of the inner zone zone2, 103. Assuming that no substantial amount of heat is provided directly to the second zone and since sublimation consumes latent heat, it is believed that the temperature of the second zone zone2 is substantially constant. FIG. 10(*b*) shows only the left half of the container, but it is clear to the skilled person that a similar situation is present on the opposite side, of course after mirroring. Hence the substantially dry inner zone 103 of the left half of the container is facing the substantially dry inner zone 103 on the right half of the container, and no heat energy is being supplied directly to this part of the container, at least not intentionally. Of course there is always some radiation from the walls of the chamber, but this amount of heat is assumed to be negligible in first order approximation.

Further, in this model it is assumed that the heat energy supplied to the container is substantially uniform (due to the rotation of the container), and that the temperature of the outer surface of the container is substantially constant (both in circumferential direction and in height direction), and can be represented by a single temperature value Tcw. The thermal IR image is used to "measure" this single temperature value, and a uniform amount of heat energy (uniform in height direction of the container) is being controlled to supply heat to the container. This heat can for example be provided by a single heater, or by a heater having multiple heating elements controlled in the same manner, or multiple heaters controlled in the same manner.

To get an impression of typical orders of magnitude, without limiting the invention to this example, the thickness of the frozen product is typically about 0.1 mm to 3.0 mm, e g about 0.5 mm to 2.5 mm; and the external diameter of the container is typically about 10.0 to 250.0 mm, e.g. about 1 cm to 10 cm; and the thickness of the container wall is typically about 1.0 to 3.0 mm, the thickness of the sublimation front SF is only a fraction of a millimetre. (In the drawings the sublimation front is sometimes deliberately shown as a relatively thick layer for illustrative purposes only).

FIG. 10(*c*) shows a typical temperature profile for this model. The lowest temperature "T1in" is found where ice crystals are being sublimated, i.e. at the sublimation front SF, which is located at the interface between the intermediate zone "zone1" and the inner zone "zone2". There is first temperature drop over the container wall 105 and a second temperature drop over the first product zone "zone1". These temperature drops can be approximated in first order by a linear function having respectively a first and second slope, also referred to as a first and second temperature gradient.

Hence, by determining the temperature Tcw at the outside of the cylinder wall 105 (e.g. based on the thermal IR data), and by determining, e.g. calculating or estimating the first and second temperature gradient, the entire temperature profile of the product is known. As can be seen, the highest product temperature "Tout1" occurs at the left side of zone1.

In order to guarantee that the temperature of the product is lower than the critical temperature Tcrit anywhere in the product, the main task of the control algorithm is to control the one or more local heaters 705 such that the resulting temperature T1out is lower than the predefined critical temperature "Tcrit" throughout the sublimation step. Despite the fact that T1out cannot be influenced or measured directly, the mathematical model allows to determine it. Since there is always a ripple and measurement errors, also methods according to the present invention will take into some safete margin, but in contrast to the prior art, this safety margin can be chosen much smaller, and can be adjusted as the sublimation proceeds, for example by taking into account progress as determined or predicted by the model. The progress of sublimation, which in this model can be equated to the radially outward movement of the sublimation front, can for example be calculated taking into account the temperature Tcw at the outside of the container, and by the cumulative amount of heat provided to the container since the start of the sublimation, for example taking into account the heat supplied by a local IR heater, the distance between the heater and the container, the heat radiated by the chamber wall, etc.

Hence it can be predicted fairly accurately what the momentary position of the sublimation front is, and based thereon what the thermal characteristic of the first and second zone1, zone2 is. The first zone 101 needs to conduct the heat to the sublimation front. The second zone 103 needs to remove the water vapour. It can be estimated when the sublimation front will arrive at the container wall. According to an important principle of the present invention, the heat supplied to the heater is adjusted accordingly, and preferably also the safety margin is adjusted dynamically taking into account this progress.

An important advantage of methods according to the present invention is that the temperature safety margin Tsm, defined as the temperature difference between the product temperature and the critical temperature, $$Tsm = T\text{prod} - T\text{crit} \quad [3]$$

can be safely reduced without compromising the quality of the product at any moment time. Indeed, the model can relatively accurately predict the amount of ice crystals still present in the product, and can therefore considerably reduce the safety margin, especially at the start or the first part, e.g. the first quarter or the first half of the sublimation process, because it is certain that sublimation is still taking place in the first zone 101 and that the water vapour does not yet encounter too much difficulty to escape via the pores in the the second zone 103 of the product.

In addition, by monitoring the temperature at the outside surface of the container wall, it can be verified that the product is still behaving according to the model, and the model can be adjusted accordingly. Hence not only the speed of the sublimation process can be improved by the present invention, but also the monitoring capabilities. Taking into account the considerable time (and thus costs) of sublimation, it can be appreciated that even a small improvement in throughput has a significant impact on costs and on the production capacity of the device or system. Moreover, also at laboratory scale, the benefit of "increased throughput" or reduction of overall processing time, in combination with improved monitoring capabilities, cannot be underestimated.

Figure 11A:
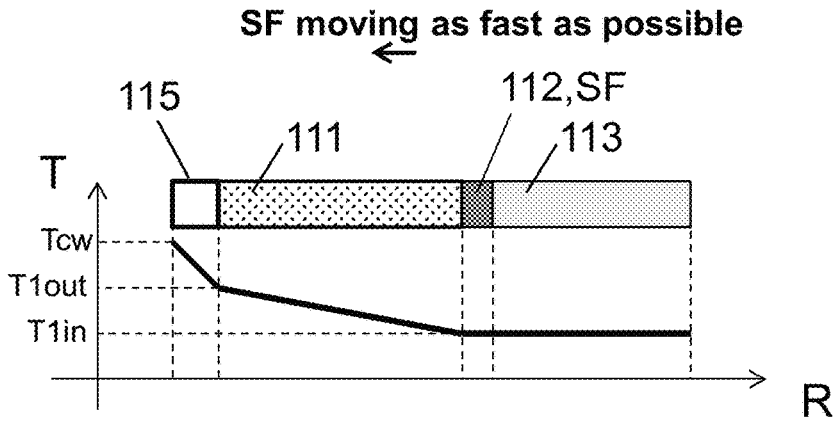
FIG. 11 illustrates three temperature profiles like that shown in FIG. 10(*b*) when different amounts of heating power is applied.
Figure 11B:
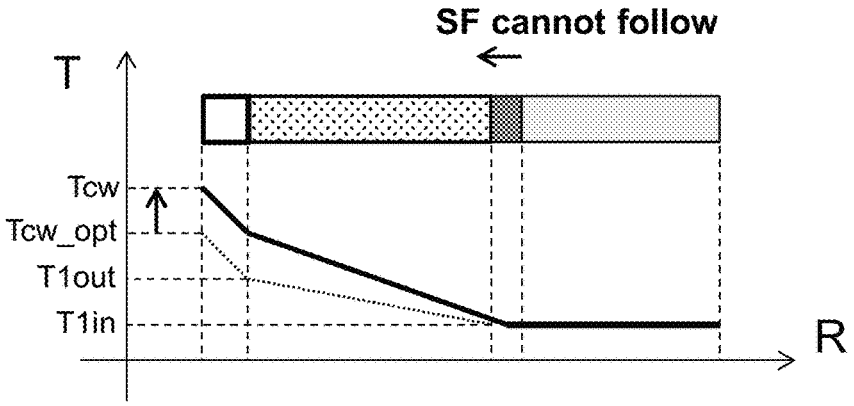
Figure 11C:
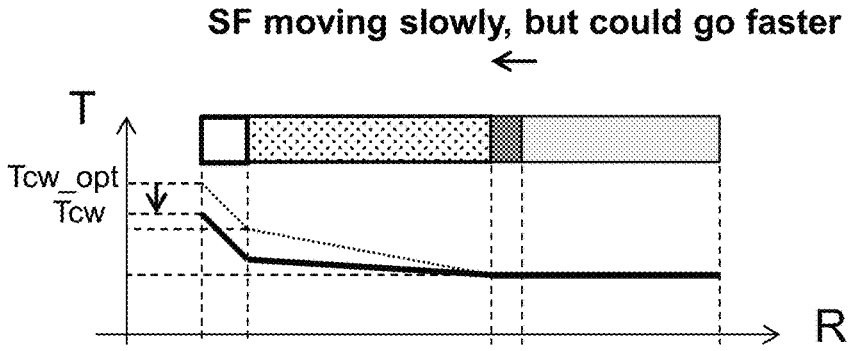

FIG. 11 illustrates three temperature profile similar to those of FIG. 10(*c*), to illustrate what happens if the amount of heat supplied to the container is (a) optimal, or (b) higher than the optimal value, or (c) lower than the optimal value.

FIG. 11(*a*) shows the temperature profile in case of optimal heating. In this case, there is equilibrium between the power supplied by the heater and the power used by sublimation (Pheater=Psublimation), and the temperature Tcw on the outside of the container wall 105 is substantially constant over time. In this case the sublimation front 112 moves radially outwards as "fast as possible", and hence, the sublimation process is proceeding as fast as possible.

FIG. 11(*b*) shows the temperature profile in case too much heating power is supplied to the container. In this case Pheater>Psublimation and the sublimation front "cannot follow". There is no equilibrium, and as a result, the temperature on the outside of the container wall Tcw increases with time. This is unwanted, because this will also cause the maximum product temperature T1out to increase. The controller can easily detect the increase of the temperature Tcw with time, and will lower the power of the heater(s) to resolve this.

FIG. 11(*c*) shows the temperature profile in case more heating power could have been supplied to the container. In this case there is equilibrium (Pheater=Psublimation), but the sublimation front could move faster, but doesn't move faster because it does not get sufficient power. (this is similar to what the prior art is doing during the entire sublimation process). As can be seen, the temperature gradients over the container wall 115 and over the first zone 111 is relatively small in this case. This way of heating is undesired during at least the first quarter or the first half of the sublimation process, but is desired near the end of the sublimation step, especially when the sublimation front 112 is about to arrive at the container wall 115.

Figures 12A, 12B:
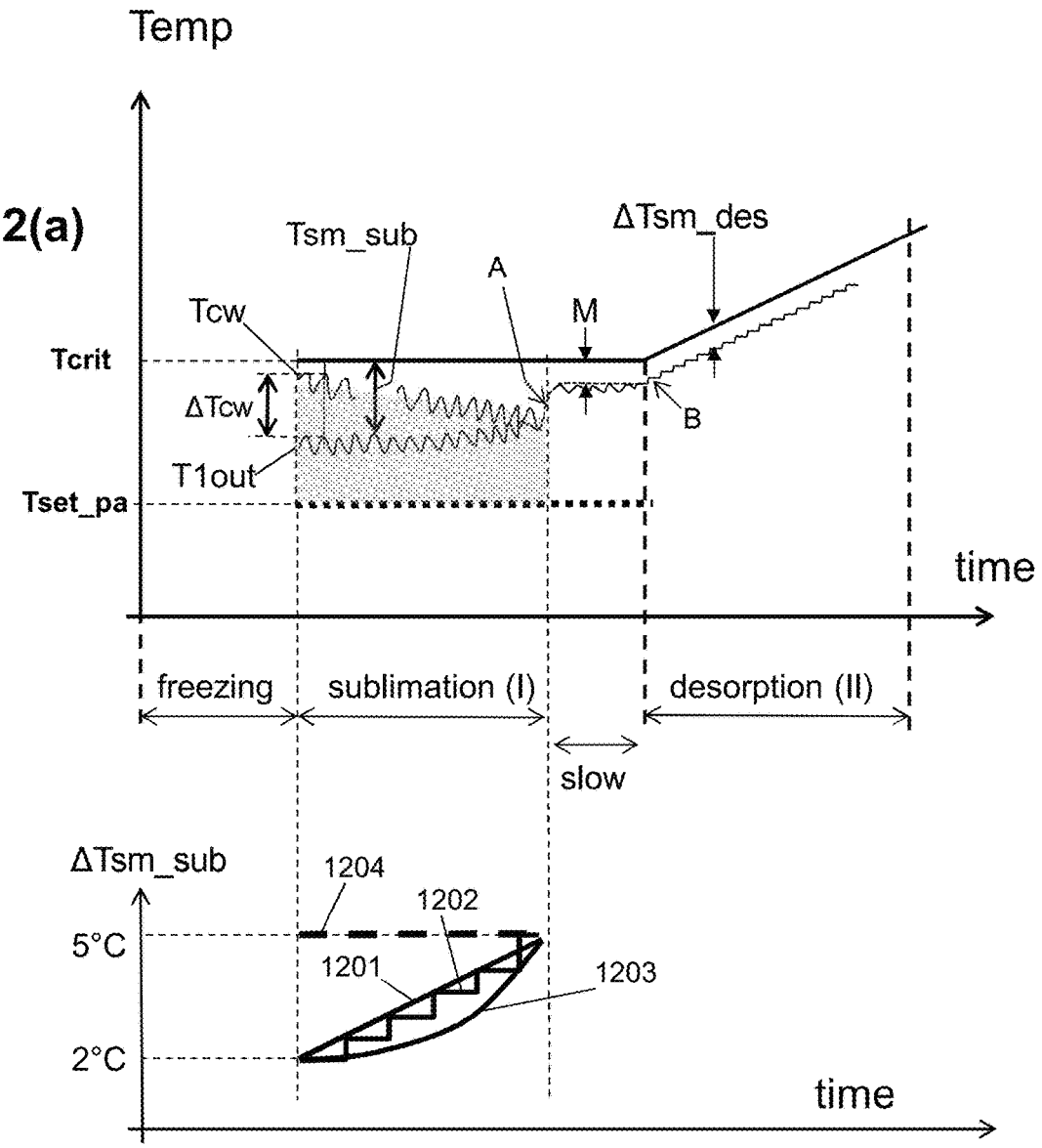
FIGS. 12(*a*) and 12(*b*) illustrate by way of an example an important principle of methods according to the present invention.

FIGS. 12(*a*) and 12(*b*) illustrate by way of an example, how a method according to the present invention works, and how the method can guarantee that the product temperature during sublimation is always below the critical temperature, while at the same time speeding up the process.

The same three steps of freezing, sublimation and desorption as were shown in FIG. 9 are also shown here, but a transition zone may be added. On the vertical axis the shelf temperature of the prior art Tset_pa is indicated, as well as the critical temperature Tcrit, which is of course the same as in the prior art if the same product is being dried.

As was shown in FIG. 10(*b*), the temperature Tcw on the outside of the container wall 105 is higher than the temperature T1out on the inside of the container wall, which is equal to the highest temperature of the product. The task of the control method is to guarantee that the product temperature anywhere in the product is always lower than the critical temperature Tcrit, or since T1out is the highest temperature inside the product, that T1 out is always lower than Tcrit. Using the mathematical model, the temperature difference ΔTcw (=Tcw−T1out) over the container wall 105 can be calculated, and thus the product temperature Tprod can be determined or estimated.

Since the method is not controlling a shelf temperature blindly (in case the containers are suspended, there may even be no shelf), but "knows" what the product temperature is, it can apply higher amounts of heat energy to the container, preferably the maximum amount for which the sublimation front can still "follow" as depicted in FIG. 11(*a*). The increased amount of heat energy means that the ice crystals will be sublimated faster, or in other words that the throughput is increased, or the time of the sublimation step is reduced. In other words, while the present invention also uses a safety margin Tsm, its value need not be unnecessarily large, and can even be adjusted over time, in contrast to the prior art where the value of the safety margin is kept constant.

In the example shown, the heater is controlled in such a way that the temperature on the outside of the container wall Tcw is allowed to approach the critical temperature Tcrit quite closely at the beginning of the sublimation step, and could even be slightly larger than Tcrit if so desired. As the sublimation proceeds, the temperature difference between the critical temperature Tcrit and the outside temperature Tcw of the container wall is gradually increased to create some extra margin between Tcrit and T1out. A typical temperature profile of the product is also shown (curve "T1out"). As can be seen, this temperature will typically also show a small ripple.

As illustrated in FIG. 12(*b*), the skilled person can choose a suitable safety margin curve, which may be relatively small at the start of the sublimation (for example at least 1° C. or at least 2° C.) and is relatively large at the end of the sublimation (e.g. about 5° C.), but of course other values can also be chosen. In between these values any suitable curve can be used, for example a straight line 1201, or a piece-wise linear curve (not shown) or a staircase function 1202, or a quadratic function 1203, or an exponential function (not shown) or any other suitable curve, preferably a monotonically increasing curve.

In a particular embodiment, a constant curve 1204 is chosen as the safety-margin, but even then the method of the present invention works completely different from the prior art, because the algorithm would still determine, e.g. calculate the product temperature, and adjust the heating such that the temperature Tcw at the outside wall of the container results in a temperature difference between the product and the critical temperature "Tcrit−Tprod" which is chosen/set/regulated to be substantially equal to the chosen safety margin value during sublimation "Tsm_sub", whereas in the prior art the temperature difference between the shelf and the critical temperature "Tshelf−Tcrit" would be chosen/set/regulated to be substantially equal to the safety margin value Tsm. Of course, the curve 1204 will not provide the optimum speed, but illustrates that the safety margin of the present invention may be chosen to be constant during the sublimation, although that is not preferred.

Referring back to FIG. 12(*a*), as the sublimation proceeds and the amount of ice crystals decreases, the safety margin ΔTsm_sub needs to be sufficiently high such that, at the end of the sublimation step, when the sublimation front arrives at the container wall and heat is no longer absorbed by sublimation of ice crystals, the temperature of the product suddenly increases (point "A" in FIG. 12(*a*)), causing also the temperature Tcw to increase. This is detected by the control system, by measuring/monitoring the temperature on the outside surface of the container on the one hand, but especially by recognizing that the temperature on the outside of the container increases faster than expected, based on the energy supplied to the one or more heaters. This is an important point to detect. Once detected, the heat energy supplied to the heaters is preferably drastically reduced. As shown in FIG. 12(*a*), the safety-margin Tsm_sub at or near the end of the sublimation process should be chosen sufficiently high, such that there is still a margin "M" between the maximum product temperature Tprod_max and the critical temperature Tcrit. It will be appreciated that this margin "M" can be increased, if desired, for example by lowering the temperature profile Tcw, especially when approaching point A, for example a few minutes before that occurs (according to the prediction).

Overall, it is expected that by using methods according to the present invention, the duration of the sublimation step may be reduced by at least 5% to 10% for at least a number of pharmaceutical products, without compromising the quality, which is a considerable improvement.

As explained above the transition between the sublimation step and the desorption step is gradual. As is the case in the prior art, the heat supplied during this transition must be moderate, in order not to overheat the product. During this transition period the same process as was used in the prior art can also be used here. As an example only, the one or more heater(s) may be controlled such that the temperature Tcw on the outside of the container wall is maintained at a fixed predefined temperature, the value of that predefined temperature being depending on the product.

Although not shown in as much detail as for the sublimation step, it will be understood that a similar method as described above can also be used for the desorption step, as shown in the right part of FIG. 12(*a*).

The mathematical model for desorption of the product after the first drying step can be largely the same or similar to that of the simple sublimation model described above, except that in this case the starting material is not a frozen product comprising ice crystals, but is a relatively dry product not having ice crystals but having a porous structure still containing some moisture content that has to be removed. A model with three concentric cylinders as shown in FIG. 10(*b*) can also be used here, but now the first zone 101 is the zone where moisture is largely removed (i.e. the dry zone), and the second zone 103 still comprises moisture that needs to be substantially removed, and during desorption, there is no sublimation front between the first and second zone 101, 103.

Also, the thermal characteristics of the first zone 101 and of the second 103 are drastically different, since the driest portion of the product is now located close to the container wall 105 rather than facing the center of the container. During the desorption, the thickness (or extend) of the first zone 101 gradually increases while the thickness of the second zone 103 gradually decreases. The progress of the desorption can be represented by the position of a virtual interface between the first and second zone, moving radially inwards.

If heat is provided sufficiently slow, the temperature gradients are similar to those shown in FIG. 10(*c*) in the sense that Tcw>T1out>T1in, but the slopes may be different, and the energy is absorbed by evaporation rather than by sublimation, but mathematically, the same model can also be used. Furthermore, the critical temperature is not a constant temperature, but is dependent on the moisture content of the product, which may be approximated by a predefined curve as a function of time, e.g. a linear curve. Alternatively, the moisture content may for example be determined using NIR sensors and appropriate calibration. With the known product characteristics, i.e. the relation between Tcrit and moisture content, the settings of the heater(s) may be adjusted accordingly.

While the parameter values are different, the same hardware setup of FIG. 7, using a thermal infrared camera 701 and an image processing unit or module 702, and a controller 713, e.g. computer using a mathematical model to calculate a temperature or temperature profile in the product, and adapted for driving at least one heater 705, can again be used.

The main task of the desorption method is to control the at least one heater 705 such that the temperature of the product "Tprod" is guaranteed to be always lower than a predefined (but not constant) critical temperature, sometimes referred to in the art as the "glass temperature" Tg, which is a maximum allowed temperature that depends on the specific product but also on the moisture content thereof, but in the present invention is simply referred to as critical temperature. As the moisture content decreases, the critical temperature increases according to a known relation.

The same advantages as mentioned above for the sublimation method according to the present invention are also applicable for a desorption method according to the present invention, inter alia, rather than controlling the temperature of a shelf and relying on an overly large safety margin, inevitably resulting in a slow process, methods according to the present invention take into account a mathematical model that models the progress, and therefore can control the process more accurately and may speed up the process without compromising product quality, by calculating or estimating the real product temperature, and by taking into account a safety-margin between the critical temperature and the product temperature, which safety-margin may be constant or may be adapted during the process.

As explained above, by using a mathematical model, the processor or computer or the like can calculate parameters of the product which cannot be directly measured, and can predict thermal behaviour of the product. Moreover the progress of desorption can be verified during the process, e.g. in real-time, albeit indirectly, by taking measurements of the temperature on the outside surface of the container 703 and by correlating those values with expected temperature values, based inter alia on a cumulative amount of heat supplied to the container.

Another difference with the sublimation method is that there is little margin at the start of the desorption process, but as time increases and there is more room for margin, the model will help to take benefit of the margin rather than using an overly broad margin, thus saving time while remaining safe.

Figure 13:
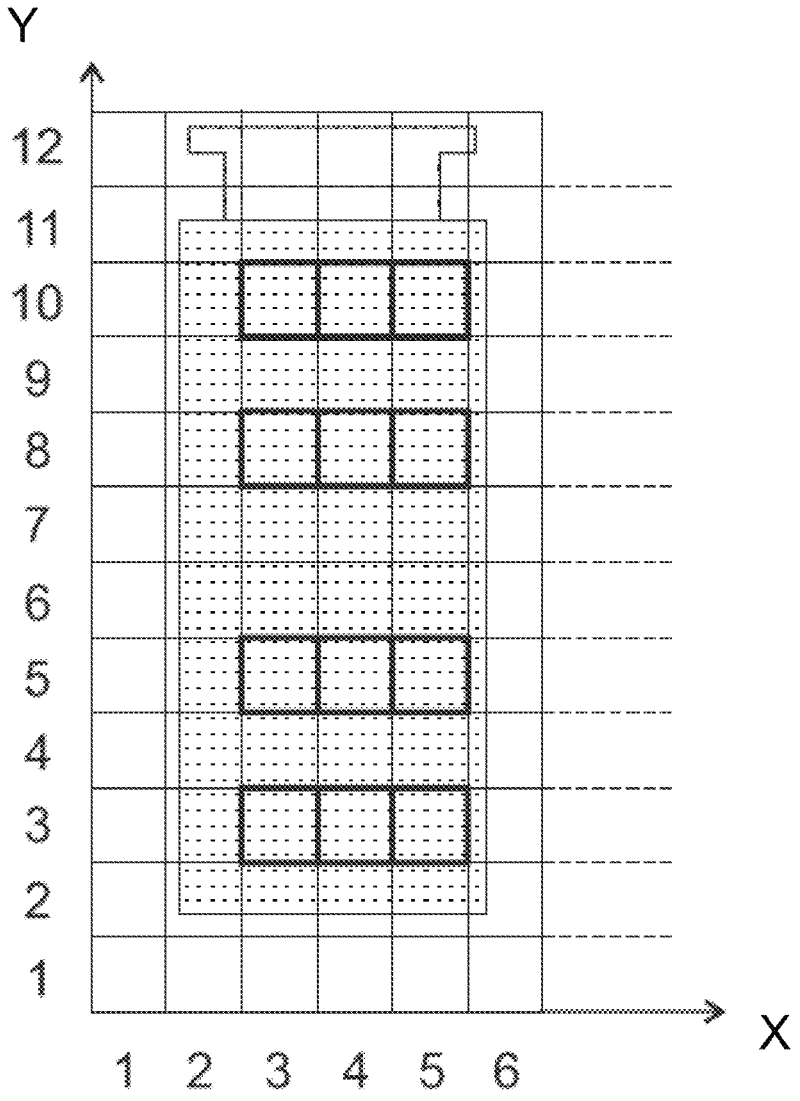
FIG. 13 illustrates by way of an example, how the temperature at one or more points on the outer wall surface of the container can be obtained via a thermal IR image obtained from a thermal IR camera, and suitable processing.

FIG. 13 illustrates by way of example, how the temperature at one or more points on the outer surface of the container wall can be obtained via a thermal IR image 1300 captured by a thermal IR camera, and by suitable processing. Image processing techniques are well known in the art and hence need not be explained in full detail here.

For the present invention, the image processing module 702 (see FIG. 7) would identify the location of the container (or more correctly stated, identify the image pixels related to the container), and in case multiple containers are present, the respective locations of each of the containers. Also the image processing module would typically ignore pixels located on the boundaries of the container, because these pixels also provide information about the background.

In the example shown in FIG. 13, the pixels located in the columns X=3 to 5, and on the rows Y=3 to 10, that is 3×8=24 pixels in total, could be used for determining a temperature Tcw of the outside surface of the container wall but of course the present invention is not limited to this specific example.

Depending on which mathematical model is used, a subset of these 24 pixels can be used. For example, in the model described above where the container and the product is represented by three concentric cylinders, it is assumed that the entire outside surface of the container wall has one single temperature Tcw. In this model, the temperature of the outside surface could for example be calculated as the average of the 24 pixels mentioned above, but other selections would also work, for example the average of eight pixels located on the column X=4 would also yield a good temperature value indicative of the temperature on the outside surface of the container wall.

In some embodiments, the camera 701 (see e.g. FIG. 7 or FIG. 8 or FIG. 23) may comprise further means for shielding or blocking the field of view, in particular for avoiding reception of radiation from an IR heater 705 located behind the container. Also in such embodiments, the image processing unit 702 may be adapted for calculating the average of the pixels located on a "vertical" line of the image (in the example of FIG. 13, for example the pixels located at X=3 and Y=3 to Y=10), and for disregarding all other information. Since the container is rotating around its longitudinal axis, this still provides information about the temperature of the entire container surface. The sampling frequency of the camera should be chosen such that each IR image pertains to different positions of the container wall.

However, if a different mathematical model is used, for example a model wherein the product is represented by a plurality of at least two disks stacked on top of each other, each disk comprising three annular rings, rather than three concentrical cylinders spanning the entire product height, an average value may be calculated for the pixel locations corresponding to the physical locations on each of the disks. For example, a first average could be calculated over the twelve pixels located at Y=7 to 10 and X=3 to 5, indicative of the surface temperature of the upper disk, and a second average may be calculated over the twelve pixels located at Y=3 to 6 and X=3 to 5, indicative of the surface temperature of the lower disk. But of course, this is only an example, and the skilled person can easily find other suitable subsets of pixels.

It is pointed out that, the "maximum" temperature of the product (i.e. the temperature T1out in FIG. 10(*c*)) is preferably derived from an "average" temperature of a subset of the pixels-values (corresponding to an average of Tcw-values of different positions located on the external surface of the container). But it would also be possible to derive the temperature T1out from calculating the "maximum" or "median" temperature of the pixel values.

Figure 14:
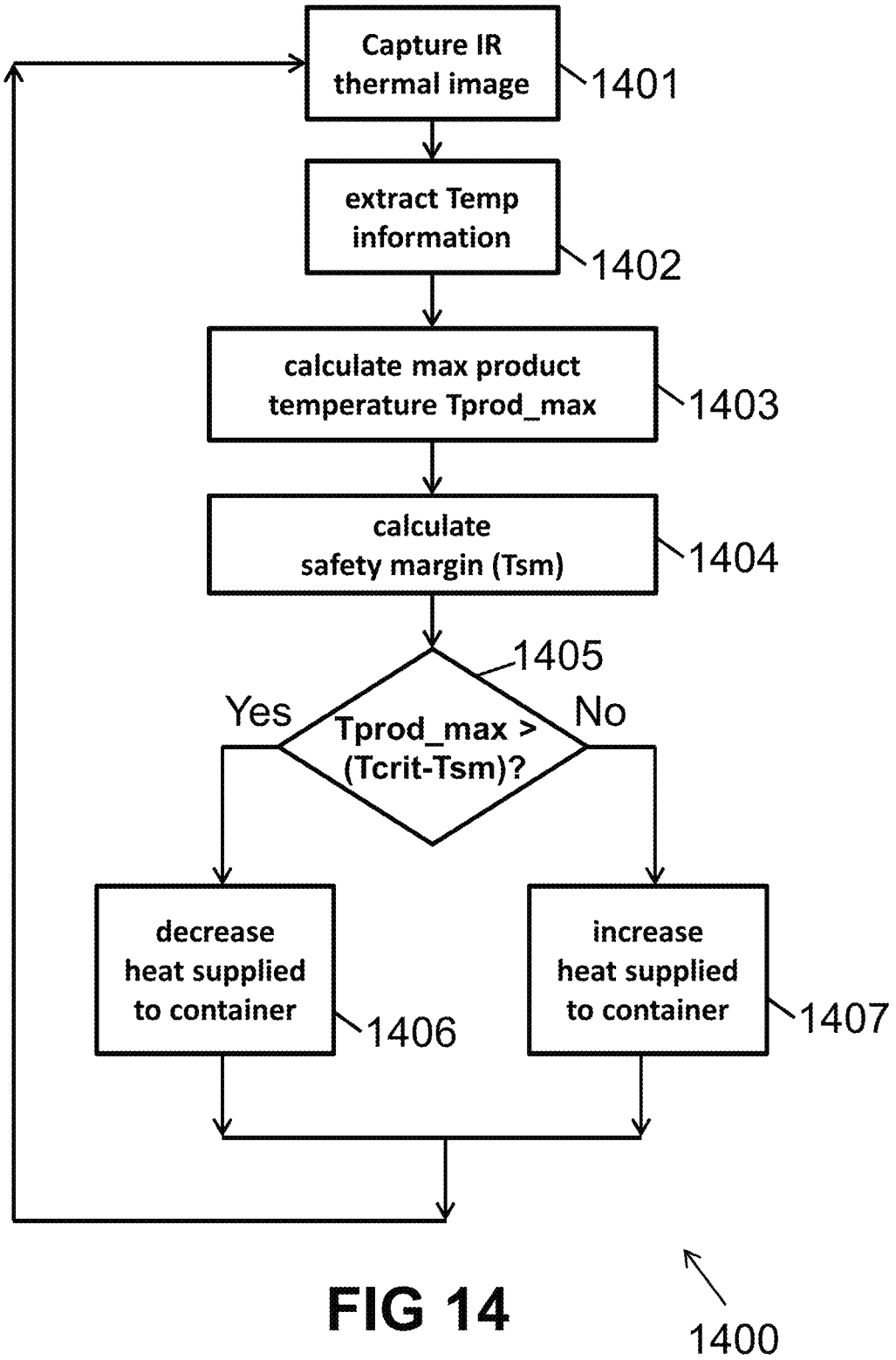
FIG. 14 shows a simplified flowchart of a method according to an embodiment of the present invention. This method can be used for the first drying step (sublimation) and/or for the second drying step (desorption), although the underlying physics, the parameters of the model (e.g. the thermal coefficients) and the constraints (e.g. the critical temperature involved) may be different.

FIG. 14 shows a simplified flowchart of a method 1400 according to an embodiment of the present invention, which may be performed by the controller 706 of FIG. 7 or the computer 713 of FIG. 8 or the computer 2313 of FIG. 23. This method can be used for the first drying step (sublimation), but also for the second drying step (desorption), although the parameters of the underlying mathematical model and the critical temperature involved is different.

In step 1401 a thermal IR image is captured using a thermal IR camera 701. The camera takes thermal pictures at a predefined frame rate, and provides the thermal images to a controller 706, e.g. to a computer 713.

In step 1402 an image processing module 702 extracts temperature information from said thermal images, optionally taking into account also other temperature information, for example from Pt100 probes.

In step 1403 a maximum product temperature "Tprod_max" is calculated using a mathematical model. For the model and the situation shown in FIG. 10(*b*), the maximum temperature is T1out.

In step 1404 a temperature safety margin "Tsm" is calculated, based on the progress of the sublimation. As discussed in relation to FIGS. 12(*a*) and 12(*b*), the value of the safety margin between the product temperature Tprod and the critical temperature Tcrit can be chosen relatively small at the start of the sublimation step (meaning that the temperature Tcw may even be higher than Tcrit), but must be chosen sufficiently high (for example in the order of at least 5° C.) near the end of the sublimation step.

In step 1405 it is tested whether the maximum product temperature "Tprod_max" is larger than the difference between Tcrit and Tsm, and if the outcome of the test is true, step 1406 is performed, and if the outcode of the test is false, step 1407 is performed.

In step 1406 heat energy supplied to the container is decreased, for example by decreasing power supplied to the local heater 705, and/or by increasing a distance between the local heater 705 and the container, and/or by changing an orientation of the heater, and/or by decreasing an exposure time of the container to a local heater.

In step 1407, heat energy supplied to the container is increased, for example by increasing power supplied to the local heater, and/or by decreasing a distance between the heater and the container, and/or by changing an orientation of the heater, and/or by increasing an exposure time of the container to a local heater.

It is important to note that the safety margin of the prior art is typically based upon assumed thermal interactions between the shelf and the container leading to a derived critical temperature of the shelf and subsequently a safety margin to incorporate variability, whereas in the present invention the safety margin is defined as the temperature difference between the product temperature and the critical temperature, which is completely different.

Figure 15:
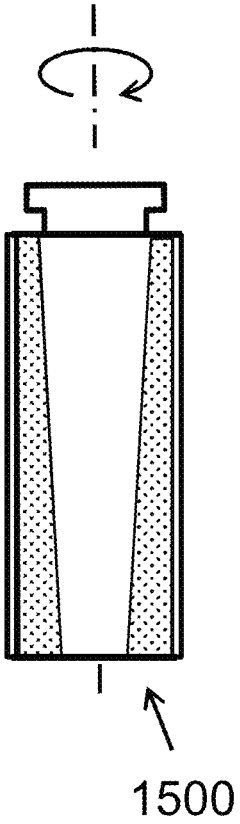
FIG. 15 shows a container like that of FIG. 4, but wherein a variation of the thickness of the dispersion or solution layer is taken into account. According to the present invention this situation can be modelled by a second, somewhat more advanced mathematical model, wherein the substance in the container is modelled by a plurality of at least two stacked disks, shown in FIG. 17.

In FIG. 10(*a*) it was assumed that the product forms a layer of constant thickness against the container wall, when being spin-frozen. In practice this is not entirely correct, because the speed is not infinitely high. If the speed during spin-freezing is still very high (for example in the order of 3000 RPM or 4000 RPM or more), the product layer would indeed be located at the container wall, but would have a non-constant thickness, but have a shape as shown in FIG. 15. Depending on the speed at which the container was rotated during spin-freezing, the thickness variation will be more pronounced. (actually, the inner surface of the product has a paraboloid shape, but it is approximated by a conical shape, and represented by a straight line in the cross sectional drawing of FIG. 15.

Figures 16A, 16B, 16C:
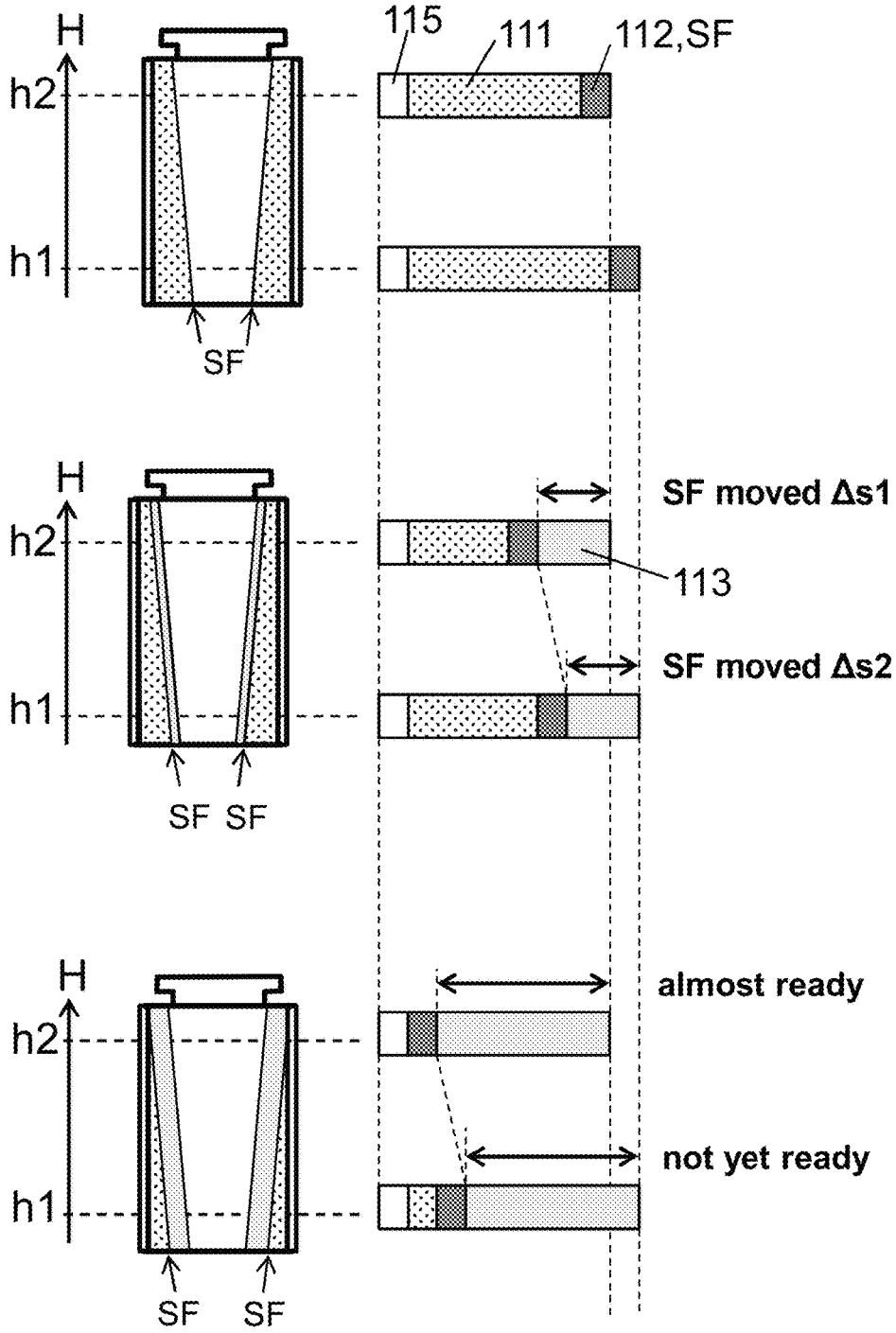
FIG. 16(*a*) to FIG. 16(*c*) show progress of the sublimation of the product in the container of FIG. 15.

FIG. 16(*a*) to FIG. 16(*c*) show how the sublimation process will proceed when uniform heating is applied to the container wall of FIG. 15: the sublimation front 112 at the top (where the product layer is thinner) will arrive sooner at the container wall 115 than the sublimation front at the bottom (where the layer is ticker), as depicted in FIG. 16(*c*). Since the sublimation is not finished yet at time "t3" (there are still ice crystals in the product), heat energy is still required to feed the sublimation process, but since the top of the product is already relatively dry, care has to be taken that this part of the product is not overheated. Clearly, the simple mathematical model with three concentric cylinders of FIG. 10 and FIG. 11 is not ideal for this situation.

Figure 17:
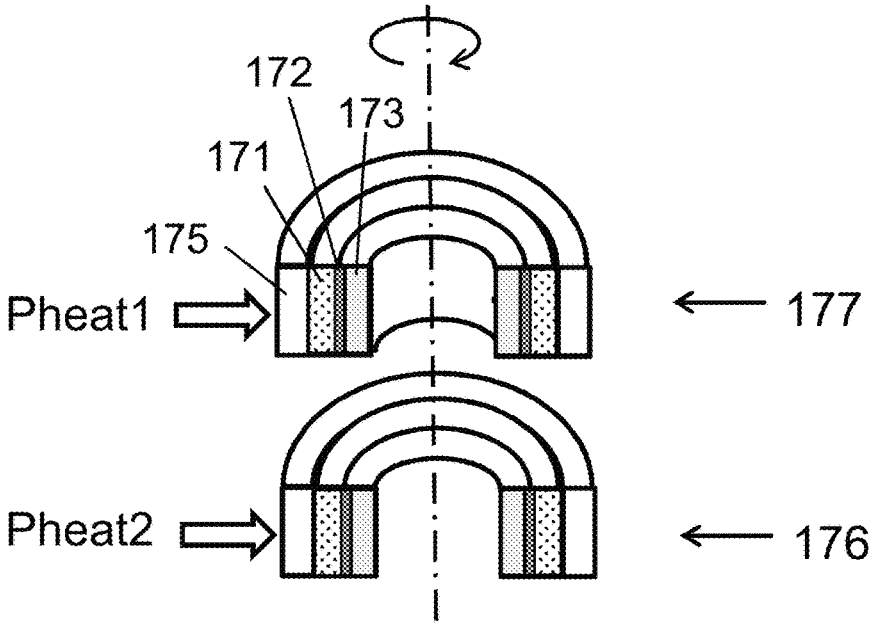
FIG. 17 shows the second (advanced) model according to the present invention, wherein the substance in the container is modelled by a plurality of at least two disks.

According to particular embodiments of the present invention, this situation can be modelled by a second, somewhat more advanced mathematical model, wherein the substance in the container is represented by a plurality N of at least two disks 176, 177, stacked on top of each other, but of course a larger number of disks can also be used, for example at least three or at least four, or at least five disks. FIG. 17 shows an example of such a model having only two disks: an upper disk and a lower disk. The model can treat both disks separately, each disk is assumed to receive its own amount of heat, and each disks has its own outside temperature, for example Tcw1, Tcw2. For simplicity of the model, it is assumed that no heat is exchanged between the disks.

In analogy with the three-cylinder model of FIG. 10(*b*), each disk consists of three annular rings: an outer ring 175 comprising material of the container wall, an intermediate ring 171 or first zone comprising substance with ice crystals, and an inner ring 173 or second zone comprising substance without ice crystals. The first zone 171 and the second zone 173 are separated by an interface known as "sublimation front" 172. The thickness of the sublimation front is exaggerated in the figures for illustrative purposes.

Using this mathematical model with at least two disks, the control algorithm of FIG. 14 using a single heater can still be used, but the model would calculate two product temperatures (a first temperature Tcw1 for the upper disk, and a second temperature Tcw2 for the lower disk), and depending on the progress of the sublimation of the two disks, two safety margins (one for the upper disk, and one for the lower disk). Since there is only a single heater, the more stringent of the two safety margins applies. Overall, this would result in a sublimation process similar to that of FIGS. 12(*a*) and 12(*b*), at least initially, but the "transition period" would start sooner, namely when the sublimation front 172 of the upper disk has arrived at the container wall 175. But even when heated with only a single heater, methods according to the present invention using a mathematical model with a plurality of at least two disks, may still provide a speed improvement over the prior art, and will do so without compromising the product quality at any moment in time, by calculating the product temperature inside each of the disks 176, 177 using the mathematical model, and by calculating a corresponding safety margins, and by driving the heater using the most stringent requirement.

However, in embodiments of the present invention, different amounts of energy are deliberately provided to different parts of the container. This can for example be implemented by means of at least two separate IR heaters, which can be powered separately, or by using a segmented radiator 1805, meaning a single radiator with a plurality of heating elements 1803, 1804 (e.g. filaments) that can be individually powered, as shown in FIG. 18, for example a heater 1805 with two segments, but of course the present invention is not limited to these examples, and more than two heating elements can also be used.

Figure 18:
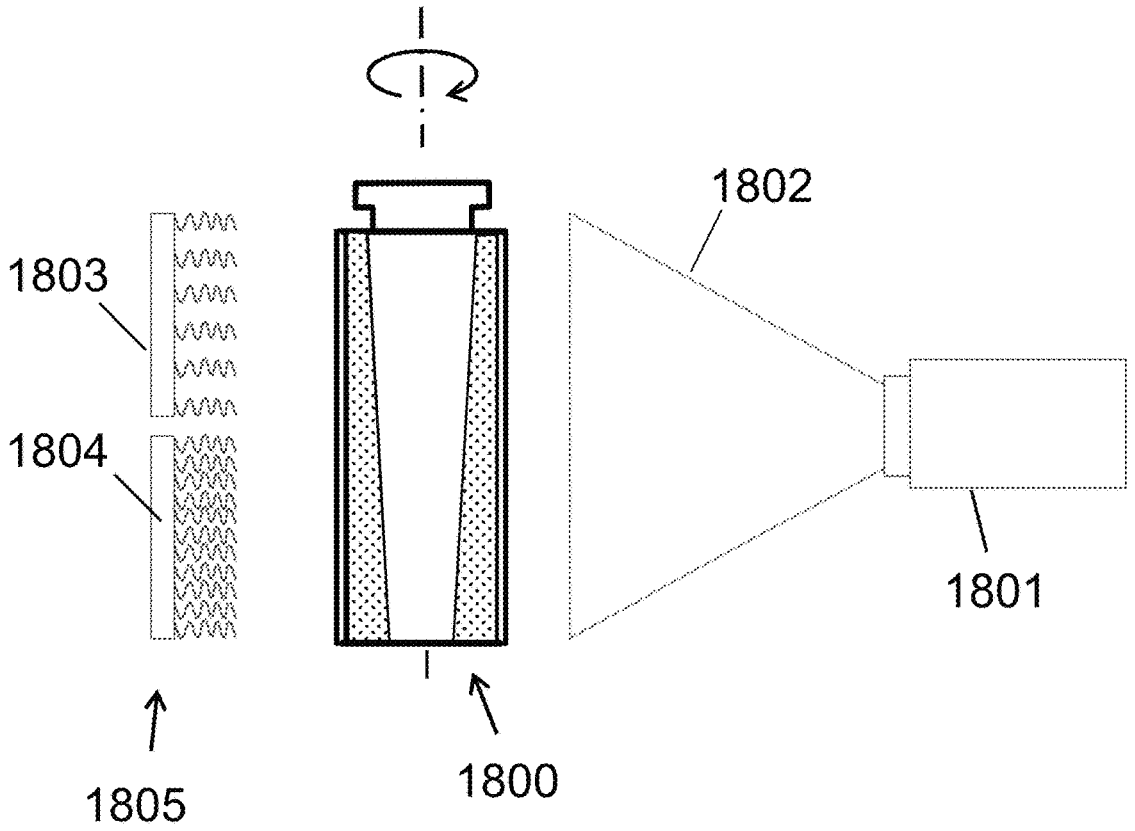
FIG. 18 shows an arrangement (as can be used in a method or apparatus according to the present invention) with a segmented radiator for deliberately heating the container of FIG. 15 non-uniformly.

The skilled person having the benefit of the present disclosure, will understand that use of the multiple-disk model of FIG. 17 in combination with multiple heaters or a multi-filament heater of FIG. 18, and a control algorithm as described above, where each of the heaters are controlled to obtain a predefined safety-marging between the product and the critical temperature, allows to control the sublimation process of the container and product of FIG. 15 even better.

Although not explicitly shown, the two heaters 1803, 1804 shown in FIG. 18, or the heater 1805 with two segments 1803, 1804 (the drawing can be interpreted in two ways), may further comprise reflecting means or focusing means, for example a mirror or a bend metal surface for directing the radiation in a particular direction, for example such that radiation from the upper heater segment 1803 mainly heats the upper disk(s), and barely heats the lower disk(s), and vice versa.

Figure 19:
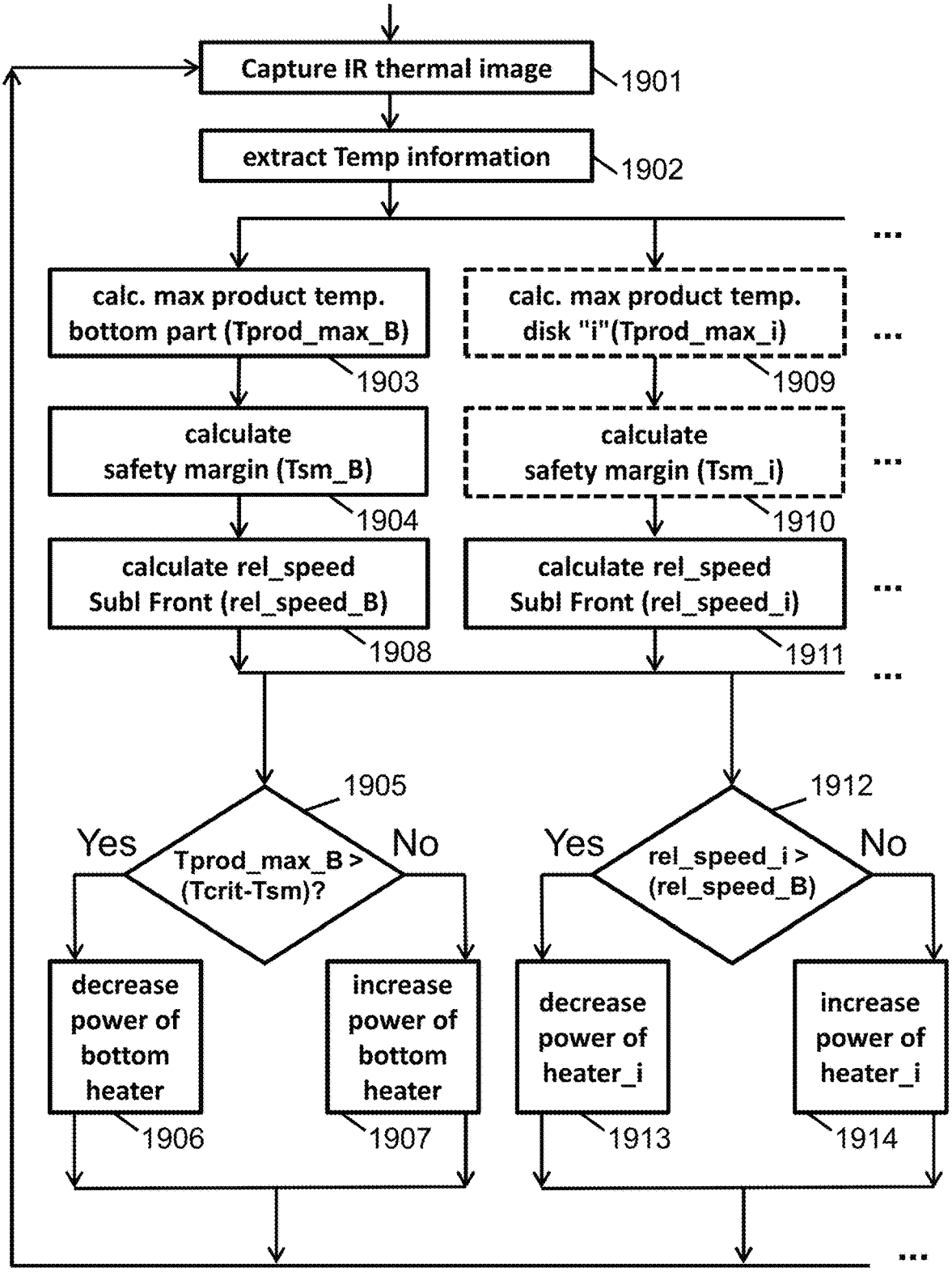
FIG. 19 is a flowchart of a method according to an embodiment of the present invention for controlling the sublimation using at least two heaters, for example as shown in FIG. 18.

FIG. 19 illustrates another method 1900 according to an embodiment of the present invention for driving a plurality of at least two heaters 1803, 1804 or at least two filaments of a single heater 1805 such that the sublimation front at the top and at the bottom of the container (see FIG. 16) arrives at approximately the same time over the entire height of the container. The idea behind the algorithm is that the sublimation front of the "bottom disk" is driven in the manner as described above, (thus: at "maximum speed" at the beginning of the sublimation step, but gradually slowing down when approaching the container wall), and that all other heaters adjust their set point such that the relative speed of the other disks is substantially the same as that of the bottom disk. With "relative speed" is meant the speed relative to the average thickness of the product layer. For example in case of two disks, if the average thickness of the upper disk is 20% less than the average thickness of the lower disk, then the upper heater would be driven such that the sublimation front would move at about 20% lower speed than the sublimation speed of the lower disk.

Thus the steps 1901 to 1907 are identical or similar to the steps 1401 to 1407 of FIG. 14, except that the max product temperature is calculated (step 1903) only for the product of the bottom disk, and the heater involved in step 1906 and 1907 is the bottom heater.

In step 1908 the relative speed of the sublimation front of the bottom disk "rel_speed_B" is calculated.

In optional step 1909 the maximum product temperature "Tprod_max_i" is calculated for disk number "i" (i being an integer value starting from 2, the bottom heater is considered heater #1).

In optional step 1910 the safety margin "Tsm_i" is calculated for disk "i", based on the progress of the sublimation front of that particular disk.

In step 1911 the relative speed of the sublimation front "rel_speed_i" is calculated for disk "i". If the optional steps 1909 and 1910 are not present, the relative speed of disk number "i" can be estimated to be a fraction of the relative speed at the bottom, the fraction being proportional to the thickness of the product layer.

In step 1912 the relative speed of the sublimation front of disk "i" is compared to the relative speed of the sublimation front of the bottom disk, and the power of the local heater "i" is decreased (step 1913) if the relative speed of the disk "i" is higher than the relative speed of the bottom disk, or increased (step 1914) if the relative speed of disk "i" is lower than the relative speed of the bottom disk.

Even though this method means that the sublimation front at the top of the container is not moving "as fast as possible", this approach offers (inter alia) the advantage that the risk of overheating the product in the upper part is reduced, and that the sublimation ends substantially everywhere at the same time, and the desorption starts substantially everywhere at the same time.

Figure 20:
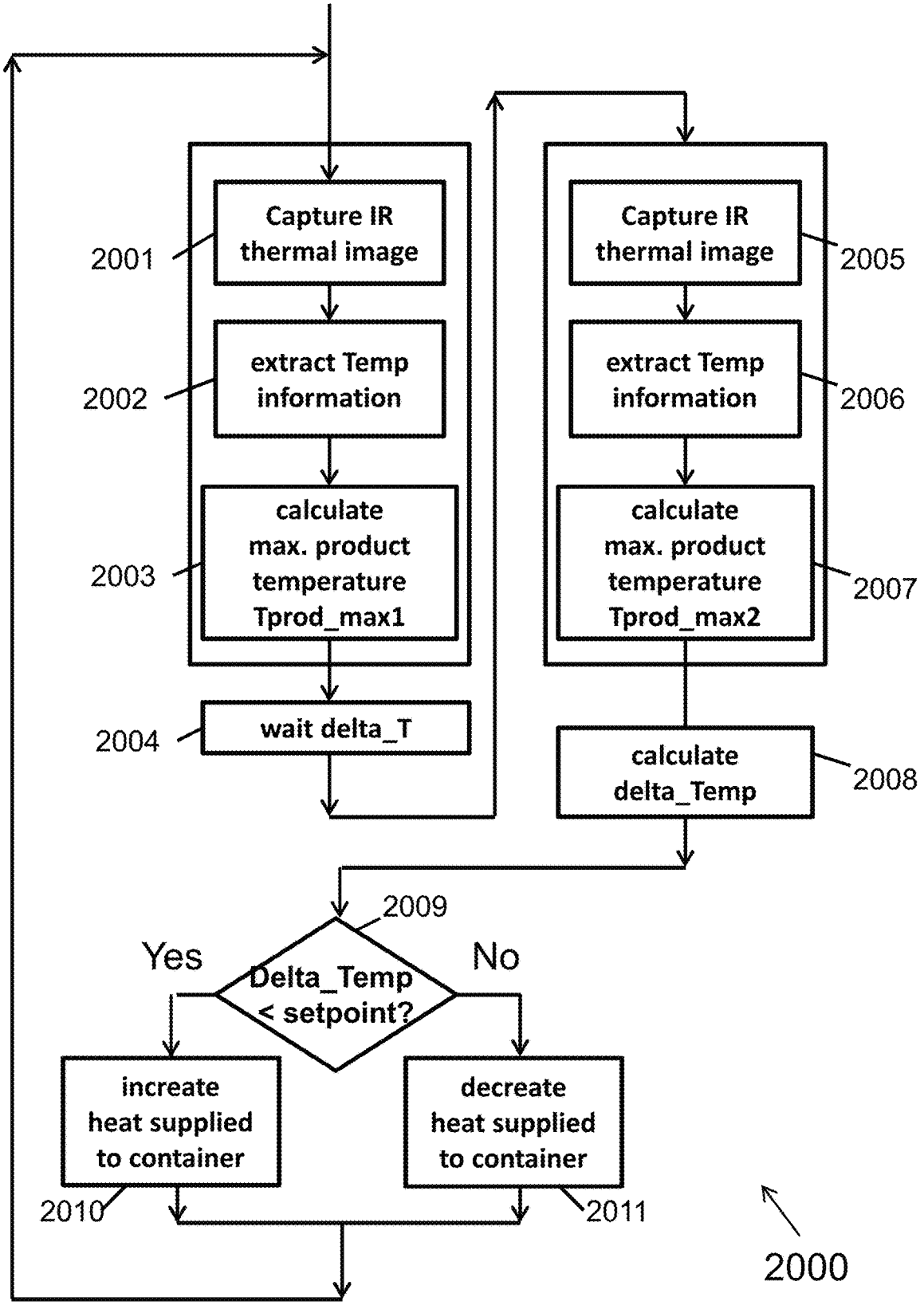
FIG. 20 is a flowchart illustrating a method of desorption according to an embodiment of the present invention.

FIG. 20 is a flowchart illustrating a method 2000 for controlling one local heater during the desorption step, according to an embodiment of the present invention. It can be seen as a special case of the method illustrated in FIG. 14.

The steps for monitoring the product and for controlling the heater are similar to those described above, and are therefore only briefly described.

In step 2001 a first thermal IR image is captured.

In step 2002 temperature information is extracted.

In step 2003 the maximum product temperature Tprod_max1 is calculated using the mathematical model, and taking into account the data of the first thermal IR image, e.g. by calculating an average or mean or maximum or median of a subset of the temperature values corresponding to the pixel-values, and the heat energy absorbed by the container and/or the heat energy supplied by the heater.

In step 2004 a predefined time period delta_T is waited, because it takes time for the dry matter to conduct heat energy.

In step 2005 a second thermal IR image is captured.

In step 2006 temperature information is extracted from the second IR image.

In step 2007 a second maximum product temperature Tprod_max2 is calculated based on the second thermal IR image.

In step 2008 a temperature difference delta_Temp is calculated as the difference between Tprod_max1 and Tprod_max2.

In step 2009 it is tested whether the temperature difference delta_Temp is smaller than a predefined setpoint, characteristic for the product. If the outcome of the test is true, the heat supplied to the container is increased in step 2010. If the outcome of the test is false, the heat supplied to the container is decreased in step 2011. As described above, "increasing the heat to the container" can be implemented in several ways, for example by increasing the power of the heater, decreasing a distance between the heater and the container, changing an orientation of the heater relative to the container, or increasing the exposure time, etc.

The skilled person will recognize that this control loop actually tracks the slope of the temperature during the desorption. Thus, in this case the signal 814 (see FIG. 8) does not contain the critical temperature Tcrit[mc] as a function of moisture content or Tcrit[time] as a function of time, but the slope of the critical curve $\Delta$Tcrit/$\Delta$t, which is more or less equivalent (incremental control versus absolute control).

Desorption is mainly a temperature controlled process. At first sight the method 2000 may look the same as the method used in the prior art, but it is not, because in the prior art the heating/cooling means are adjusted such that the shelf temperature follows a predefined curve, whereas in the present invention, the local heating means are controlled such that the maximum product temperature (as provided by the mathematical model) follows a predefined temperature profile. That is radically different.

In an alternative embodiment, the maximum product temperature Tprod_max1 in step 2003 is determined using a predefined relationship between temperature of said product and the level of residual moisture, which level may be measured using NIR spectroscopy sensors. In this case the control loop is determined by knowledge about the condition of the product in the container.

The skilled person having the advantage of the present disclosure, can easily think of other variants.

Referring back, FIG. 15 showed a container 1500 with a cylindrical portion holding a product in the form of an ice layer of non-constant thickness. FIG. 17 showed that the behaviour of this product can be described using a mathematical model comprising a plurality of at least 2 disks. The hardware of FIG. 18 and the method of FIG. 19 describe a first solution for non-uniformly heating the container, such that the "sublimation front" of the product (during the first drying step) arrives at the container wall at approximately the same time over the entire height of the product.

Figure 21:
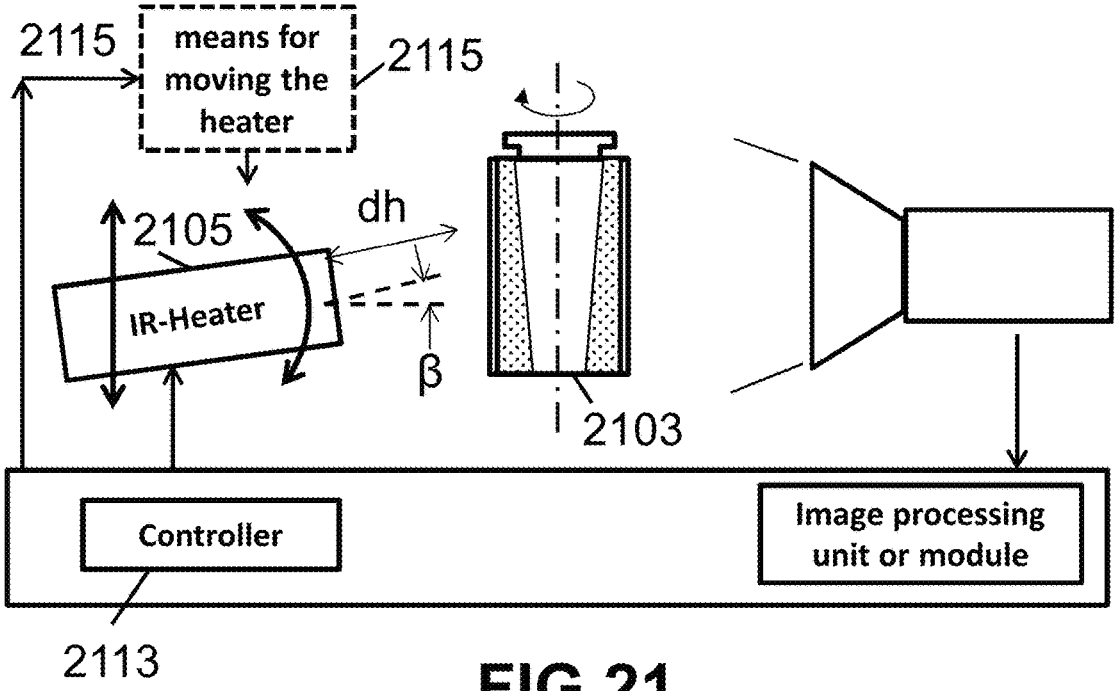
FIG. 21 shows another apparatus according to an embodiment of the present invention, adapted for freeze-drying the substance stored in the container of FIG. 15, using only a single heater.

FIG. 21 shows a second solution for addressing the problem of non-uniform thickness, where a single movable heater 2105 is provided for deliberately non-uniformly heating the surface of the circumferential portion of the container 2103. As discussed in FIG. 8, in this case the controller 2113 would not only control the power of the heater 2105, but would also control the position and/or orientation of the heater. This system (hardware and software) can also be used for containers where the thickness of the product layer is substantially constant, in which case the system has more degrees of freedom to even better control the drying process, for example to take into account deviations due to the presence of the container bottom or the presence of the container top, or due to reflections inside the chamber, etc. Preferably in this case the heater has a directed beam or non-uniform beam, to only heat a portion of the container.

FIG. 22(*c*) shows a third solution for addressing the problem of a product layer with a non-constant thickness, by addressing the root cause of the problem. Indeed, when rotating a cylindrical container having a liquid product, the product will assume a shape with a paraboloid surface as shown in FIG. 22(*a*), due to gravitational and centrifugal forces. Depending on the amount of liquid and/or the inner diameter of the container and/or the rotation speed, the bottom of the container may or may not comprise liquid at the center, resulting in a truncated paraboloid surface shown in FIG. 22(*b*). In both cases the liquid has a non-constant thickness.

In the prior art the problem of non-uniform thickness does not seem to be recognized as such, probably because the classical methods of freeze-drying take a large safety margin, and the product temperature cannot be directly measured. However, the inventors of the present invention came to the insight that the product temperature can be determined indirectly by "measuring" the temperature at the circumference of the container and based on a mathematical model, and they further realized that the non-constant layer thickness creates an additional problem to further optimize this method, and they came up with a third idea to solve this problem.

FIG. 22(*c*) shows a container according to particular embodiments of the present invention, having a wall portion with a paraboloid shape or a truncated paraboloid shape. Preferably the paraboloid shape is dimensioned for creating a product layer therein, having a constant thickness when the container is rotated around its longitudinal axis at a predefined angular speed lower than 4000 RPM, the speed corresponding to the specific dimensions and/or curvature of the paraboloid shape.

The container is preferably made of glass or a ceramic material, but containers made of other materials, such as for example aluminium or steel, in particular stainless steel can also be used.

For practical reasons, the container preferably has a flat bottom portion, or another bottom portion allowing the container to be positioned in an upright position (e.g. an upwards directed dome located at the center of the bottom, or any other suitable shape), but the exact shape of the bottom portion is not important for the present invention.

Preferably the paraboloid shape extends over the entire height of the container, but that is not absolutely required, and it suffices that a lower portion 2201 of the side wall 2200 of the container has a paraboloid shape. The upper portion 2202 may for example have a cylindrical shape or a conical shape or any other shape.

Preferably the container has an opening at its top.

Preferably the container has a cavity with a volume smaller than 1000 ml, for example smaller than 200 ml, preferably smaller than 100 ml or smaller than 20 ml. In particular embodiment, the cavity has a volume in the range from about 1.0 ml to about 30.0 ml for pharmaceutical products.

Since the tolerance on the inner diameter of the glass container is typically 0.10 mm, in some embodiments of the present invention a difference between a first inner diameter "D1" at a first position of the paraboloid portion of the container, and a second inner diameter "D2" at a second position of the paraboloid portion of the container is at least 0.20 mm, or at least 0.30 mm, or at least 0.50 mm, or at least 1.0 mm.

The present invention is also related to the use of such a container for freeze-drying a product stored therein, in particular a pharmaceutical composition, or a biological composition, or a cosmetic composition or a medical nutritional product.

The present invention is also related to a container having a paraboloid side wall portion comprising a frozen pharmaceutical or biological or cosmetic or nutricial composition located at an inner surface of said side wall portion, for example as illustrated in FIG. 22(*c*).

The present invention is also related to a container having a parabolic side wall portion comprising a freeze-dried pharmaceutical or biological or cosmetic or nutricial composition located at an inner surface of said side wall portion, for example as illustrated in FIG. 22(*c*).

The present invention is also related to a container having a paraboloid side wall portion comprising a freeze-dried pharmaceutical or biological or cosmetic or nutricial composition, produced with a method according to the present invention.

The present invention is also related to a method of spin-freezing a product stored in a container having a wall portion 2201 with a paraboloid or truncated paraboloid shape.

In order to freeze-dry the product stored inside this container, the simple mathematical three-cylinder model of FIG. 10 can be used, since the product thickness is substantially constant.

Despite the fact that the shape of the product is not exactly cylindrical, the simple mathematical model of three concentric cylinders can be used because the layer has a substantially constant thickness, and the container can be heated by a single heater adapted for radiating the container side wall (or rather the portion where product is located) substantially uniformly.

Alternatively the slightly more advanced multi-disk-with-three-annular-rings model shown in FIG. 17 can be used, which may provide even better results, because the diameters of the "disks" are not constant. The method may use a single stationary heater, or multiple heaters, or a heater with multiple filaments, or a movable heater, as described above.

The main advantages of using a method according to the present in combination with a container having a paraboloid shape as shown in FIG. 22(*c*) are:

(i) the fact that not all products, for example not all proteins are capable of withstanding high rotational speeds, (ii) the speed of the drying, in particular of sublimation can be increased (as compared to the algorithm of FIG. 19), without compromising the quality.

So far only a single container was considered, in conjunction with its local heater. FIG. 23 shows a system 2300 according to an embodiment of the present invention, where a particular product stored in a plurality of containers is being freeze-dried simultaneously, preferably in a "continuous system" having multiple chambers and door locks and the like. A system with multiple chambers and door locks is for example described in WO96/29556A1 incorporated herein by reference in its entirety. An explicit example of such a continuous system and related continuous method is provided further hereinbelow.

FIG. 23 is a schematic representation of an exemplary system 2300 comprising three thermal IR cameras C1, C2, C3 adapted for repeatedly, e.g. periodically capturing thermal IR images. The first and second camera C1, C2 are movable, e.g. rotatable, while the third camera C3 is fixedly mounted. Seven containers, each comprising a product to be freeze-dried, preferably the same product in the same quantity, are being rotated about their respective longitudinal axes. In the example, the first camera C1 is adapted for capturing images of the first, second and third container, the second camera C2 is adapted for capturing images of the fourth, fifth and sixth container, and the third camera C3 is adapted for capturing images of the seventh container. Each container has its local heater H1 to H7. A computer 2313 performs a method according to the present invention for each of the containers.

During sublimation, each local heater H1 to H7 can be controlled independently. During the desoption, each local heater can also be controlled independently, but a common process would additionally control the chamber temperature and pressure. The cameras and the heaters are preferably mounted such that the heaters are not located in the field-of-view of the cameras. Optionally means for limiting the field of view of the cameras may be added to the camera, or a shield having for example vertical slits mounted between the containers and the cameras for allowing a portion of the side wall of the container to be viewed by the camera, while at the same time blocking direct line-of-sight between the heaters and the cameras. The skilled person can easily find suitable arrangements.

While only a single local heater is shown for each container, of course each container may have two or more local heaters, or the local heaters may have multiple segments, for example as explained in FIG. 18. While the system shown in FIG. 23 allows to monitor each of the containers by exactly one camera (albeit not full time), it would also be possible that each container is being monitored (at least for a portion of the time) by two different cameras, for redundance reasons, or that each container has its own camera. Alternatively, if sufficient space is available, a single camera could be used to monitor all containers at the same time. The skilled person can make a suitable trade-off depending on the specific requirements of the system, for example in terms of cost, complexity, reliability, etc.

In another aspect, the present invention also relates to a kit of parts comprising a freeze-drying apparatus in accordance with embodiments of the present invention and a container in accordance with embodiments of the present invention.

It will be apparent that the invention is not limited to the exemplary embodiments shown and described above, but that within the scope of the appended claims numerous variants are possible which will be self-evident to the skilled person in this field, after reading the present disclosure.

In an example for illustrating embodiments of the present invention, described further hereinbelow, an in-line process for continuous freeze-drying of unit doses is presented. Embodiments of the present invention are not necessarily limited to such examples. However, this example may serve to support and/or describe features of embodiments of the present invention and/or to aid the skilled person in understanding the invention and in reducing the invention to practice.

Biopharmaceutical therapeutics are often formulated as dried products through freeze-drying (e.g. lyophilisation) due to their limited stability in aqueous solution. Conventional pharmaceutical freeze-drying may be operated in a batch-wise mode. All vials are continuously filled and loaded onto the shelves in the drying chamber. These vials make up one batch, which is processed through a sequence of consecutive process steps, such as freezing, primary drying and secondary drying, until the final dried product is obtained. This batch approach may have an inherently disadvantageous uncontrolled end product variability. In this example, this disadvantage can be overcome by applying a continuous freeze-drying concept for unit doses, in which each single process step is integrated in a continuous production flow.

At the start of the exemplary continuous freeze-drying process, sterile glass vials are aseptically filled with the aqueous drug formulation before they are transferred to the freezing unit. Here, the vials are rapidly rotated, e.g. gripped at their cylindrical walls and rapidly rotated, for example at approximately 4000 rotations per minute (rpm), along their longitudinal axis to form a thin layer of product spread over the entire inner vial wall. Next, the flow of a cold, inert and sterile gas may cool the solution, eventually inducing ice nucleation (e.g. spin freezing). Upon further cooling, the formed ice crystals start growing, leading to a gradual increase in solute concentration. At the eutectic temperature $T_e$, when a saturated solution is reached, some compounds (e.g., mannitol, sodium chloride or glycine) have the tendency to crystallize. Non-crystallizing materials continue to freeze-concentrate and become supersaturated, leading to an increase in viscosity. At the glass transition temperature $T_g'$, the viscosity has raised to a level beyond which further ice crystallization is inhibited and maximum freeze-concentration is reached. Because of the inhibition in crystal growth at $T_g'$, a small residue of unfrozen water remains present in the amorphous solid.

The spin frozen vials are continuously transferred to a long belt in a temperature-controlled annealing chamber for further crystallization and solidification of the solutes under standardized conditions, e.g. predetermined environmental conditions. When the desired morphological structure is obtained, the vials are further processed to the primary drying unit which is kept under a constant vacuum between 10 and 30 Pa. Both these units may be separated by an appropriate load-lock system to facilitate the vial transfer without disturbing the specific conditions of pressure and temperature in each chamber. Continuous primary drying of the spin frozen vials may require an adequate and uniform energy transfer towards the entire vial wall, to ensure an efficient and homogeneous ice sublimation behavior. One way of providing this energy is via conduction, by placing spin frozen vials in individual, close-fitting temperature-controlled pockets. However, non-contact IR radiation has been shown to be a very feasible method in supplying the energy required for drying of the spin frozen vials. Each vial is slowly rotated (e.g. at approximately 20 rpm) along its longitudinal axis in front of an individual temperature-controlled IR heater. Rotation of the vials during primary drying may ensure a uniform heat transfer. The belt of spin frozen vials may move in discrete steps to place each vial in a known position in front of a single IR heater. The individual IR heaters allow to individualize and optimize the drying trajectory for each spin frozen vial. Non-contact IR radiation offers some benefits over conduction as energy transfer method of preference. A whole range of vial types with different dimensions can be processed without the need for customization of the heatable pockets. In addition, monitoring and control of the drying behavior is facilitated in non-enveloped vials. Lastly, the thermal inertia of the heatable pockets is higher compared to the IR heaters, which allows a faster response to changing input parameters. Residual unfrozen water is removed by desorption during the secondary drying phase until the desired moisture content is achieved. In case secondary drying should be conducted at a pressure level different from primary drying, a second continuous drying unit may be provided, also separated by an appropriate load-lock. At the end of the continuous freeze-drying process, vials are removed from the drying module via another load-lock system and may be transferred to a final unit for stoppering and capping of the processed vials under sterile nitrogen conditions.

Product appearance is an important Critical Quality Attribute (CQA) of freeze-dried drug products. Loss of cake structure (i.e. collapse) should be avoided for aesthetic purposes and to ensure fast reconstitution of the dried product. Therefore, the product temperature at the sublimation interface $T_i$ should be kept below the critical product temperature $T_{i,crit}$ during the entire primary drying process. $T_{i,crit}$ is defined as $T_e$ or the collapse temperature $T_c$ for crystalline and amorphous products, respectively. In general, $T_c$ lies a few degrees above the glass transition temperature $T_g'$ as the high viscosity of the glass near $T_g'$ limits molecular motion. In a previous study, a mechanistic model was developed which allowed the computation of the optimal dynamic temperature profile of the IR heater to maximize the primary drying efficiency while maintaining an elegant product appearance. The development of the optimal IR heater profile for a specific formulation requires the reliable measurement of $T_i$. In conventional batch freeze-drying, $T_i$ is generally measured using resistance temperature detectors (RTDs) or, preferentially, thermocouples. RTDs provide a mean readout for the complete area of the detection element, which is partially in contact with dried material during the majority of the primary drying process, leading to unreliable data. Thermocouples are preferred as the temperature is measured at the point where the two thin wires, made of different metals, are connected, making them less unreliable compared to RTDs in measuring $T_i$. Because of the invasive character of RTDs and thermocouples, the process conditions during freezing and solidification (degree of supercooling) as well as during drying (difference in heat transfer) may be different from situations without these sensors. Therefore, vials containing thermosensors may not be representative for the rest of the batch. Also, the response of the thermocouple is highly dependent of its position in the ice because of the temperature gradient across the frozen product. Deviations in its positioning add to the high uncertainty on the measurement of the "correct" value of $T_i$. In general, thermocouples are inserted in vials by manual operation, which, in a production area, increases the risk to compromise the required sterile conditions. Lastly, thermocouples are unsuitable to measure $T_i$ during the continuous primary drying step. The spinning of the glass vials makes it impossible to insert thermocouples in the frozen product layer during the continuous freezing step. Trying to assess the product temperature through measuring the temperature of the glass wall is compromised by poor contact due to the rotating of the vial.

IR thermography allows non-contact temperature measurements based on the detection of IR radiation emitted by an object and its conversion to a thermal image, displaying the spatial temperature distribution. For in-line temperature monitoring during batch freeze-drying, the IR camera may be implemented on the top of the freeze-dryer which required customization of the equipment by removing a part of the radiation shield to visualize the vials on the top shelf. From this position, only the top of the cake is visualized. As the sublimation front moves gradually downwards during primary drying, most of the time the temperature of the dried product is measured, which may not be representative for $T_i$. In continuous freeze-drying, the vials are not packed on shelves, but may be freely rotating in front of an individual IR heater, forming a long line of vials. The product is spread over the entire wall of the spin frozen vial, which allows complete visualization by the IR camera. The sublimation front moves from the center of the vial towards the glass wall during the continuous primary drying step. Hence, after compensation for the temperature gradient over the glass wall and the ice layer, $T_i$ can be continuously monitored from the very beginning of the primary drying step until the end. The present example illustrates the feasibility of IR thermography in combination with the continuous freeze-drying concept. In a first step, the implementation of the IR camera is described via a model-based design approach. Secondly, the temperature gradient over the thin glass wall of the vial and the ice layer is calculated to accurately measure the temperature at the sublimation interface $T_i$. Finally, the use of IR thermography is evaluated for two different applications: the determination of the endpoint of primary drying and the calculation of the dried product mass transfer resistance $R_p$.

Figure 24:
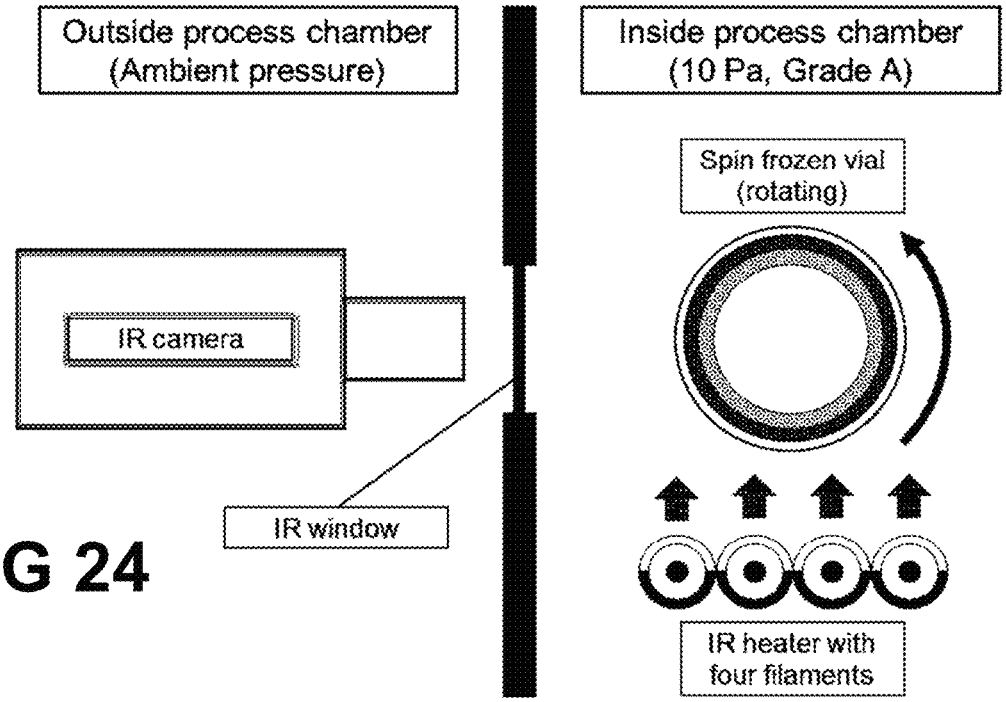
FIG. 24 shows an IR camera set-up (top view) during primary drying with the rotating spin frozen vial and the IR heater inside the vacuum chamber and the IR camera positioned outside measuring through an IR window at an angle of 90°, in accordance with embodiments of the present invention.
Figure 25:
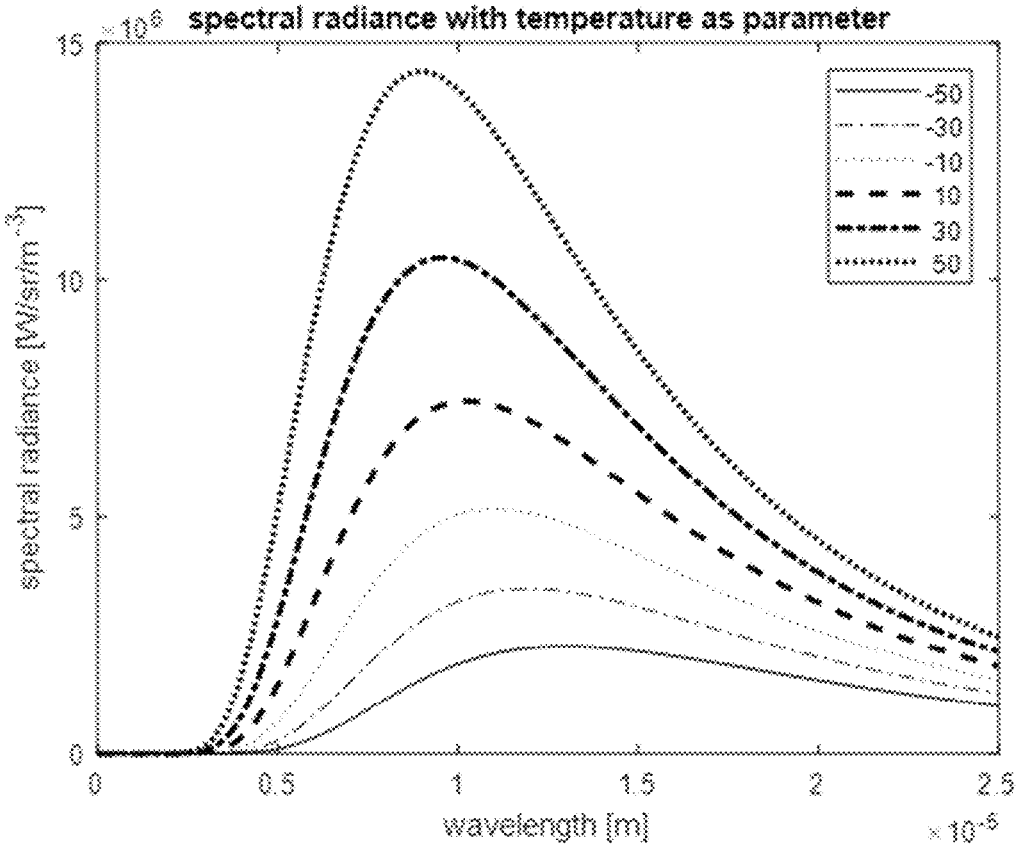
FIG. 25 shows the spectral radiance $B_\lambda$ in function of the wavelength for a vial temperature varying from −50° C. to 50° C., relating to an example illustrating embodiments of the present invention.

The freeze-drying of protein therapeutics needs to meet the Good Manufacturing Practice (GMP) standards for the aseptic production of parenteral drug products. This implies that all product contact areas need to be sanitized and sterilized using Cleaning-in-Place (CIP) and Sterilization-in-Place (SIP) procedures. Since an IR camera is generally not compatible with such processes, this camera must be positioned outside the process chamber, as shown in FIG. 24. Hence, the temperature of the spin frozen vials was monitored through a window consisting of a material which is highly transparent for the electromagnetic radiation emitted by these vials. The radiation spectrum of an object is highly dependent on its temperature. This relation is described via Planck's law, which calculates the spectral radiance $B_\lambda$ (W/(sr m$^3$)) in function of the wavelength (m) and the absolute temperature T (K) of the object:

$$B_\lambda(\lambda, T) = \frac{2hc^2}{\lambda^5} \frac{1}{e^{\frac{hc}{\lambda k_B T}} - 1}$$

with h the Planck constant ($6.63\times10^{34}$ J s), c the speed of light ($3.00\times10^8$ m/s) and $k_B$ the Boltzmann constant ($1.38\times10^{23}$ J/K). As the temperature should be monitored during both the primary and secondary drying phase, $B_\lambda$ was calculated for a vial temperature which can vary from approximately −50° C. to 50° C. For each temperature in this interval, $B_\lambda$ is plotted in function of in the $1.0\times10^{-6}$ m to $25.0\times10^{-6}$ m region, as shown in FIG. 25. These spectra were compared to the transmission properties of different window materials for minimal loss of information. Taking other properties into account, e.g. the mechanical resistance of the window material to the vacuum in the drying chamber, germanium was selected because of the good transmission properties in the spectral region of interest. A germanium disk with a thickness of 3 mm and an anti-reflectance coating was implemented in the polycarbonate door of the drying chamber via a plastic interface and rubber rings, eventually leading to an IR transparent window with a diameter of 30 mm.

In an exemplary freeze-drying set-up in accordance with embodiments of the present invention, a 10 mL type I glass vial (Schott, Müllheim, Germany) was filled with 3.9 mL of an aqueous 3 mg/mL sucrose (Sigma-Aldrich, Saint Louis, Mo., USA) solution and spin frozen as previously described hereinabove. The glass vial was positioned in a vial holder and vertically rotated along its longitudinal axis at approximately 2900 rpm. The solution was spread uniformly across the entire vial wall before the rotating vial was immersed into liquid nitrogen for 40±5 s, leading to complete solidification of the product. Within 15±5 s after spin freezing, the vial was transferred from the liquid nitrogen to the drying chamber of an Amsco FINN-AQUA GT4 freeze-dryer (GEA, Köln, Germany), to avoid exceeding $T_g'$ of the formulation. The shelves in the drying chamber were cooled at a fixed temperature of −10° C. to minimize its radiation contribution to the spin frozen vial during drying. The vial was hung in front of one IR heater (Weiss Technik, Zellik, Belgium) at a distance of 4 cm measured from the center of the vial until the heated laments of the IR heater, without making contact with the shelf. To achieve a homogeneous radiation energy transfer, the spin frozen vial was continuously rotating at 5 rpm. When the vial was placed in the drying chamber, the pressure was immediately lowered to 13.3 Pa. Within 5 minutes, the pressure was below the triple point of water. After 17 minutes, the desired pressure was reached and the IR heater was activated. Primary drying was conducted at a constant electric power input Pe of 7 W, supplied by the Voltcraft PPS-11360 power supply (Conrad Electronic, Hirschau, Germany) to the IR heater. The amount of ice sublimed during the initial pressure decrease, i.e. the 17 minutes lasting period between activating the vacuum pump and the IR heaters, was gravimetrically determined in triplicate.

The temperature of the spin frozen vials was continuously monitored using a FLIR A655sc IR camera (Thermal Focus, Ravels, Belgium) equipped with a 45° lens and an uncooled micro-bolometer as detector. The IR camera was placed in front of the polycarbonate door, measuring through the germanium window inside the drying chamber, as illustrated in FIG. 24. The spin frozen vial was slowly rotating at a distance of 350+/−10 mm of the camera. The depth of field far and near limit were approximately 380 and 320 mm, respectively. Hence, each object situated between these limits was in the focus range. The IR heater was positioned at an angle of 90°. Thermal images were recorded with an image size of 640×480 IR pixels. At the specified measuring distance, the width of the vial (24 mm) took up approximately 80 pixels, leading to a spatial resolution of 0.30 mm. A small portion of the top and the bottom of the spin frozen vial was hidden behind the IR window interface. The thermal resolution of the IR camera was 30 mK Noise Equivalent Temperature Difference (NETD). Each minute a thermal image was recorded via the FLIR ResearchIR MAX software (Thermal Focus, Ravels, Belgium). Data processing was conducted using the same software. The germanium window had a transmission of 85% in the wavelength region of interest, while the emissivity of the glass vial was 0.92.

The IR camera measures the temperature of the outside of the vial wall. During primary drying, the accurate measurement of the temperature at the sublimation interface $T_i$ requires an appropriate compensation for the temperature gradient over the glass wall and the ice layer, which are in close contact with each other. Due to the endothermic nature of the process, the radiation energy provided during primary drying is completely consumed for ice sublimation and $T_i$ (almost) remains constant. Therefore, the system can be assumed to be at steady-state. Hence, the temperature gradient can be quantified by Fourier's law of thermal conduction, which states that the rate of heat flow per unit area is proportional to the temperature gradient. After integrating from the outer radius of the glass vial $r_{v,o}$ to the inner radius $r_{v,i}$ for the specific cylindrical geometry, see FIG. 26, the one-dimensional heat conduction over the glass wall of the vial is given by:

$$P_{tot} = 2\pi k_{glass} h \frac{(T_{v,o} - T_{v,i})}{\ln\left(\frac{r_{v,i}}{r_{v,o}}\right)}$$

with $P_{tot}$ the total power provided to the spin frozen vial (W), $k_{glass}$ the thermal conductivity of glass (1.05 W/(m K)), h the height of the spin frozen product (m), $T_{v,o}$ the temperature measured at the outer side of the vial wall (K), $T_{v,i}$ the temperature at the inner side of the vial wall (K), $r_{v,i}$ the inner radius of the glass vial (m) and $r_{v,o}$ the outer radius of the glass vial (m). The temperature gradient over the thin ice layer is also calculated via this equation hereinabove, in which $T_{v,o}$ and $T_{v,i}$ are replaced by $T_{v,i}$ and $T_i$ (K) and $r_{v,o}$ and $r_{v,i}$ by $r_{v,i}$ and the sum of the radius from the center of the vial to the border of the spin frozen layer $r_{p,i}$ (m) and the thickness of the dried product layer 1 (m), respectively (see FIG. 26). Also, the thermal conductivity of ice $k_{ice}$ (2.18 W/(m K)) is taken into account instead of $k_{glass}$. Due to the close contact between the ice layer and the vial wall, the thermal contact resistance between the glass and ice is assumed to be negligible.

The power provided by the IR heater to the spin frozen vial during primary drying $P_{rad}$ can be calculated via the Stefan-Boltzmann law:

$$P_{rad}=A_{rad}F\sigma(\epsilon T_{rad}^4-aT_{v,o}^4)$$

with $A_{rad}$ the surface area of the IR heater ($m^2$), F the view factor (−), σ the Stefan-Boltzmann constant ($5.67\times10^{-8}$ W/($m^2$ $K^4$)), ∈ the emission coefficient of the IR heater (−), $T_{rad}$ the temperature of the IR heater (K) and a the absorptivity of the glass vial (−). In general, a is estimated as the value for a given surface, in this case the glass vial. F is defined as the percentage of total radiation which leaves the surface of the IR heater and goes directly to the target surface, i.e. the spin frozen vial. Here, the IR heater was considered to be a diffuse emitter, meaning, the surface emits radiation uniformly in all directions. Hence, F only depends on the relative geometric orientation of the emitting IR heater surface to the spin frozen vial, represented by a flat plate and a cylinder, respectively. F is computed based on a Monte Carlo method described by Mortier et al. This Monte Carlo method is a simulation approach in which a defined number of rays is propagated from random positions on the emitting surface at randomly chosen angles. For each generated ray, it is evaluated whether it will directly hit the target surface or not. F is estimated by the ratio of the number of rays that strike the target surface to the total amount of emitted rays. Finally, the radiation energy provided by the surrounding surfaces (e.g. the chamber walls and door) to the spin frozen vial $P_{sur}$ was experimentally determined. Hence, $P_{tot}$ was compensated for this additional energy contribution:

$$P_{tot}=P_{rad}+P_{sur}$$

Figure 26:
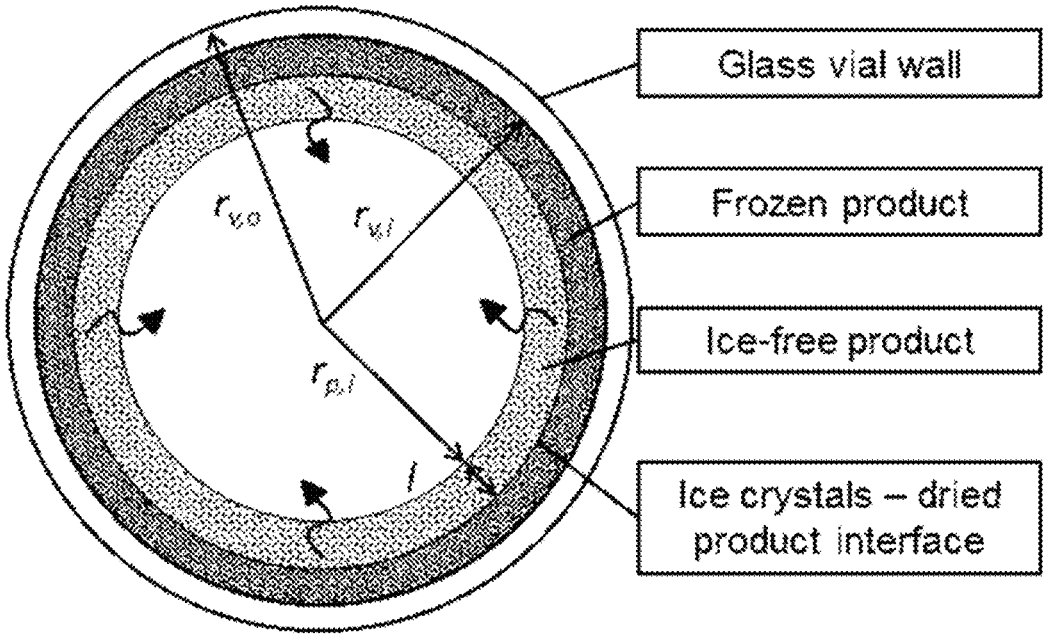
FIG. 26 shows an illustration of a cross-section of a spin frozen vial during primary drying with specified temperatures and radii, relating to an example illustrating embodiments of the present invention.

During primary drying, the sublimation front gradually moves from the center of the vial towards the glass wall, leaving a (connected) porous product matrix (see FIG. 26). The water vapour generated at this sublimation interface escapes through this porous structure before eventually reaching the condenser. The flux of water vapour through the pores is restricted by the dried product mass transfer resistance Rp. Exceeding this mass ow limit is associated with a local increase in vapour pressure at the sublimation interface $P_{w,i}$ due to the saturation of the pores. As $T_i$ is in equilibrium with $P_{w,i}$, $T_i$ will also increase. However, $T_i$ should be maintained below $T_{i,crit}$ during the entire primary drying step to avoid collapse of the product. Therefore, the determination of $R_p$ may be important for the development of the optimal freeze-drying cycle, e.g. the optimal dynamic IR heater temperature profile, for a specific formulation, allowing a maximum primary drying efficiency while yielding a decent cake aspect.

The dried product mass transfer resistance $R_p$ (m/s) is correlated to the ratio of the vapour pressure gradient and the mass flow rate by the following equation:

$$R_p = \frac{A_p(P_{w,i} - P_{w,c})}{\dot{m}_{sub}}$$

with $A_p$ the product surface area available for sublimation ($m^2$), $P_{w,i}$ the vapour pressure of ice at the sublimation interface (Pa), $P_{w,c}$ the partial pressure of water in the drying unit (Pa) and $\dot{m}_{sub}$ the sublimation rate during primary drying (kg/s). $P_{w,c}$ is considered to be equal to the overall pressure in the drying unit $P_c$, as the gas composition in the primary drying unit consists almost entirely of water vapour, similar to batch freeze-drying. The system was assumed to be at steady-state, hence, $m_{sub}$ is directly linked to $P_{tot}$. This relation is given by:

$$\dot{m}_{sub} = \frac{P_{tot} M}{\Delta H_s}$$

where M is the molecular weight of water (0.018 kg/mol) and $\Delta H_s$ is the latent heat of ice sublimation (51139 J/mol). $P_{tot}$ is determined via the Stefan-Boltzmann law, based on the measurement of $T_{v,o}$ using the IR camera, including the compensation for $P_{sur}$. Alternatively, $\dot{m}_{sub}$ can also be determined via a gravimetric procedure, requiring a series of experiments. $P_{w,i}$ is in equilibrium with $T_i$, calculated by the following empirical equation:

$$P_{w,i} = 3.6\ 10^{12} e^{-\frac{6145}{T_i}}$$

where $T_i$ is determined based on the measured value of $T_{v,o}$, taking the temperature gradient over the glass wall and the ice layer into account. $A_p$ of the spin frozen layer is calculated by:

$$A_p = 2\pi(r_{p,i} + l)h$$

where $r_{p,i}$ is given by:

$$r_{p,i} = \sqrt{r_{v,i}^2 - \frac{V}{\pi h}}$$

with V the filling volume ($m^3$). Due to the cylindrical shape of the cake, $A_p$ increases with the gradual movement of the sublimation interface from the inside of the vial towards the vial wall (see FIG. 26).

$R_p$ is formulation-specific and is strongly influenced by the size of the pores in the dried product layer, which is mainly determined by the freezing procedure and the degree of supercooling during this freezing step. In addition, as the path of water vapour originating from the sublimation front and flowing through the pores of the dried product layer prolongs with the primary drying progress, $R_p$ generally increases with the corresponding increase in l. This relation is given by the following empirical equation:

$$R_p = R_{p,o} + \frac{A_{R_p} l}{1 + B_{R_p} l}$$

where $R_{p,0}$ (m/s), $A_{Rp}$ (1/s) and $B_{Rp}$ (1/m) are constants describing $R_p$ in function of the thickness of the dried product layer 1. $R_p$ is calculated in function of drying time t for a specified time interval Δt (e.g., 60 s) via the hereinabove mentioned equation $$R_p = \frac{A_p(P_{w,i} - P_{w,c})}{\dot{m}_{sub}}.$$

The increase in the dried layer thickness Δl (m) is calculated for the same Δt by:

$$\Delta l = \frac{\dot{m}_{sub}\Delta t}{A_p \rho_{ice} \phi}$$

with $\rho_{ice}$ the density of ice ($kg/m^3$) and ϕ the volume fraction of ice (–). This equation is fitted to the experimental $R_p$ data in function of 1 via non-linear regression, resulting in the $R_p$ constants.

Diffuse reflectance NIR spectra were continuously in-line collected with an Antaris™ II Fourier-Transform NIR spectrometer (Thermo Fisher Scientific, Erembodegem, Belgium), equipped with a quartz halogen lamp, a Michelson interferometer and an InGaAs detector. The fibre optic probe was implemented in the drying chamber at a distance of 0.5+/−0.1 mm near the middle of the vial without hampering or disturbing the rotation of the vial. As drying progresses from the center of the vial to the inner vial wall, in-line NIR spectroscopy allowed the detection of complete ice removal, i.e. the endpoint of primary drying. Every 20 seconds a NIR spectrum was collected in the 4500-10000 $cm^{-1}$ region with a resolution of 16 $cm^{-1}$ and averaged over 4 scans. The illumination spot size obtained with the NIR probe was approximately 28 $mm^2$. Due to rotation of the vial during the measurements, each spectrum was collected at a different position of the cake on a specific height. It was assumed that this monitored part is representative for the whole cake.

The collected NIR spectra during each validation run were analyzed with the help of the multivariate data analysis software SIMCA (Version 14.0.0, Umetrics, Umea, Sweden). The NIR spectra collected before activation of the heaters were removed from each dataset. The Savitzky-Golay filter was applied to smooth the spectra: a quadratic polynomial function was fitted to a moving sub-model, each containing fifteen data points. Additionally, Standard Normal Variate (SNV) preprocessing was applied to eliminate the additive baseline offset variations and multiplicative scaling effects in the spectra which may be caused by small variations in distance between the NIR probe and the rotating glass vial and possible differences in product density. Principal Component Analysis (PCA) was then used for the analysis of the preprocessed and mean-centered NIR spectra.

PCA is an unsupervised multivariate projection method which extracts and displays the variation in the data set. The original variables, e.g. the individual wave numbers of the NIR spectra, are replaced by a new set of latent variables, named principal components (PCs). These PCs are sequentially acquired by an orthogonal, bilinear decomposition of the data matrix. Each component explains most of the remaining variability in the data. PCs are composed of a score and a loading vector. The score vector contains a score value for each spectrum, which describes its quantitative relation to the other spectra. The loading vector provides qualitative information about which spectral features present in the original observations are captured by the corresponding component.

The glass transition temperature ($T_g'$) of the 3 mg/mL sucrose formulation was determined via Modulated Differential Scanning calorimetry (MDSC) using a differential scanning calorimeter Q2000 (TA instruments, Zellik, Belgium). Hermetically sealed aluminium pans (TA instruments, Zellik, Belgium) were filled with approximately 12 mg of the formulation. The DSC cell was constantly purged with dry nitrogen at a rate of 50 mL/min. The sample was initially cooled until −90° C. This temperature was maintained for 5 minutes. Subsequently the temperature was linearly increased until 0° C. at a heating rate of 2° C./min. The modulation amplitude and period were set at 0.212° C. and 40 seconds, respectively. The analysis was conducted in duplicate. The thermograms were analysed with TA Instruments Universal Analysis 2000 version 4.7A (TA Instruments, Zellik, Belgium).

Figure 27:
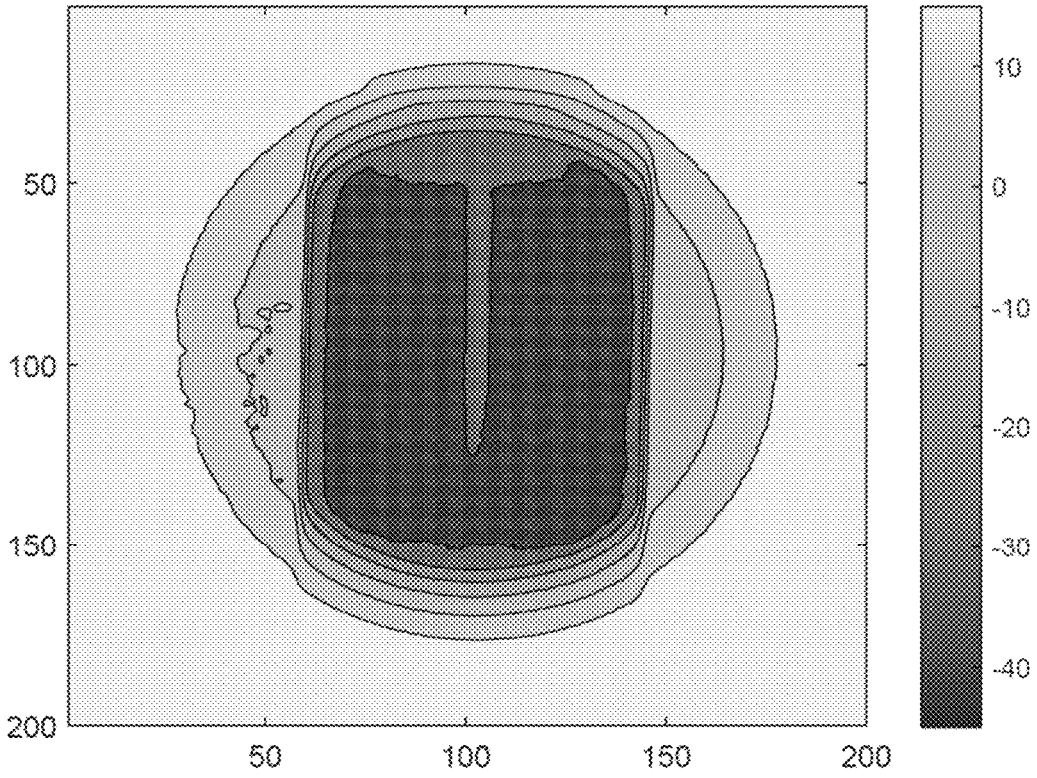
FIG. 27 shows a thermal image of a spin-frozen vial just before activation of IR heaters, in an example illustrating embodiments of the present invention.
Figure 28:
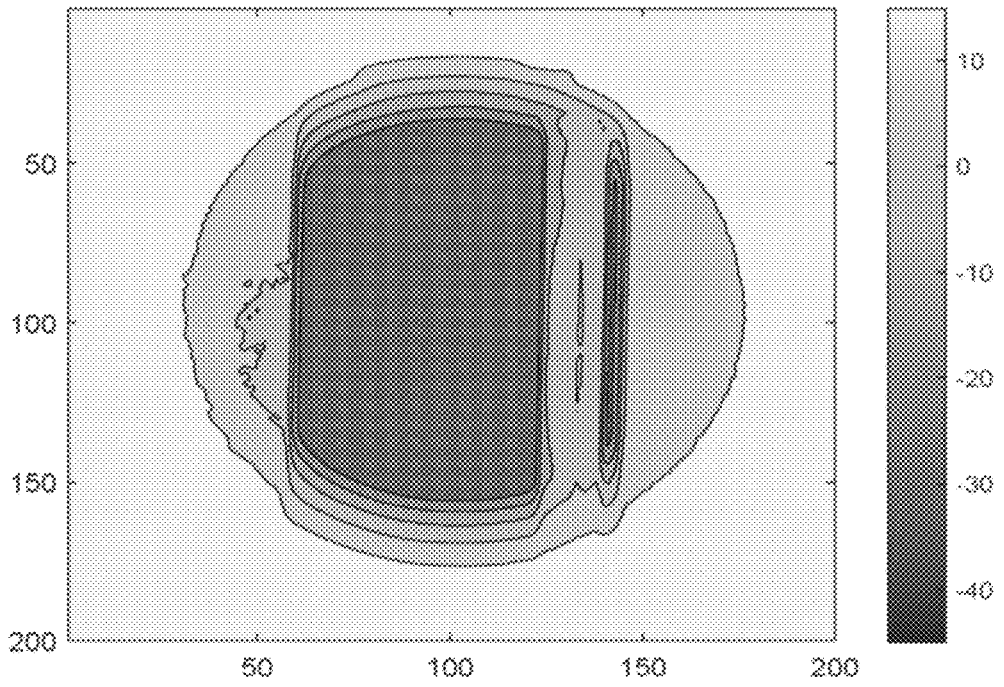
FIG. 28 shows a thermal image of a spin-frozen vial, 20 minutes after activation of IR heaters, in an example illustrating embodiments of the present invention.
Figure 29:
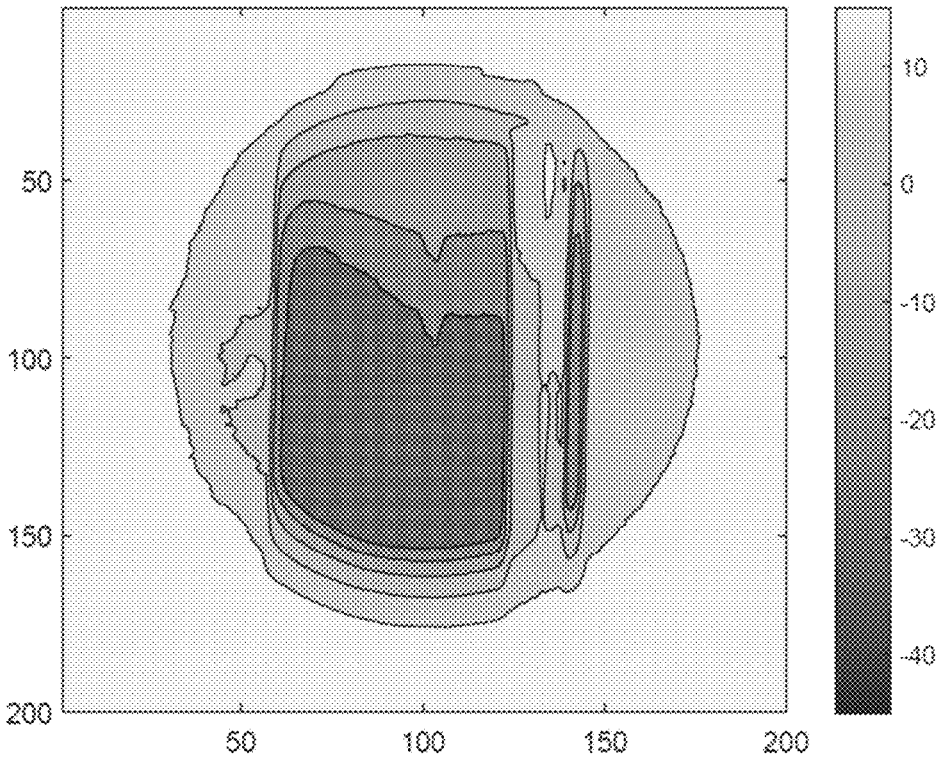
FIG. 29 shows a thermal image of a spin-frozen vial, after 100 minutes of primary drying, in an example illustrating embodiments of the present invention.

The thermal images obtained at different time points during the primary drying of a (rotating) spin frozen vial are illustrated in FIGS. 27 to 29. The IR window and glass vial can be clearly distinguished from the surrounding interface, which had a temperature higher than 15° C. As the pixels from the interface did not contain any useful information, they were partially removed from the thermal images. This way, the size of the original image was reduced to 200×200 IR pixels, highlighting the vial which was positioned in the center of the germanium window.

The thermal image in FIG. 27 shows a spin frozen vial under constant vacuum (13.3 Pa), just before activation of the IR heater. Generally, the measured temperature $T_{v,o}$ was approximately −37° C., slightly higher than the equilibrium temperature for $P_c$ at that time calculated via the equation hereinabove, but ice sublimation was already ongoing due to the energy input provided by the surroundings. In addition, $T_{v,o}$ needs to be compensated for the temperature gradient over the glass wall and the ice layer. In the middle and at the edge of the vial, thin bands are present with temperature values deviating from the rest of the glass surface. These bands remained in the same position despite the rotation of the spin frozen vial, indicating they originated from external factors instead of being a characteristic of the monitored vial itself. The band in the middle of the vial occurred due to reflectance inherent to the experimental set-up, while the pixels at the edge also resulted in a higher value for $T_{v,o}$. These observations were present in each thermal image recorded during the entire drying process. The temperature data in these points were not relevant in relation to the product information and these regions were excluded from further analysis.

The thermogram in FIG. 28 was captured 20 minutes after activating the IR heater. $T_{v,o}$ had raised compared to the thermal image in FIG. 27, as the increased energy input led to a higher sublimation rate, associated with a local increase in $P_{w,i}$ and, consequentially, $T_i$. The emitted radiation energy reflected on the vial side facing the IR heater, leading to unreliable $T_{v,o}$ data in that position. In combination with the previous findings, the region of interest for the correct and reliable measurement of $T_{v,o}$ was situated on the vial side facing away from the IR heater, with a safety margin to avoid any reflective in influence as observed at the edge and the middle of the vial.

The third thermal image, in FIG. 29, was obtained after 100 minutes of primary drying. A steep increase in $T_{v,o}$ indicates complete ice removal as the provided radiation energy is no longer consumed for ice sublimation. Instead, the energy is used to heat up the glass vial and its content, associated with higher values for $T_{v,o}$. The thermogram in FIG. 29 indicates that primary drying was finished earlier in the top part of the spin frozen layer compared to the bottom part. This observation can be explained by the difference in product layer thickness between top and bottom of the cake, originating from the spin freezing step. Fast rotation of the vial results in a thin layer with a parabolic shape of the liquid surface. The inherent deviation in layer thickness between the top and the bottom of the vial is calculated by:

$$\Delta L_{tot} = \frac{hg}{2\pi\omega^2 r_{p,i}}$$

with $\Delta L_{tot}$ the deviation to the average thickness of the spin frozen layer (m), g the gravitational acceleration (9.81 m/s$^2$) and ω the angular velocity (rad/s). For the maximum rotation speed of the current experimental set-up (2900 rpm), the relative deviation in layer thickness between the cake at the top and the bottom of the vial is 8.96%. By increasing the rotation speed to 4000 rpm, this relative deviation can be reduced until 4.72%. This rotation speed is intended as standard value for the continuous freeze-drying system, without being harmful for biopharmaceuticals, with the ability to further increase until a maximum of approximately 6000 rpm.

Figure 30:
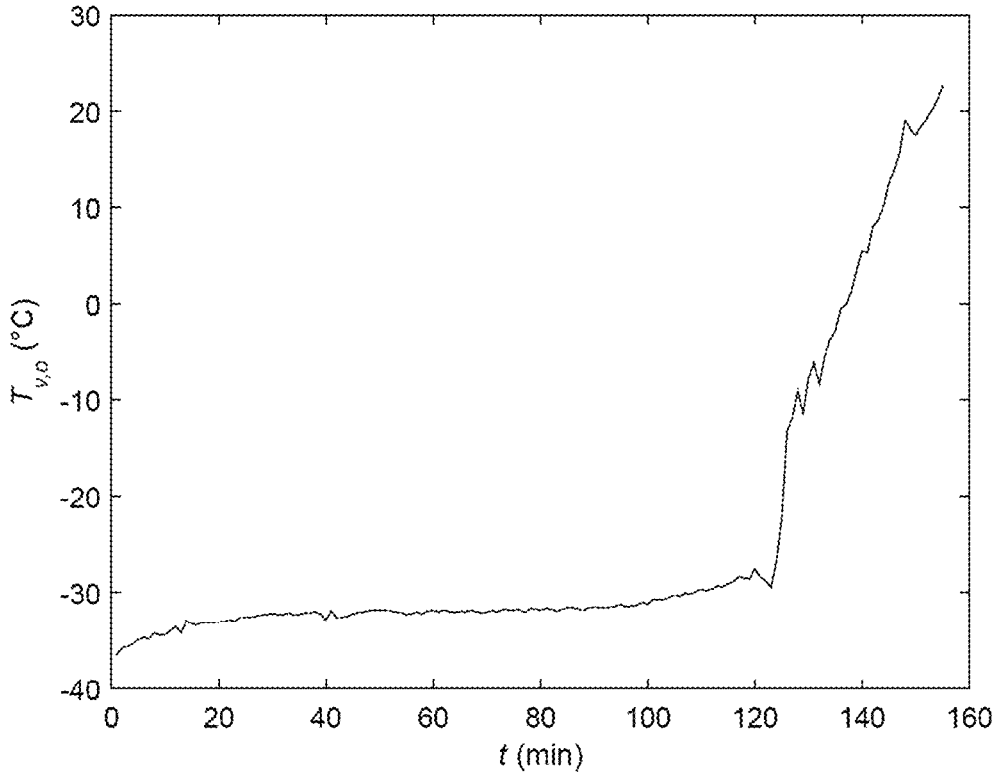
FIG. 30 shows the temperature at the outer vial wall in function of drying time, in an example illustrating embodiments of the present invention.

The mean temperature of the glass vial $T_{v,o}$ is plotted in function of drying time t in FIG. 30. The mean value of $T_{v,o}$ was calculated for a region without any reflective contribution from the surroundings or the IR heater. This region was located approximately in the middle of the vial between pixel 75 and 90 on the x-axis and 110 and 130 on the y-axis (see FIG. 27-29). At this position, the layer thickness approaches the average theoretical value of the spin frozen product layer. The small fluctuation in $T_{v,o}$ originates from the rotation of the vial.

Initially, $T_{v,o}$ increases a few degrees until a plateau value is reached after approximately 25 minutes. This gradual temperature rise is caused by the increase in $R_p$, as will be discussed further hereinbelow. Only after 100 minutes, $T_{v,o}$ starts to rise again followed by a steep increase after 124 minutes. As observed in FIG. 29, a steep increase in $T_{v,o}$ indicates that the amount of ice is diminishing as the provided energy is no longer consumed for sublimation but to heat up the glass vial. As confirmation, the primary drying endpoint was determined via the NIR spectroscopy method which is extensively described in literature. This method is based on PCA to analyze the NIR spectra which were collected in-line during the drying stage. This way, the primary drying endpoint was estimated to be reached after 128 minutes. This value is in accordance with the data obtained by the IR camera and confirms the applicability of IR thermography to determine the primary drying endpoint.

Via NIR spectroscopy, the primary drying progress is monitored at one specific height of the rotating vial while IR thermography provides a two-dimensional image with additional spatial information. Hence, IR thermography allows the monitoring of the drying behavior for the complete spin frozen layer. Even multiple vials of the continuous belt could be monitored at once, offering a huge advantage to NIR spectroscopy, making use of a single probe. Multipoint NIR spectroscopy could offer an alternative for the monitoring of multiple vials, while NIR chemical imaging could be applied to image the complete vial. NIR spectroscopy and IR thermography are highly complementary as the first can provide detailed in-line information about several CQAs as residual moisture content, protein conformation or the solid state of different components (e.g. mannitol) while the latter is an essential tool regarding product appearance by monitoring $T_i$. Eventually, the combination of both IR thermography and NIR spectroscopy will be implemented in the continuous freeze-drying equipment for optimal real-time process monitoring and control.

The temperature at the sublimation front $T_i$ is calculated based on the measured temperature at the outer vial wall $T_{v,o}$ via Fourier's law. $T_{v,o}$ and $T_i$ are plotted in function of t in FIG. 31. During primary drying, the lowest temperature is situated at the interface where sublimation occurs. Hence, $T_i$ is constantly lower than $T_{v,o}$ and energy is transferred from the outer glass wall towards the sublimation front. With the progress of primary drying, the ice layer thickness gradually decreases. Provided that the energy flux remains constant, the absolute temperature difference between $T_{v,o}$ and $T_i$ also decreases. At the start of the primary drying step, the temperature gradient was 0.88° C., while towards the end, the temperature difference over the glass wall was decreased until 0.47° C.

Before the steep temperature rise indicating the end of primary drying, $T_{v,o}$ starts to increase steadily after 100 minutes while the NIR data indicate that traces of ice are still present in the product. Possibly, the remaining (low) amount of ice might not sufficiently cool the glass vial which might cause the gradual increase in $T_{v,o}$ observed towards the end of primary drying (see FIG. 30). Starting from this point, the calculated Ti might be unreliable for the few last minutes of the primary drying stage.

Figure 31:
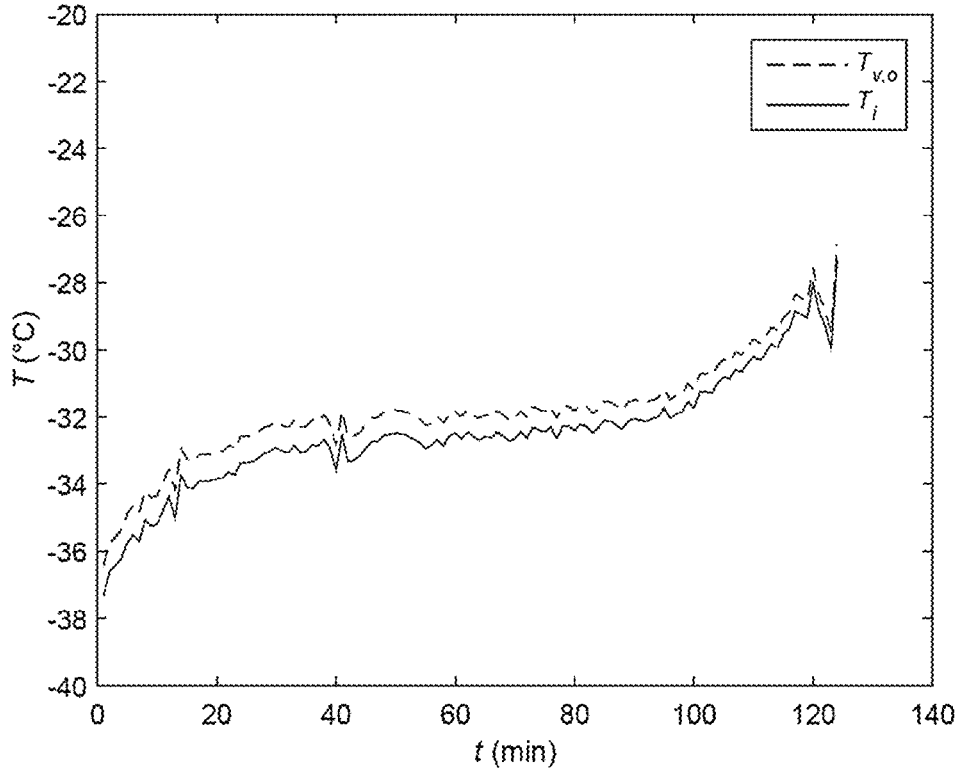
FIG. 31 shows the temperature at the outer vial wall (dashed) and the temperature at the sublimation front (solid) as function of drying time, in an example illustrating embodiments of the present invention.
Figure 32:
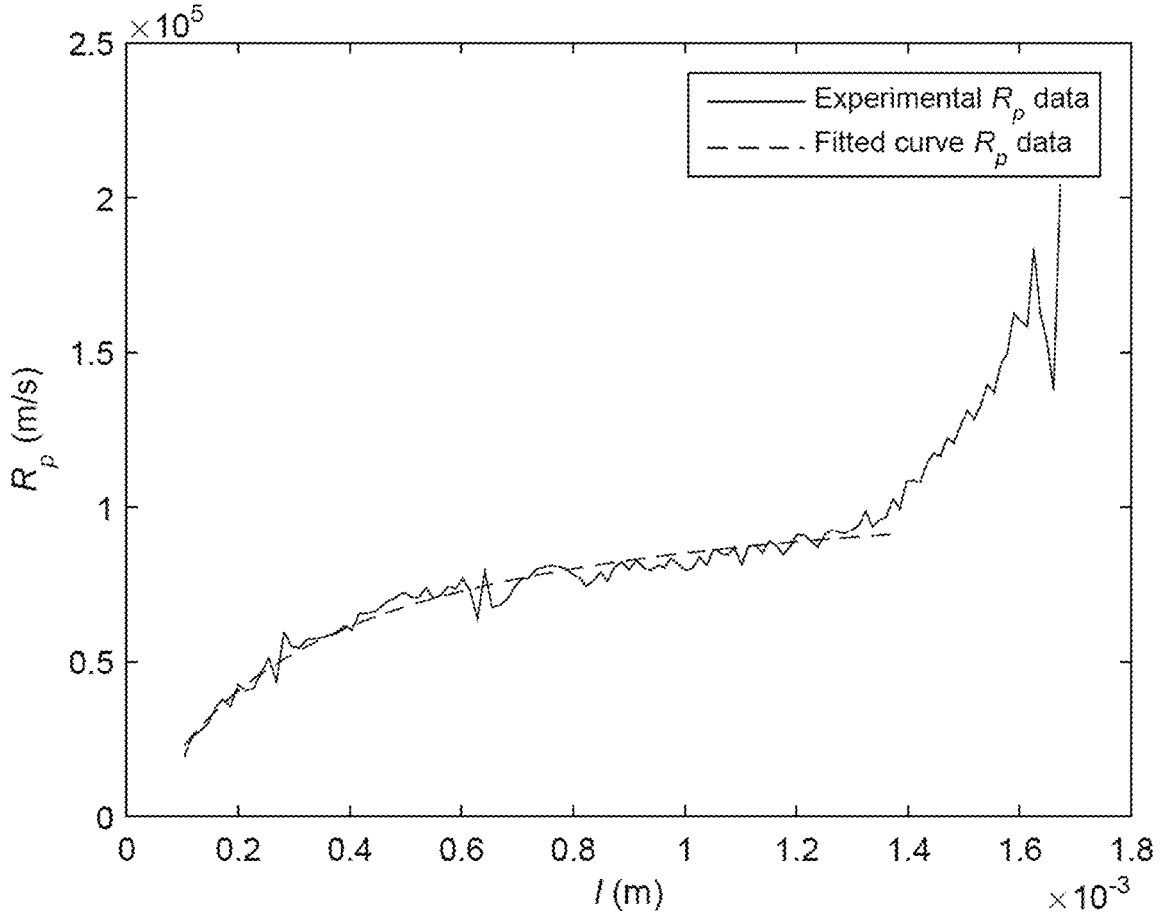
FIG. 32 shows the dried product mass transfer resistance as function of the dried layer thickness, in an example illustrating embodiments of the present invention.

Based on the measurement of $T_i$, the dried product mass transfer resistance $R_p$ is calculated and plotted in function of the dried layer thickness 1 in FIG. 32. The Rp profile has a similar shape as the $T_i$ curve. $R_p$ is plotted starting at a dried layer thickness of 0.0001 m because of ice sublimation during the initial pressure decrease. The seemingly steep increase in $R_p$ at a dried layer thickness of approximately 0.0014 m is an anomaly associated with the temperature rise towards the end of primary drying (FIG. 31). This last part of the $R_p$ profile was not included for the equation fitting to the computed data, as $T_i$ was considered unreliable for the very last part of primary drying, leading to an overestimation for $R_p$.

Via non-linear regression, $R_{p,0}$=−9.22 $10^3$ m/s (95% confidence interval [−2.10 $10^4$ m/s, 2.60 $10^3$ m/s]), $A_{Rp}$=4.22 $10^8$ 1/s ([2.79 $10^8$ 1/s, 5.65 $10^8$ 1/s]) and $B_{Rp}$=3.48 $10^3$ 1/m ([2.50 $10^3$ 1/m, 4.46 $10^3$ 1/m]) were calculated. The 95% confidence interval for $R_{p,0}$ included zero, indicating that at the start of primary drying (1=0), $R_p$ was minimal as no pores were present to limit the mass flow. Often, $R_{p,0}$ is assumed to be zero because of the theoretical absence of any product resistance when sublimation is initiated. This condition was not imposed for the regression analysis, as this point was situated outside the experimental region, but the $R_{p,0}$ coefficient seems to confirm this theory.

With the increase in 1, $R_p$ increased towards a plateau value causing the fit-parameter $B_{Rp}$ to be significantly different from zero. This behavior has been observed in previous instances for pure sucrose formulations and is attributed to the onset of microcollapse due to the very low $T_g'$ of the formulation (−32.5° C.).

The computed $R_p$ profile is in the same order of magnitude as reported for similar formulations. However, the obtained results are not directly comparable with these literature data as the shape of the product and the process settings for $R_p$ determination were different.

The results indicate that IR thermography is a suitable technique to determine $R_p$ in function of 1 for spin frozen vials. This is an important result in the development and optimization of the primary drying process conditions (e.g. the dynamic IR heater profile) for the continuous freeze-drying of a wide range of products. In addition, the proposed procedure allows to evaluate the influence of different process and formulation parameters on $R_p$, which can be readily applied in reducing the continuous freeze-drying methodology in accordance with embodiments of the present invention to practice.

Non-invasive IR thermography was shown, in this example, to be particularly suitable for in-line temperature monitoring during the drying step of the continuous freeze-drying concept. The IR camera allowed the detection of the primary drying endpoint in spin frozen vials, confirmed by NIR spectroscopy. The implementation of both these complementary PAT tools offer optimal process monitoring and control of several CQAs during continuous freeze-drying. As the sublimation front in spin frozen vials moves in the direction of the IR camera, this technique allowed the measurement of the dried product mass transfer resistance $R_p$ in function of the dried layer thickness 1. The temperature gradient over the glass wall and ice layer was compensated via Fourier's law of thermal conduction to calculate the temperature at the sublimation front $T_i$. Furthermore, since the temperature measurement is taken from the area with highest temperature in the system (vial+product), it can provide a safeguard to reaching too high temperatures anywhere in the product. The described method is useful for the optimization of the dynamic IR heater profile during the continuous freeze-drying of a specific product and will allow to evaluate the impact of several process parameters on $R_p$.

APPENDIX, EXAMPLE OF MATHEMATICAL MODEL IN MORE DETAIL

It is noted that the information in this appendix is only an example, and that the present invention is not limited thereto. When words like "must" etc. are used, those words are limited to the example described in the appendix.

Determining the Temperature at the Sublimation Front and the Dynamic Safety Margin This exemplary calculation scheme assumes the application of a heater that supplies radiant heat to the container.

Radiant heat is supplied by a radiating surface. The energy transfer (in J/s) from the radiator to the container can be calculated using Stefan-Boltzmann's law:

$$\text{Stefan-Boltzmann: } Q_R = e\sigma AF(T_r^4 - T_c^4), \quad [1]$$

wherein e is the emission coefficient of the radiator [−], σ the Boltzmann constant ($5.6703\times10^{-8}$ W/(m$^2$·K$^4$)) and A the radiating area [m$^2$]. F is the viewfactor [−], the ratio between the radiation captured by the container and the total emitted radiation. $T_r$ [K] and $T_c$ [K] are the absolute temperatures of the radiator and receiving surface respectively. Q [J/s] is the transmitted power. The viewfactor is dependent of the geometry of both radiator and container. In simple geometries the viewfactor can be determined analytically, but the viewfactor can also be derived by simulation with raytracing, or Monte Carlo Simulation. For optimal accuracy the effective radiant heat should be calibrated, using known settings of the radiator and measuring the amount of pure ice with known temperature that sublimates over time. In this way, the aggregation of the constants in formula [1], i.e. e, σ, A and F, can be determined.

By measuring the temperature of the container wall and combining this with the known settings of the radiator, the radiant heat transfer is determined. This heat is converted into latent heat which drives sublimation of the ice crystals of the product in the container. Since the initial layer thickness is known, the cumulative heat transfer can be translated into the growth of a dried layer, i.e. a layer which is deprived of ice crystals. The thickness of the layer containing ice crystals is equally known, by subtracting the dried layer thickness from the original layer thickness. To determine the temperature of the interfaces, ultimately knowing the temperature at the sublimation front, Fourier's law in one-dimensional form is used:

$$\text{Fourier's law: } Q_c = -kA\Delta T/L, \quad [2]$$

wherein k [W/(m·K] is the thermal conductivity of the material of a heat conducting slab, A [$m^2$] is the area of the heat conducting slab, ΔT [K] is the temperature difference between the two ends of the slab and L [m] is the length of the slab. The negative sign indicates that heat flows from high temperature to low temperature. Since the thermal conductivity of the container material and the thermal conductivity of ice are known, the temperature of the ice at the sublimation front can be determined using the fact that the radiant heat transfer is equal to the conductive heat transfer ($Q_R = Q_c$). For exemplary reasons, the calculation is illustrated for a glass container with thermal conductivity of $k_g$, of thickness $d_g$ and an exposed surface area $A_g$.

$$T_{in,g} = T_{out,g} - Q_c \times d_g / k_g A_g, \quad [3]$$

$$\text{With } Q_c = Q_R, T_{in,g} = T_{out,g} - Q_R \times d_g / k_g A_g, \quad [4]$$

with $T_{out,g}$ [K] and $T_{in,g}$ [K] indicate the outer and inner temperature of the glass container.

$$T_{in,g} = T_{out,ice} \quad [5]$$

$$d_{ice}(t) = d_{ice}(0) - \int_{t_0}^{t} Q_R / (\rho_{ice} \times H_{sublimation} \times A_{ice}) dt, \quad [6]$$

with $H_{sublimation}$[J/kg] the latent heat of sublimation for ice, $\rho_{ice}$ the density of ice [kg/$m^3$], $A_{ice}$ the surface area of the ice [$m^2$] and $d_{ice}(t)$ the thickness [m] of the ice at time t [s].

$$\text{Then } T_{sublimationfront}(t) = T_{out,ice} - Q_R \times d_{ice}(t) / (k_{ice} A_{ice}) \quad [17]$$

In this manner, the temperature at the sublimation front is known at all times. This is particularly important at the onset of the sublimation process. The temperature at the sublimation front provides information of the pressure of the water vapour at this sublimation front through the following formula:

$$p_{sublimationfront} = 27 \times 10^9 \times e^{\left(-\frac{6145}{T_{sublimationfront}}\right)}, \quad [8]$$

With $p_{sublimationfront}$ in Torr. To convert into Pa, the following relationship can be used:

$$p \text{ in Pa} = p \text{ in } Torr \times \frac{10^5}{760} \quad [9]$$

The pressure difference between the $p_{sublimationfront}$ and the partial vapour pressure in the chamber determines the water vapour flow which is driven out of the container. This flow will pass through the opening of the container. The speed of the water vapour is maximized by reaching the velocity of sound (choked flow), in which situation the pressure in the container will rise and this leads to uncontrolled rise of the temperature of the ice at the sublimation front and hence also to a rise of the temperature near the glass wall. Melting of the ice may occur at that location which is an undesirable situation.

From this example it is also clear, that the maximum temperature of the frozen product is determined as $T_{out,ice}$ and occurs at the interface of the glass container and the ice. After a certain time, the layer which does not contain ice crystals anymore will act as a resistance for the vapour to leave the substance. If the amount of radiant heat would be the same as the onset of sublimation, the pressure at the sublimation front would need to rise to compensate for the increasing resistance. This in turn would lead to a temperature rise at the sublimation front and subsequently lead to increased temperature at the glass-ice interface. Loss of structure, called collapse, would occur. Therefore the amount of radiant heat must be reduced as the sublimation progresses.

At the onset of sublimation the choked flow condition must be avoided, but this situation will not occur easily and therefore a small safety margin on process settings is accepted. Nevertheless, the temperature at the ice-glass interface may not exceed $T_{crit}$. In this situation, it is generally safe to control the power of the heater to achieve $T_{out,g} = T_{crit}$. At the maximum dry layer thickness it is advisory to avoid collapse and therefore it is necessary to stay 5 degrees C. below the $T_{crit}$ for all of the substance. In this example we propose a linear relationship between dry layer thickness and Safety Margin (SM). But other functions may be implemented, dependent of the specific substance. So in formula:

$$SM(t) = \frac{d_{ice}(0) - d_{ice}(t)}{d_{ice}(0)} \times 5 \text{ [K]} \quad [10]$$

At the onset of sublimation no safety margin is required, provided that the outer temperature of the glass does not exceed $T_{crit}$. Near the end of sublimation, the safety margin reaches 5 K. The relative level of residual moisture at the end of primary drying is of the order of 20%.

Determining the Safety Margin During Desorption

Desorption is used to reduce the residual moisture level to 1-3%. During desorption, heat is supplied to the substance which is now free of ice crystals. Therefore the temperature may rise above the ordinary melting point of ice. During desorption, the unfrozen water in the glassy formation of product and excipients is driven out and converted into vapour flowing out of the now porous structure (cavities exist where ice crystals have been). Although the exact details of this process are not fully understood yet, it is known that this process is fastest at higher temperatures. Therefore, in desorption the water molecules will primarily escape near the glass/product interface, where the temperature is highest. The temperature of this interface is similarly determined as with the sublimation process, which is described above. In literature (Ref1) it is stated that during desorption the $T_{crit}$ is rising with reduction of the residual moisture level. The consequence of this is that initially the temperature of the glass wall should be well below the $T_{crit}$ of the dry matter and gradually this safety margin may be reduced, dependent of the residual moisture. This residual moisture (RM) level is determined by a NIR system as described in literature (Ref2). Then, the determination of the Safety Margin may be described by the following formula:

$$SM(RM) = \frac{RM_{actual}}{RM_{final}} \times T_s, \quad [11]$$

Wherein $RM_{actual}$ and $RM_{final}$ denote the residual moisture [%] during the desorption process and residual moisture at the end of the process, respectively. $T_s$ [K] is the temperature margin which is acceptable at the end of the desorption process. This temperature is dependent of the product in the container.

Formula [11] indicates a linear relation between actual residual moisture level, but refinement may be achieved by applying other relationships, such as exponential of quadratic.

REFERENCES

[Ref 1]: "Moisture desorption isotherms and glass transition temperatures of osmo-dehydrated apple and pear", Nadia Djendoubi Mrad, et. al, IChemE J. (Foods and Bioproducts Processing), April 2013, Volume 91, Issue 2, Pages 121-128.

[Ref 2]: "Noncontact Infrared-Mediated Heat Transfer During Continuous Freeze-Drying of Unit Doses", P. J. Van Bockstal et. al, J Pharm Sci. 2016 Jun. 16. pii: S0022-3549(16)41414-0. doi: 10.1016/j.xphs.2016.05.003.

The invention claimed is:

1. A method of drying a frozen product stored in a container having a container wall defining a cavity for holding said product, the method being a method of drying by sublimation or being a method of drying by desorption, the method comprising the steps of:

a) capturing a thermal IR image of at least a portion of the container wall using at least one thermal IR camera;

b) processing the thermal IR image by determining a plurality of temperature values associated with a plurality of points located on an outer surface of the container wall, using an image processing module;

c) calculating a maximum temperature of the frozen product in the container using a mathematical model that models heat flow and that models progress of a drying process;

d) controlling an amount of power supplied to at least a portion of the container based on a calculated maximum product temperature and on a temperature safety margin;

e) repeating at least once a) to d).

2. The method according to claim 1, wherein the method further comprises:

step f) preceding step d) of determining a temperature safety margin as a temperature difference between a temperature of the frozen product and a predefined critical temperature related to the frozen product based on a calculated progress.

3. The method according to claim 2, wherein step f) comprises calculating the temperature safety margin using the mathematical model by taking into account at least one of:

a predetermined content of said frozen product;

at least a subset of the temperature values calculated in step b);

an estimated or calculated cumulative amount of heat energy provided to or absorbed by the container.

4. The method according to claim 1, wherein the container has a longitudinal axis and is rotated around the longitudinal axis and has a substantially circular cross-section in a plane perpendicular to the longitudinal axis; and wherein the mathematical model is mainly based on heat transfer from an outside of the container wall, through the container wall, and through a portion of the frozen product still containing ice crystals.

5. The method according to claim 1, wherein the method of drying is a method of sublimation, and wherein the mathematical model is based on one of the following models:

A) a model of supplying heat energy to a body comprising three concentric cylindrical shapes, comprising:

a) an outer cylinder formed by a material of the container;

b) an intermediate cylinder in physical contact with the outer cylinder and comprising a portion of the frozen product still containing ice crystals;

c) an inner cylinder containing a portion of the frozen product substantially free of ice crystals; or B) a model based on supplying heat energy to a body comprising a plurality of at least two disks, each disk comprising three concentric annular rings comprising:

a) an outer ring formed by the material of the container;

b) an intermediate ring in physical contact with the outer ring and comprising the portion of the frozen product still containing ice crystals;

c) an inner ring containing the portion of the frozen product substantially free of ice crystals.

6. The method according to claim 1, wherein the method of drying is or further comprises a method of desorption, and wherein the mathematical model is based on one of the following models:

A) a model of supplying heat energy to a body comprising three concentric cylindrical shapes, comprising:

a) an outer cylinder formed by a material of the container;

b) an intermediate cylinder in physical contact with the outer cylinder, comprising a portion of the frozen product substantially free of ice crystals, and substantially free of moisture content;

c) an inner cylinder containing a portion of the frozen product substantially free of ice crystals but still containing moisture content; or B) a model of supplying heat energy to a body comprising a plurality of at least two disks, each disk comprising three concentric annular rings:

a) an outer ring formed by the material of the container;

b) an intermediate ring in physical contact with the outer ring and comprising the portion of the frozen product substantially free of ice crystals, and substantially free of moisture content;

c) an inner ring containing the portion of the frozen product substantially free of ice crystals but still containing moisture content.

7. The method according to claim 1, wherein the container has a side wall portion having a cylindrical shape or a conical shape or a truncated conical shape or a paraboloid shape or a truncated paraboloid shape over at least a portion of a height of the container.

8. The method according to claim 1, wherein step d) comprises one or more of the following actions:

i) controlling an amount of power supplied to at least one heater;

ii) controlling a distance between the at least one heater and a cylinder;

iii) controlling an orientation between the at least one heater and the cylinder;

iv) controlling an exposure time of the container in front of the at least one heater;

v) controlling a translational and/or rotational movement of the cylinder.

9. The method according to claim 1, wherein step d) comprises controlling the amount of power supplied to the container by controlling at least a first amount of power provided to a first heater and by controlling at least a second amount of power provided to a second heater, located at a different position relative to the container.

10. The method according to claim 1, wherein at least one heater is movable relative to the container.

11. The method according to claim 1, wherein step d) comprises estimating or calculating at least one temperature of at least one point of the frozen product located in an intermediate cylinder or in an intermediate ring using the mathematical model; and wherein controlling at least one heater comprises controlling the at least one heater such that a product temperature is smaller than or equal to a critical temperature minus the safety margin.

12. A method of freeze-drying a liquid product, comprising:

g) providing a container;

h) inserting the liquid product in said container;

k) freezing the liquid product in said container while rotating the container about a longitudinal axis of the container at a predefined speed;

applying a first drying step for removing ice crystals from the liquid product, using the method according to claim 1.

13. The method of freeze-drying a liquid product according to claim 12, wherein step g) comprises providing a container containing a side wall portion having a substantially constant thickness and having a substantially paraboloid shape or a truncated paraboloid shape over at least a quarter of a height of the container; and wherein step k) comprises freezing the liquid product in said container while rotating the container about the longitudinal axis of the container at a predefined speed chosen corresponding to a curvature of the paraboloid shape, such that the liquid product will form a layer of substantially constant thickness against the side wall.

14. A freeze-drying apparatus for drying a frozen product stored in a container having a container wall defining a cavity holding said frozen product, the apparatus being adapted for drying said frozen product by sublimation and/or by desorption, the apparatus comprising:

a) a thermal IR camera for capturing a thermal IR image of at least a portion of the container wall;

b) an image processing module adapted for processing the thermal IR image by calculating a plurality of temperature values associated with a plurality of points located on an outer surface of the container wall;

c) at least one heater arranged for heating at least a portion of the outer surface of the container wall;

at least one of the following components: a power supply to the at least one heater, means for moving the at least one heater, means for moving the container;

d) a controller adapted for repeatedly:

calculating a temperature of the product in the container using a mathematical model that models heat flow and models progress of a drying process;

calculating a temperature safety margin; using a mathematical model that models heat flow and progress of the drying process of said frozen product in said container;

calculating a temperature safety margin between a temperature of the frozen product and a predefined critical temperature related to the frozen product;

controlling an amount of power supplied to at least a portion of the container by controlling at least one of the power supply, the means for moving the at least one heater, and the means for moving the container.

15. A kit of parts comprising the freeze-drying apparatus in accordance with claim 14 and a container suitable for use in said freeze-drying apparatus, the container having a longitudinal axis, and comprising a container wall defining a cavity for holding a product to be freeze-dried;

the container wall having a bottom portion and at least a lower side portion and optionally an upper side portion;

the lower side portion having a substantially constant thickness over at least a portion of a height of the lower side portion;

a cross-section of the lower side portion in a plane containing the longitudinal axis defines at least one substantially parabolic shape or truncated parabolic shape;

a cross section of the lower side portion in a plane perpendicular to the longitudinal axis having a substantially circular shape.

16. The kit of parts in accordance with claim 15, wherein said container comprises a frozen pharmaceutical composition, or a frozen biological composition, or a frozen cosmetic composition or a frozen medical nutritional product located at an inner surface of said side portion.

* * * * *